US006643861B2

(12) United States Patent
Sherlock et al.

(10) Patent No.: US 6,643,861 B2
(45) Date of Patent: Nov. 11, 2003

(54) BATH LIFTING SYSTEM

(75) Inventors: Mary Frances Sherlock, Kerrville, TX (US); Rainer Kuenzel, Hunt, TX (US)

(73) Assignee: Freedom Bath, Inc., Kerrville, TX (US)

( * ) Notice: Subject to any disclaimer, the term of this patent is extended or adjusted under 35 U.S.C. 154(b) by 0 days.

(21) Appl. No.: 10/254,358

(22) Filed: Sep. 25, 2002

(65) Prior Publication Data

US 2003/0019029 A1 Jan. 30, 2003

Related U.S. Application Data

(63) Continuation-in-part of application No. 10/085,197, filed on Feb. 27, 2002, which is a continuation-in-part of application No. 09/550,307, filed on Apr. 14, 2000, now Pat. No. 6,397,409.

(51) Int. Cl.[7] ..... A47K 3/02

(52) U.S. Cl. ..... 4/560.1; 4/561.1; 4/566.1; 4/604

(58) Field of Search ..... 4/560.1–566.1, 4/571.1, 573.1, 578.1, 579, 604

(56) References Cited

U.S. PATENT DOCUMENTS

| | | | |
|---|---|---|---|
| 1,934,117 | A | 11/1933 | Daley et al. |
| 2,033,166 | A | 3/1936 | Winters |
| 2,087,286 | A | 7/1937 | Hicks |
| 2,361,474 | A | 10/1944 | Gross |
| 2,494,224 | A | 1/1950 | Benson |
| 2,672,620 | A | 3/1954 | Gross |
| 2,697,475 | A | 12/1954 | Dueth |
| 2,772,721 | A | 12/1956 | Saunders |
| 3,022,518 | A | 2/1962 | Hayden |
| 3,071,779 | A | 1/1963 | Turner |
| 3,078,475 | A | 2/1963 | Turner |
| 3,106,723 | A | 10/1963 | Carpenter |
| 3,203,008 | A | 8/1965 | Murcott |
| 3,280,409 | A | 10/1966 | Cotner |
| 3,289,217 | A | 12/1966 | Glover |
| 3,307,204 | A | 3/1967 | Cotner |
| 3,317,928 | A | 5/1967 | Root |
| 3,381,317 | A | 5/1968 | Daniels et al. |
| 3,674,308 | A | 7/1972 | Radding |
| 3,714,672 | A | 2/1973 | Condon |
| 3,779,017 | A | 12/1973 | Fujisawa et al. |
| 3,918,108 | A | 11/1975 | Feyerherm |

(List continued on next page.)

FOREIGN PATENT DOCUMENTS

| | | |
|---|---|---|
| DE | 3511-267 A1 | 3/1985 |
| EP | 0 198 946 B1 | 10/1986 |
| EP | 0 198 946 A2 | 10/1986 |
| GB | 1099388 | 1/1968 |
| GB | 2 117 236 A | 10/1983 |

(List continued on next page.)

OTHER PUBLICATIONS

Marshall Brain, *How Stuff Works, How Water Towers Work,* by Marshall Brain (5 pgs) © 1998 BYG Publishing, Inc. http://www.howstuffworks.com/water.htm.

(List continued on next page.)

*Primary Examiner*—Tuan N. Nguyen
(74) *Attorney, Agent, or Firm*—Akin Gump Strauss Hauer & Feld LLP

(57) ABSTRACT

A bath lifting system comprises a seat which is raised and lowered inside of a bath by a lifting device positioned inside the bath. The lifting device provides an aesthetically appealing system with the seat substantially covering the lifting device, thus obscuring its view. The guiding assembly guides the seat from a lowered position to a raised position to facilitate ingress and egress to a bather. A composite bath embodiment and a retrofit embodiment, each with either straight up or laterally offset lifting, are disclosed. All the embodiments can use a closed self-pressurized system.

54 Claims, 32 Drawing Sheets

U.S. PATENT DOCUMENTS

| | | | | |
|---|---|---|---|---|
| 4,296,508 | A | * 10/1981 | Moran | 4/560.1 |
| 4,409,887 | A | 10/1983 | Shingu et al. | |
| 4,569,091 | A | 2/1986 | Brandenberger | |
| 4,628,550 | A | 12/1986 | Walton | |
| 4,726,081 | A | 2/1988 | Duffin et al. | |
| D297,876 | S | 9/1988 | Nolan | |
| 4,959,957 | A | 10/1990 | Schmale et al. | |
| RE33,624 | E | 7/1991 | Duffin et al. | |
| 5,129,112 | A | 7/1992 | Schaffer | |
| 5,146,638 | A | 9/1992 | Richards | |
| 5,226,183 | A | 7/1993 | Clark | |
| 5,263,207 | A | 11/1993 | Gilbert | |
| 5,279,004 | A | 1/1994 | Walker | |
| 5,329,651 | A | 7/1994 | Mardero et al. | |
| 5,341,820 | A | 8/1994 | Hammett | |
| 5,365,618 | A | 11/1994 | Gilbert | |
| 5,381,566 | A | 1/1995 | Sonesson et al. | |
| 5,396,670 | A | 3/1995 | Firebaugh et al. | |
| 5,402,541 | A | 4/1995 | Schmidt | |
| 5,499,694 | A | 3/1996 | Dorn | |
| 5,530,975 | A | 7/1996 | Firebaugh et al. | |
| 5,537,697 | A | 7/1996 | Parker | |
| 5,606,751 | A | 3/1997 | Baker | |
| 5,797,149 | A | 8/1998 | Mustarde | |
| 5,813,062 | A | 9/1998 | Vago et al. | |
| 5,822,809 | A | 10/1998 | Gallo | |
| 5,924,147 | A | 7/1999 | Clark et al. | |
| 6,279,685 | B1 | 8/2001 | Kogan et al. | |
| 6,311,952 | B2 | 11/2001 | Bainter | |
| 6,370,874 | B1 | 4/2002 | Rausch et al. | |
| 6,397,409 | B1 | 6/2002 | Sherlock et al. | |
| 2002/0100114 | A1 | 8/2002 | Sherlock et al. | |

FOREIGN PATENT DOCUMENTS

| | | | |
|---|---|---|---|
| GB | 2131291 | A | 6/1984 |
| GB | 2-242-126 | A | 9/1991 |
| GB | 2-248-547 | A | 4/1992 |
| WO | WO 91/05530 | A1 | 5/1991 |
| WO | WO 95/27464 | A1 | 10/1995 |

OTHER PUBLICATIONS

University of Rhode Island Cooperative Extension, *Rhode Island Home *A* Syst Water Conservation Kit,* ( 3 pgs) Resources Sciences (printed Nov. 12, 1999) (no date for publication) http://www.edc.uri.edu/homeasyst/page10.htm.

*Guardian Tublift, Assembly, Installation and Operating Instructions,* Guardian Products (5 pgs) (no date).

American Stair–Glide Corporation, *Tubmate Bath Lift, Stop Worrying and Enjoy Your Bath Again.* (2 pgs) (no date but note 250 PM 1085—54R).

*Bath & Shower Systems,* The Arjo Architect's Tools, ,2 pages, printed on Aug. 29, 2000, date of first publication unknown.

*Malibu,* The Arjo Architect's Tools, http://www.arjo.com/Present/Malibu/intro.htm, 1 page, printed on Sep. 8, 2000, date of first publication unkown.

*Assisted Bathing, Integrated Transport/Bathing,* The Arjo Architect's Tools, http://www.arjo.com/Present/Malibu/ass1.htm, 1 page, printed on Sep. 8, 2000, date of first publication unknown.

*Assisted Bathing, Transferring the Chair,* The Arjo Architect's Tools, http://www.arjo.com/Present/Malibu/ass2.htm, 1 page, printed on Sep. 8, 2000, date of first publication unknown.

*Assisted Bathing, Adjusting The Bath Height,* The Arjo Architect's Tools, http://www.arjo.com/Present/Malibu/ass3.htm, 1 page, printed on Sep. 8, 2000, date of first publication unkonw.

*Assisted Bathing, Washing Without Strain,* The Arjo Architect's Tools, http://www.arjo.com/Present/Malibu/ass4.htm, 1 page, printed on Sep. 8, 2000, date of first publication unknown.

*Product Specification,* The Arjo Architect's Tools, http://www.arjo.com/GB–INT/Malibu/prodspec.htm, 1 page, printed on Sep. 8, 2000, date of first publication unknown.

*Independent Bathing, Taking Control,* The Arjo Architect's Tools, http://www.arjo.com/Present/Malibu/indep2. htm, 1 page, printed on Sep. 8, 2000, date of first publication unknown.

*Space Requirements,* The Arjo Architect's Tools, http://www.arjo.com/GB–INT/Malibu/space.htm, 1 page, printed on Sep. 8, 2000, date of first publication unknown.

*Independent Bathing,* The Arjo Architect's Tools, http://www.arjo.com/Present/Malibu/indep.htm, 1 page, printed on Sep. 8, 2000, date of first publication unknown.

*Independent Bathing, Self Transfer,* The Arjo Architect's Tools, http://www.arjo.com/Malibu/indep1.htm, 1 page, printed on Sep. 8, 2000, date of first publication unknown.

*Assisted Bathing,* The Arjo Architect's Tools, http://www.arjo.com/Present/Malibu/ass.htm, 1 page, printed on Sep. 8, 2000, date of first publication unknown.

*Product Information,* ARJO Malibu, http://www.arjo.com/products/default.asp?Language=3&Category=23&Product=94, 1 page, printed on Feb. 11, 2001, date of first publication unknown.

*Installation Drawing,* ARJO Malibu, http://www.arjo.com/products/pdf/Malibu.pdf, 2 pages, printed on Feb. 11, 2001, date of first publication unknown.

*Product Specification,* ARJO Malibu, http://www.arjo.com/products/default.asp?Language=3&Category=23&Product=94Page199, 1 page, printed on Feb. 11, 2001, date of first publication unknown.

*Product Information,* ARJO Freedom Bath, http://www.arjo.com/products/default.asp?Language=3&Category=23&Product=119, 2 pages, printed on Feb. 11, 2001, date of first publication unknown.

*Technical Information,* Arjo Freedom Bath, http://www.arjo.com/products/default.asp?Language=3&Category=23&Product=119&Page=204, 2 pages, printed on Feb. 11, 2001, date of first publication unknown.

*Installation Drawing,* ARJO Freedom Bath, http://www.arjo.com/products/pdf/Freedom.pdf, 7 pages, printed on Feb. 11, 2001, date of first publication unknown.

*Product Information,* ARJO Prelude, http://www.arjo.com/products/default.asp?Language=3&Category=23&Product=121, 1 page, printed on Feb. 11, 2001, date of first publication unknown.

*Installation Drawing,* ARJO Prelude, http://www.arjo.com/products/pdf/Prelude.pdf, 4 pages, printed on Feb. 11, 2001, date of first publication unknown.

*Product Specification,* ARJO Prelude, http://www.arjo.com/products/default.asp?Lauguage=3&Category=23&Product=121&Page=200, 1 page, printed on Feb. 11, 2001, date of first publication unknown.

*Technical Information,* ARJO Prelude, http://www.arjo.com/products/default.asp?Language=3&Category=23&Product=121&Page=206, 1 page, printed on Feb. 11, 2001, date of first publication unknown.

*Technical Information,* ARJO Malibu, http://www.arjo.com/products/default.asp?Language=3&Category=23&Product=94&Page=205, 4 pages, printed on Feb. 11, 2001, date of first publication unknown.
*Product Specification,* ARJO Malibu, http://www.arjo.com/products/default.asp?Language=3&Category=23&Product=94&Page=199, 1 page, printed on Feb. 11, 2001, date of first publication unknown.
The Arjo Architect's Tools, http://www.arjo.com/GB–INT/Freedom/front.htm, 1 page, printed on Aug. 29, 2000, date of first publication unknown.
Dialog Patent Search Report, http://www.dialogweb.com/cgi/dwclient, ©2001 The Dialog Corporation plc, 5 pages (Jul. 17, 2001).
Dialog Patent Search Report, http://www.dialogweb.com/cgi/dwclient, ©2001 The Dialog Corporation plc, 18 pages (Jul. 23, 2001).
Dialog Patent Search Report, http://www.dialogweb.com/cgi/dwclient, ©2001 The Dialog Corporation plc, 11 pages (Jul. 17, 2001).
*Operating Instructions and Parts List,* Neptune Bath Lift, Mountway, Ltd., issue 3, 9 pages (Mar. 5, 1991).
PCT Search Report, International Application No. PCT/US01/08819, 2 pages (Aug. 21, 2001).
*Sunrise Medical's Home Page*, http://www.sunrisemedical.com/sunrise.html, 1 page, printed on Feb. 21, 2001, date of first publication unknown.
*Sunrise One Source,* Sunlink Web . . . /listCatalogItems?search=Hoyer&pointer=25&brand=&Category=&Attr1=&Attr2=&Attr3=&/2/21/01, 1 page, printed on Feb. 21, 2001, date of first publication unknown.
*Item Details* (*ITEMDETAILCALICO/productdetail.txt*), Sunrise One Source, h . . . /itemDetailCalico?item=040–0117AC&brand=&Category=&Attr1=&Attr2=&Attr3=&Attr4, 1 page, printed on Feb. 21, 2001, date of first publication unknown.
*Technical Specifications Item #040–0117AC*; Sunrise One Source, Water Powered Tublift, 1 page, date of first publication unknown.
*Part Information* (*GETParts*), Sunrise One Source, . . . /get/Parts?item=040–0117AC&desc=Water%20Powered%20Tublift%20with%20Arim–Mounted2/21/01; 2 pages, date of first publication unknown.
*Sunrise Medical's Home Page,* http://www.sunrisemedical.com/sunrise.html, 1 page, printed on Feb. 27, 2001, date of first publication unknown.
*Sunrise One Source,* Sunlink Web, . . . /Config Details?Var1=tublift&Var2=&Var3=&Var4=&Var5=0&Var6=0&Var7=0&Var8=, 1 page, printed on Feb. 27, 2001, date of first publication unknown.
*Search Results,* Sunrise One Source, . . . /searchDrawings?search=tublift&pointer=0&brand=&Category=&Attr1=&Attr2= &Attr3, 1 page, printed on Feb. 27, 2001, date of first publication unknown.
*040–0117 Water Powered Tublift,* Sunrise One Source, . . . /getDrawing?item=040–0117WW&name=040–0117~Water~Powered~Tublift&brand=&Cat Feb. 27, 2001; 2 pages, date of first publication unknown.
*Home Health: Bathroom: Bath Lifts: Merlin Bathlifter–folding bathlift,* © 1997–2001 Westons Internet, 4 pages, http:/www.westons.com, last modified Oct. 14, 2001.
*Bath Lift,* Silver Cross Elevators, 2 pages, http:/www.silvercross.com/Products/BathLift.html, Copyright 1999.
*Free bathlifts, bath lifts information,* Silver Cross, 2 pages, http:/www.silvercross.com/Products/BathLift.html, Copyright 1999.
*Bath Lift Carexa,* Unicare Medical Inc. ad, 3 pages of identical one page in different shades; Unicare Medical, Inc.; 770 Lawrence Ave. West; Toronto, Ontario M6A 1B8; Canada; 416–785–5535; 800–668–2030; 416–787–8042 (Fax);E–mail: unicare@tube.com; www.unicaremedical.com.
VersaBathSeat™, Chattanooga Group, Inc. catalog ad © 2001, 2 pages.
*Invacare, Model 5000,* Bed, one page; http://www.altamobility.com/chairs.html.
*The Intelligencer, Carexa Bath Lift,* Battery Operated, one page; http://intelligenceraucitoncentral.com/ItemDemo.asp?ProductNumber=10 Copyright 2000.
*Ferno—Our Product Line,* Ferno–Washington, Inc. Website, http://therapy.ferno.com/ferno.htm, 2 pages, printed on Jul. 19, 2002, date of first publication unknown.
*Model 191 Stationary Lift,* Ferno–Washington, Inc. website http://therapy.ferno.com/Lifts/m191.htm, 2 pages, printed on Jul. 19, 2002, date of first publication unknown.
*M.O.M.S Item Detail* for Bathmaster 2000, Mail Order Medical Supply website, http://db.momsup.com/moms/momsdb.fm$FIND?sort=sort&OTNGroupNo=5077&layout=search&html=htmlDetail&header=HeaderDetail&footer=FooterDetail, 1 page, printed on Jul. 10, 2002, date of first publication unknown.
*Mail Order Medical Supply,* vol. 64 (2002), p. 14, copied on Jul. 10, 2002, date of first publication unknown.
*Fenner Fluid Power System Schematic,* 2 pages, faxed on Jun. 3, 2002, date of first publication unknown.
*Pipeguard Accumulator Schematic,* 1 page, issue date May 22, 2002, date of first publication unknown.
*Bosch AC/DC Solenoid and Wiring Box Schematic,* 1 page, faxed on May 17, 2002, date of first publication unkown.

* cited by examiner 20
100
94
96
B
111
122
112
125
116
124
118
102
108
106
104
180
182
110
178
30
172
114
144
146
168
120
134
136
174
28
32
126
138
140
170
22B
22
24A
176
142
98
130
128
132
A FIG. 8
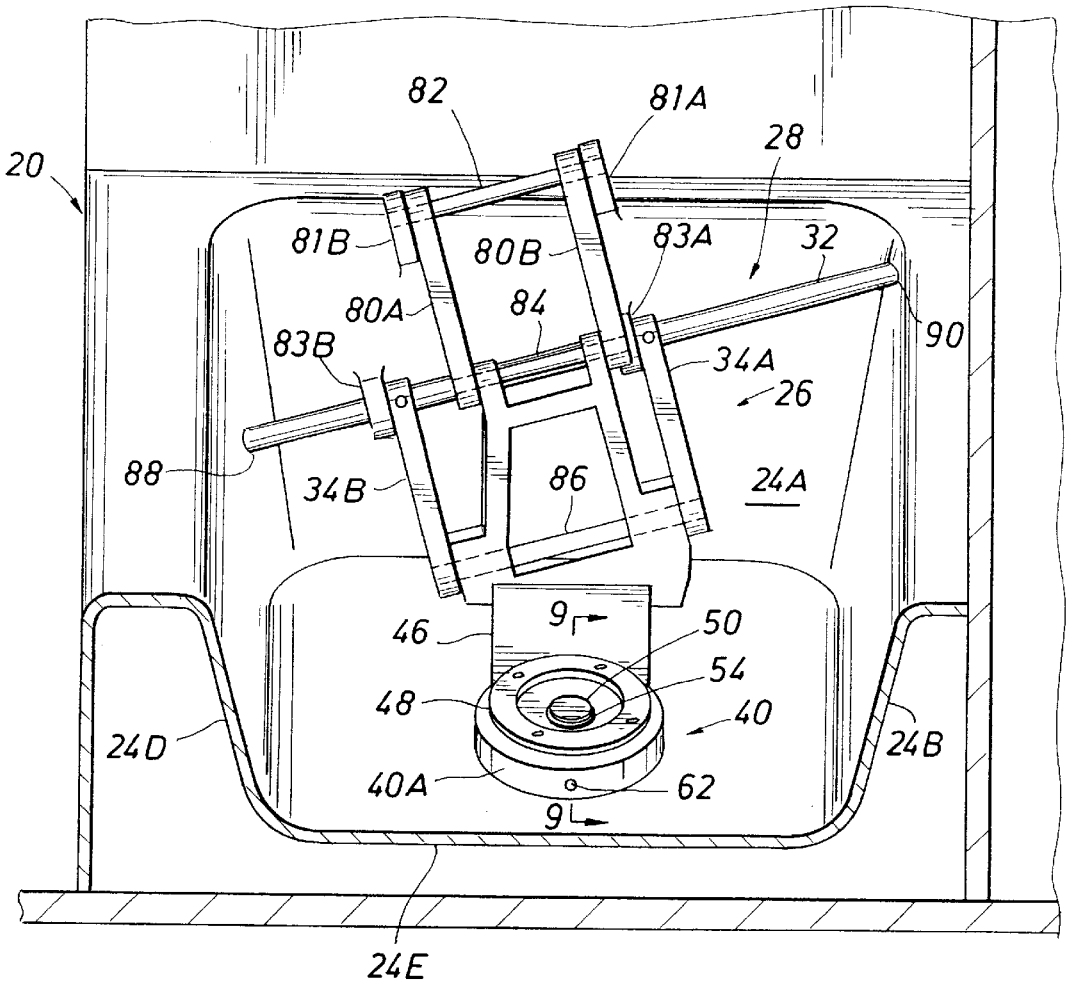
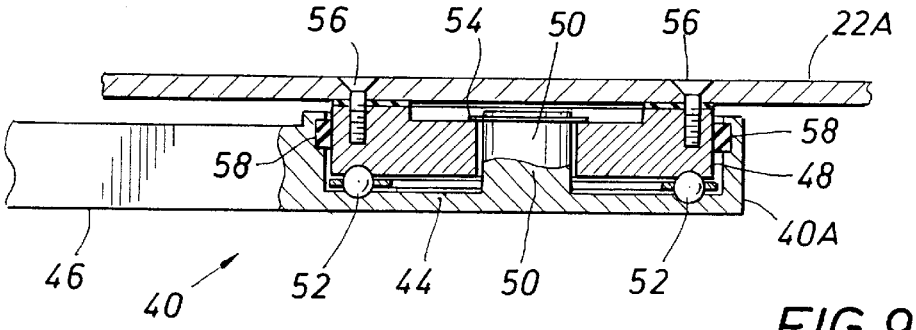
FIG. 9

320
326
324
322
22A'
318B
60'
334
336
340
338
62'
40'
64'
306
22'
22B'
308
46A
86
312A
316
314
84
80A'
386A
344'
310
26'
32'
402A
82'
392A
344
394A
390A
388
346A
24A'
366
368A
300
28A
28'
352
348A
342
350A

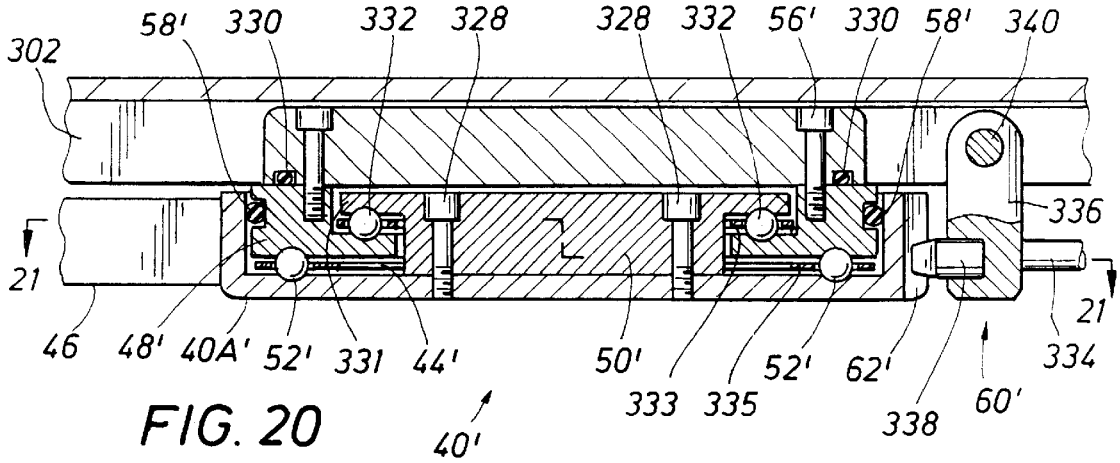
FIG. 20
FIG. 21
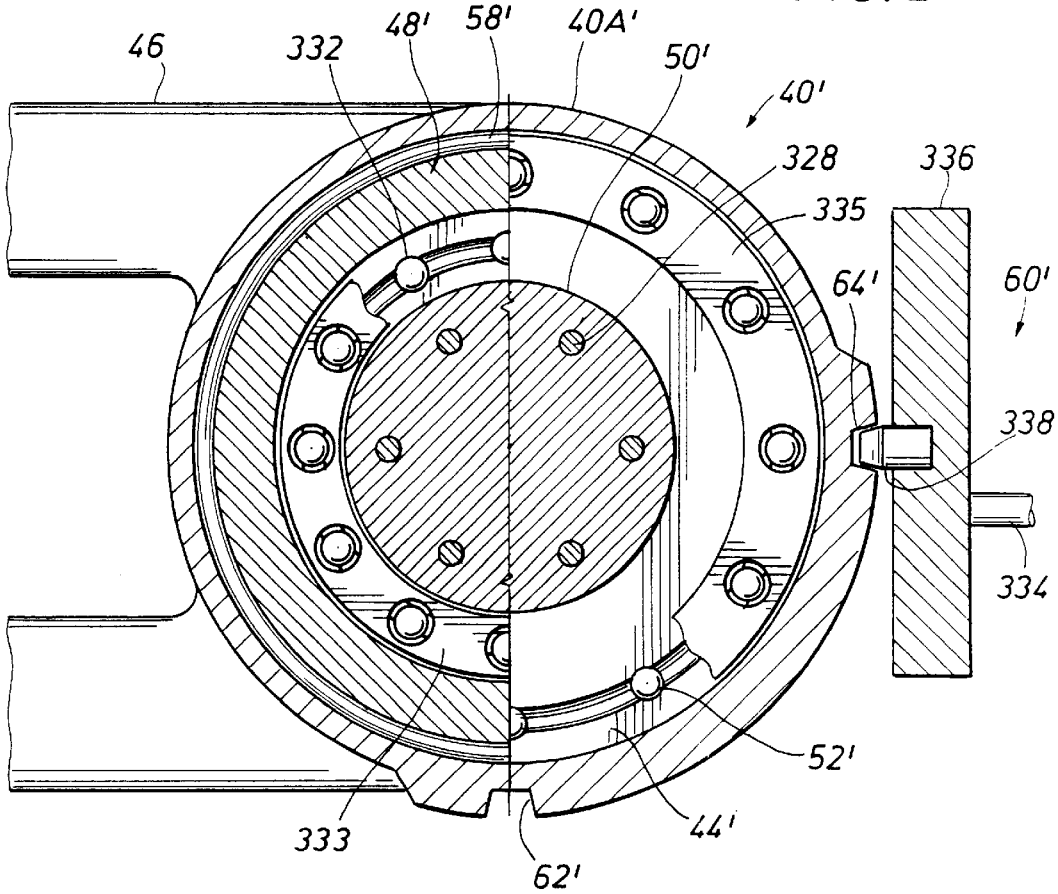

BATH LIFTING SYSTEM

CROSS-REFERENCE TO RELATED APPLICATIONS

This application is a continuation-in-part of co-pending U.S. application Ser. No. 10/085,197, filed Feb. 27, 2002, which is a continuation-in-part of application Ser. No. 09/550,307, filed Apr. 14, 2000, now U.S. Pat. No. 6,397, 409, the entirety of each of these applications are hereby incorporated by reference herein.

STATEMENT REGARDING FEDERALLY SPONSORED RESEARCH

Not applicable.

REFERENCE TO A MICROFICHE APPENDIX

Not applicable.

FIELD OF THE INVENTION

This invention relates generally to a bath system for raising and lowering an individual in and out of a bath, and more particularly, to a bath system with a seat and a lifting device, where the lifting device is positioned within the bath, substantially out of sight.

BACKGROUND OF THE INVENTION

Bath lifting systems have been available in the past to raise and lower individuals in and out of a bath. For example, U.S. Pat. No. 2,361,474 proposes a bath lifting system for raising and lowering an individual in and out of a bath using two exposed U-shaped crankshafts. A table spanning the shafts is connected to the bights of the U-shaped crankshafts. The crankshafts rotate in unison to rotate the table from a lowered position within the bath to a raised or extended position out of the bath.

Another bath lifting system is proposed in U.S. Pat. Re. No. 33,624. This system proposes a lifting device on the outside of the bath connected to a seat support member that extends through the bath wall. In particular, the seat support member extends through an elongated wall opening, or slot, to lift the seat from a lowered position to a raised position.

Yet another bath lifting system is proposed in U.S. Pat. No. 5,146,638. This system proposes a telescoping lifting column which is positioned in an upright position through one end of the upper rim or top of a bath. The lifting column includes a first actuator that vertically raises and lowers the seat in and out of a bath. A second actuator then swivels or rotates the lifting column about its cylindrical axis to position the front portion of the seat from a central position in the bath to a position over the rim or top of the bath. If desired, the seat can be swiveled through a smaller angle from its central position in the bath for transfer from a wheelchair to the seat.

Many other bath lift systems, available in the past, have an appearance that is bulky and mechanical. In particular, exposed lifting devices located adjacent to the bath are not considered aesthetically appealing. In the lifting devices positioned out of sight behind a side bath wall and extending through the upper rim of the bath, dual actuators, electronic circuitry and mechanical parts are proposed to provide a two step movement to first raise the seat and then swivel the seat, even if only to swivel the seat a preferred smaller angle from a central position to position the seat for transfer from a wheelchair. (See '638 patent, col. 3, ln. 62 to col. 4, ln. 41).

Also, support members which extend through an elongated opening or slot in the bath wall, that begin at the bottom of the bath in the drain area, are particularly susceptible to seal wear and resulting water leakage from the area where fluids collect caused by the sliding movement of the member that extends through the wall.

Therefore, an aesthetically appealing lifting device, covered behind the seat, would be desirable. Moreover, a bath lifting system substantially covered behind a lift seat that provides positioning of the seat from a central position to a position along side of the rim or top of the bath for transfer from a wheelchair would be desirable. In addition, a system that moves the seat from the lower back of the bath to the middle top of the bath would also be desirable. Furthermore, a bath lifting system that could be retrofitted into an existing bath would be desirable. In addition, a bath lifting system which provides a desired lift force irrespective of the amount or presence of any associated tap water pressure would be desirable. Further, a bath lifting system controlled by a wireless remote device would be desirable.

SUMMARY OF THE INVENTION

According to the invention, a composite bath embodiment that substantially covers the bath lifting system behind the seat while positioning the seat from a central position to a laterally offset position along the side of the rim of the bath for transfer from a wheelchair is disclosed. A retrofit embodiment of the invention is also disclosed that uses a frame that allows the system to be retrofitted into an existing bath with little or no modifications to the bath. Both the composite bath embodiment and the retrofit embodiment are disclosed for straight up or laterally offset use. In addition, a self-pressurized system is disclosed, which provides its own hydraulic pressure to move the seat, that can be used in all embodiments of the invention

BRIEF DESCRIPTION OF THE DRAWINGS

The object, advantages, and features of the invention will become more apparent by reference to the drawings which are appended hereto and wherein like numerals indicate like parts and wherein an illustration of the invention is shown, of which:

FIG. 8 is a perspective view of the alternative composite embodiment A looking down, and towards the back of the bath, with the seat removed, to better illustrate the lifting device;

FIG. 9 is a view of the bath taken along line 9—9 of FIG. 8 showing a cross section view of the seat rotation assembly;

FIG. 20 is an enlarged cut-away side elevational view of the preferred retrofit embodiment seat rotation assembly;

FIG. 21 is a section view of the seat rotation assembly taken along line 21—21 of FIG. 20;

OVERVIEW

Figure 10:
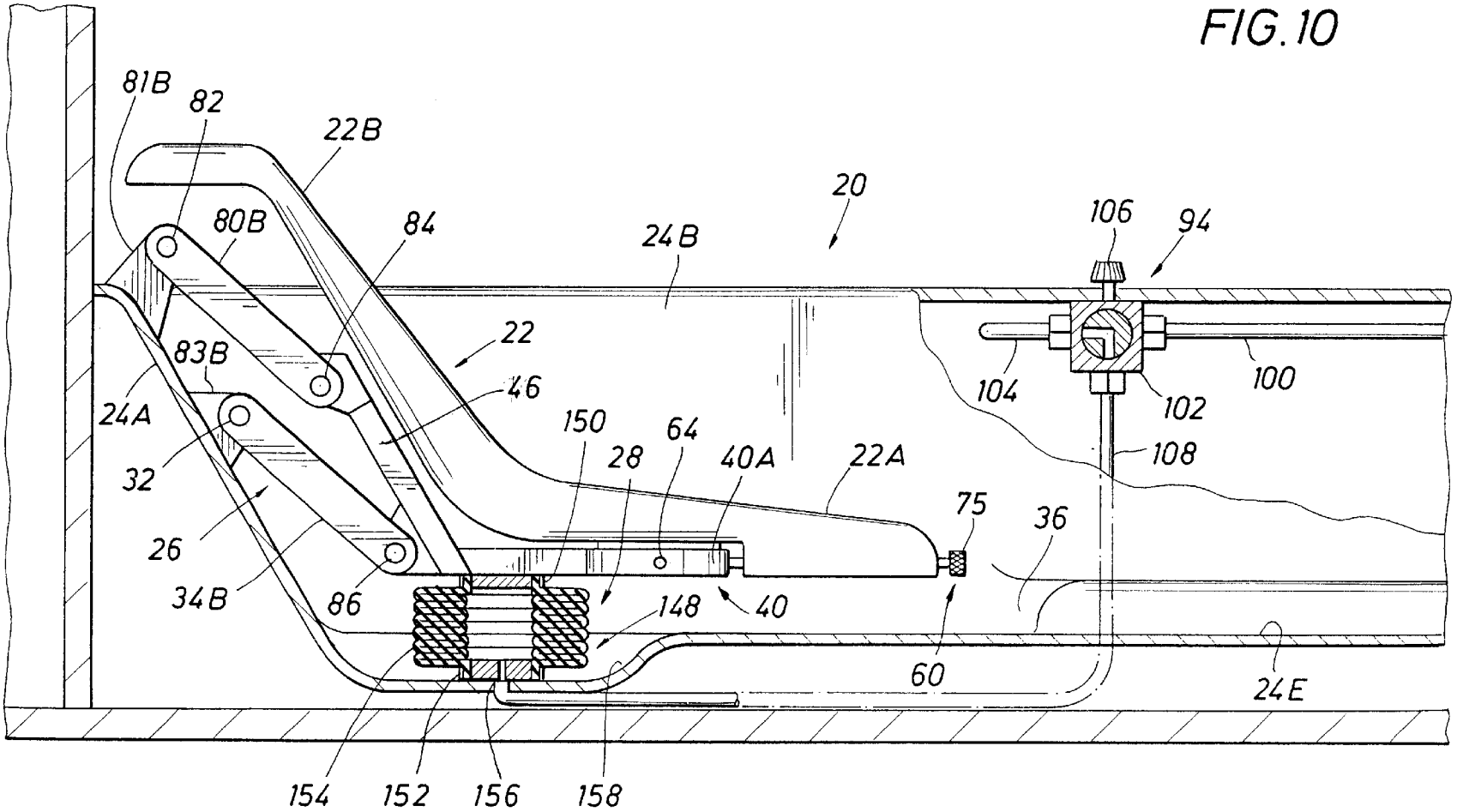
FIG. 10 is a cut-away side elevational view of an alternative composite embodiment B of the present invention showing the seat in the lowered position.
Figure 11:
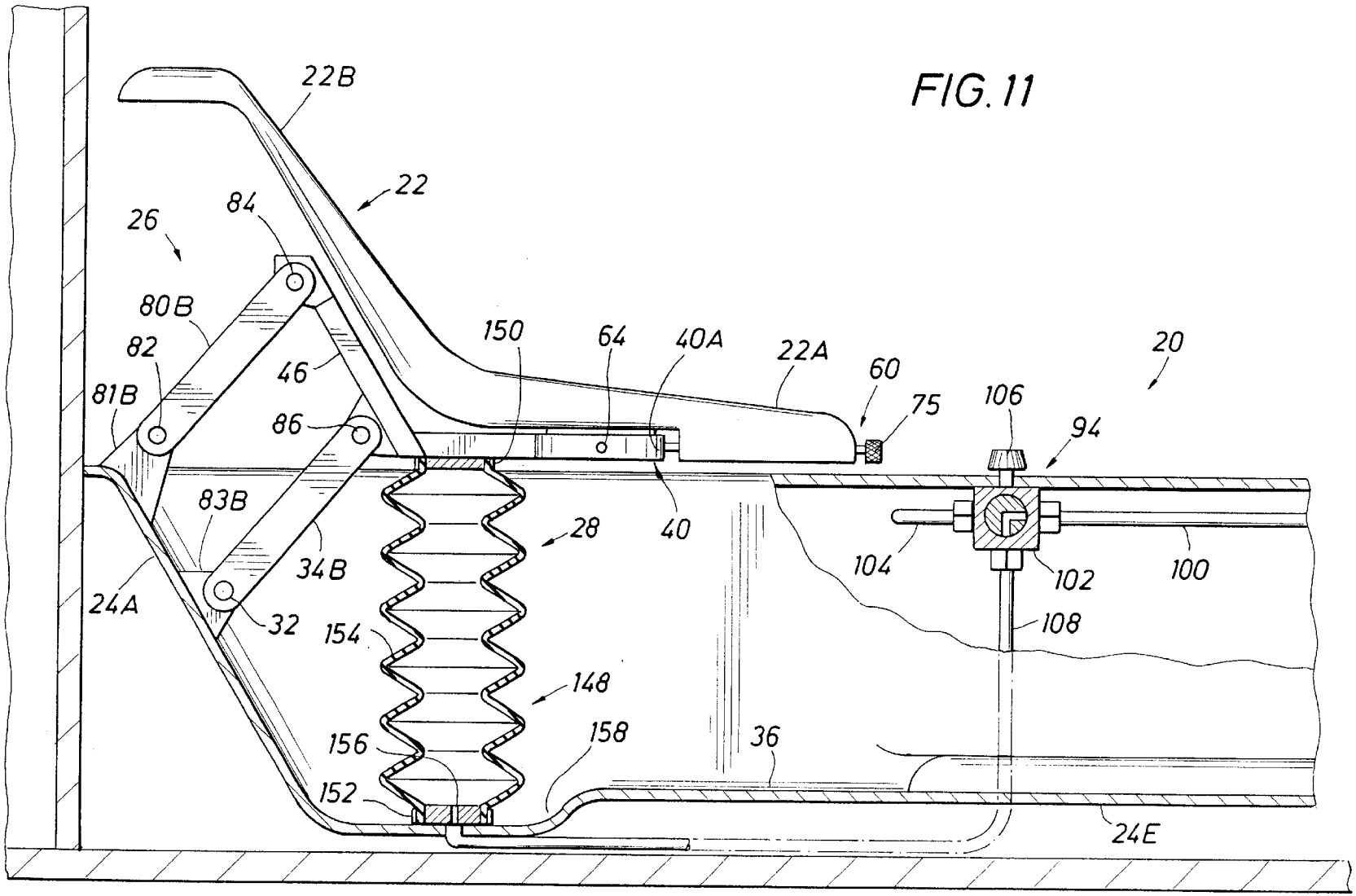
FIG. 11 is a view similar to FIG. 10 of an alternative composite embodiment B of the present invention showing the seat in the raised position.
Figure 12:
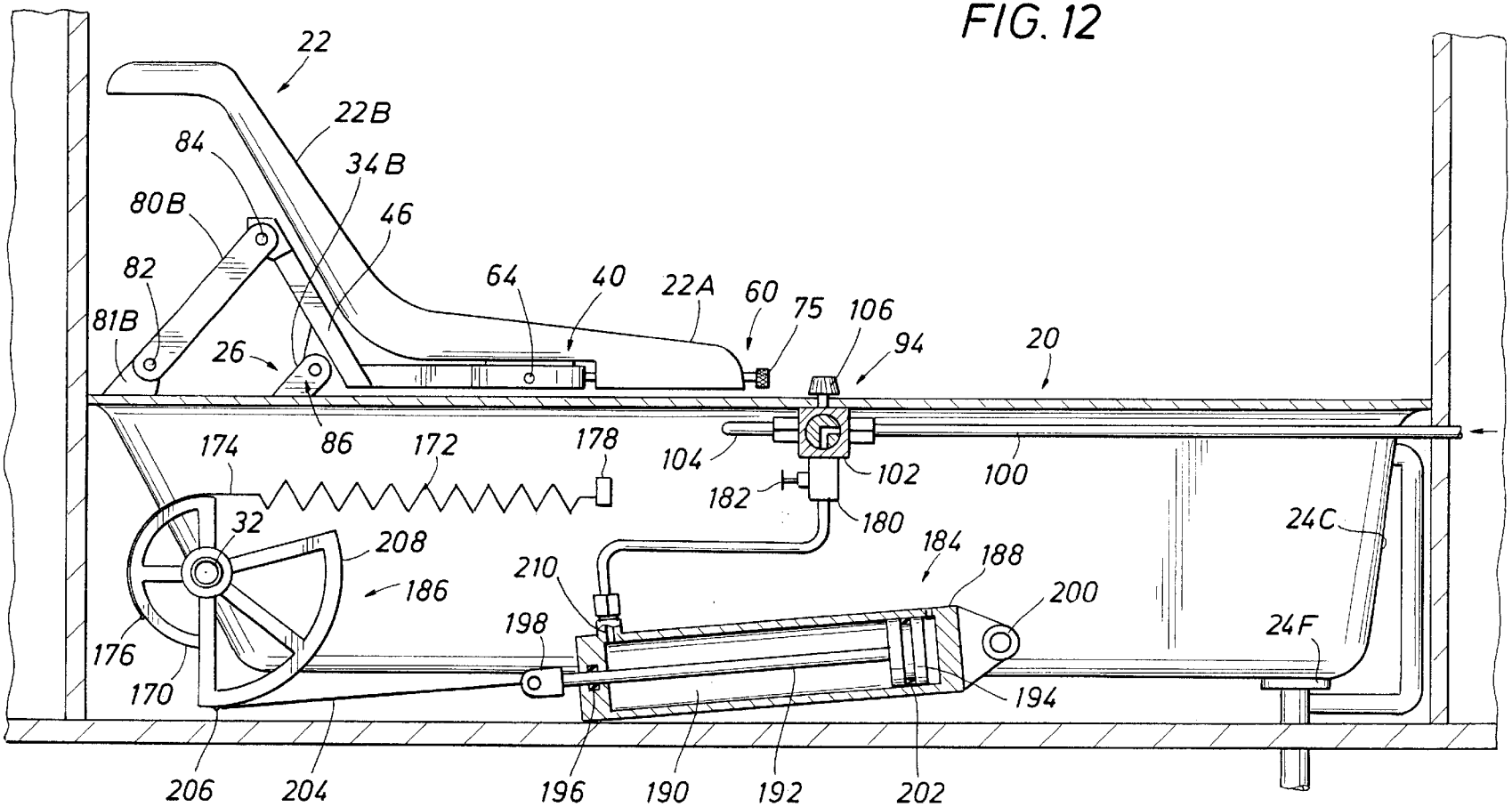
FIG. 12 is a side elevational view of an alternative composite embodiment C of the present invention showing the seat in the raised position and another lifting power system.
Figure 25:
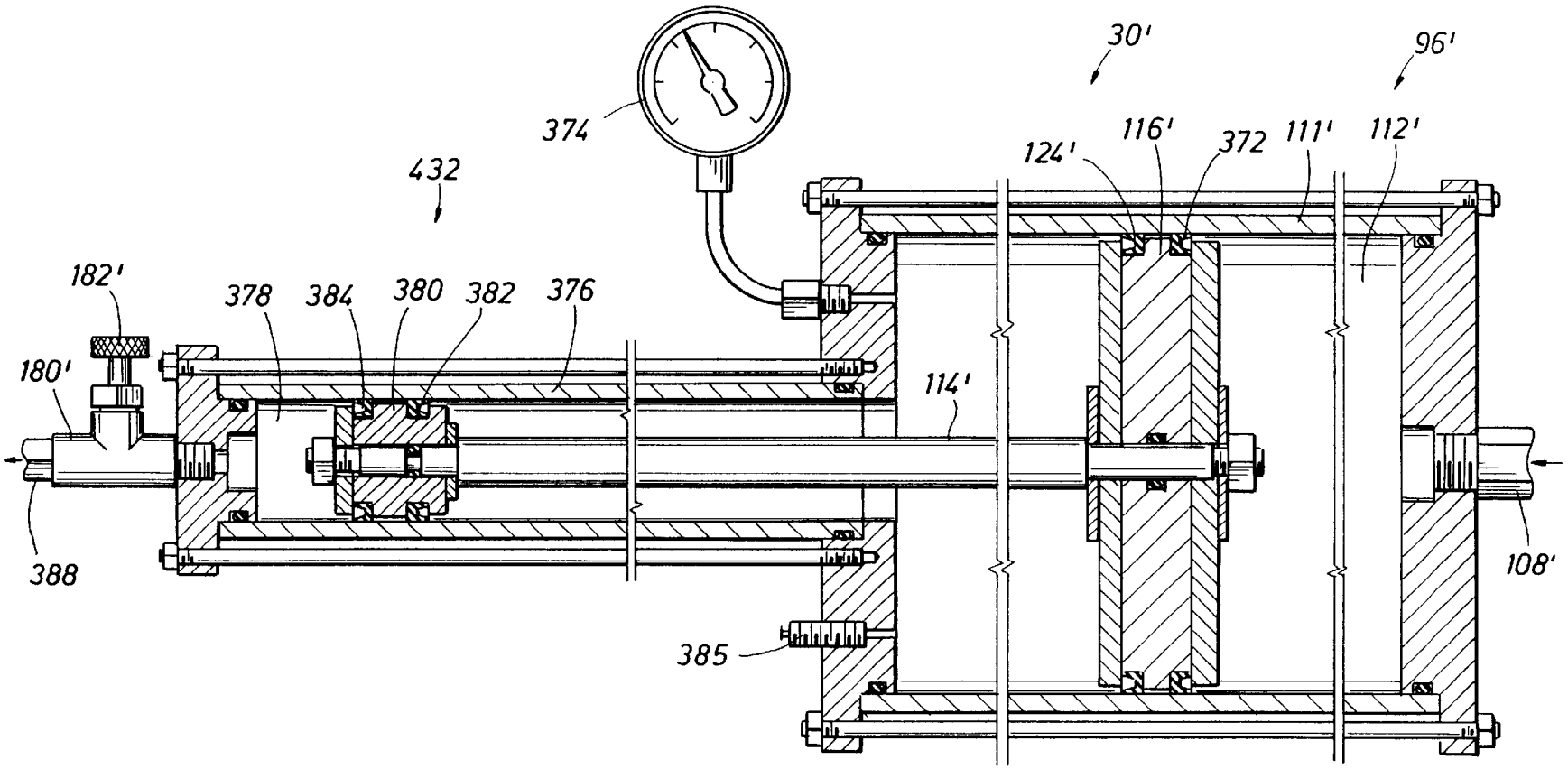
FIG. 25 is an enlarged broken side elevational view of the lifting power system of the retrofit embodiment to better show the details of the primary and secondary pistons of the lifting power system.
Figure 26:
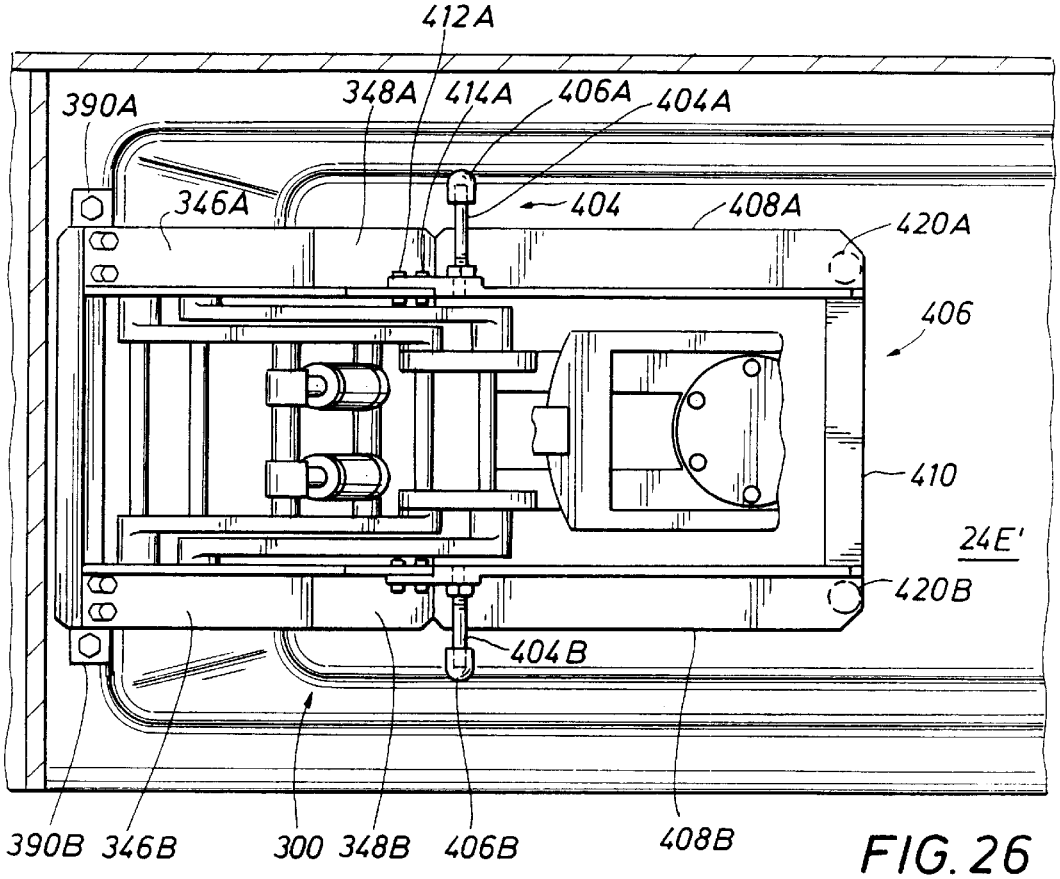
FIG. 26 is a top view of an alternative straight up retrofit embodiment D in the raised position and the seat removed to better show the frame extension below the seat and the two lateral stabilizers engaged with the side walls of the bath.
Figure 27:
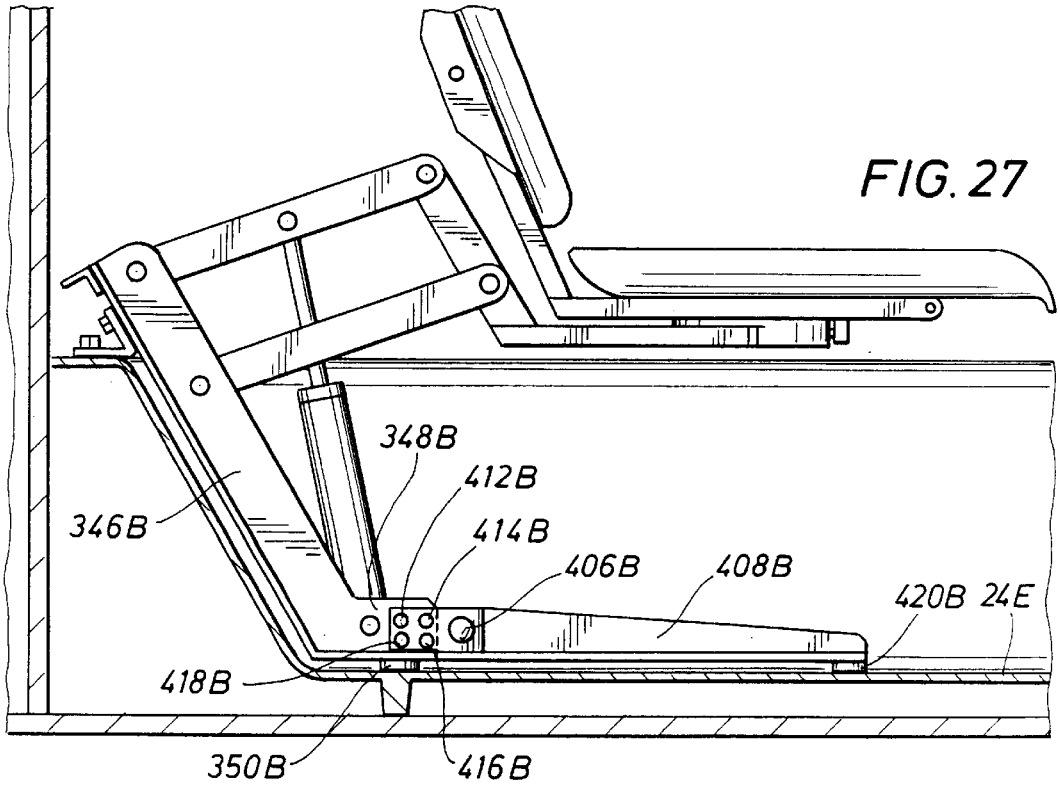
FIG. 27 is a cut-away side elevational view of the alternative straight up retrofit embodiment D, shown in FIG. 26, with the seat in place.
Figure 31:
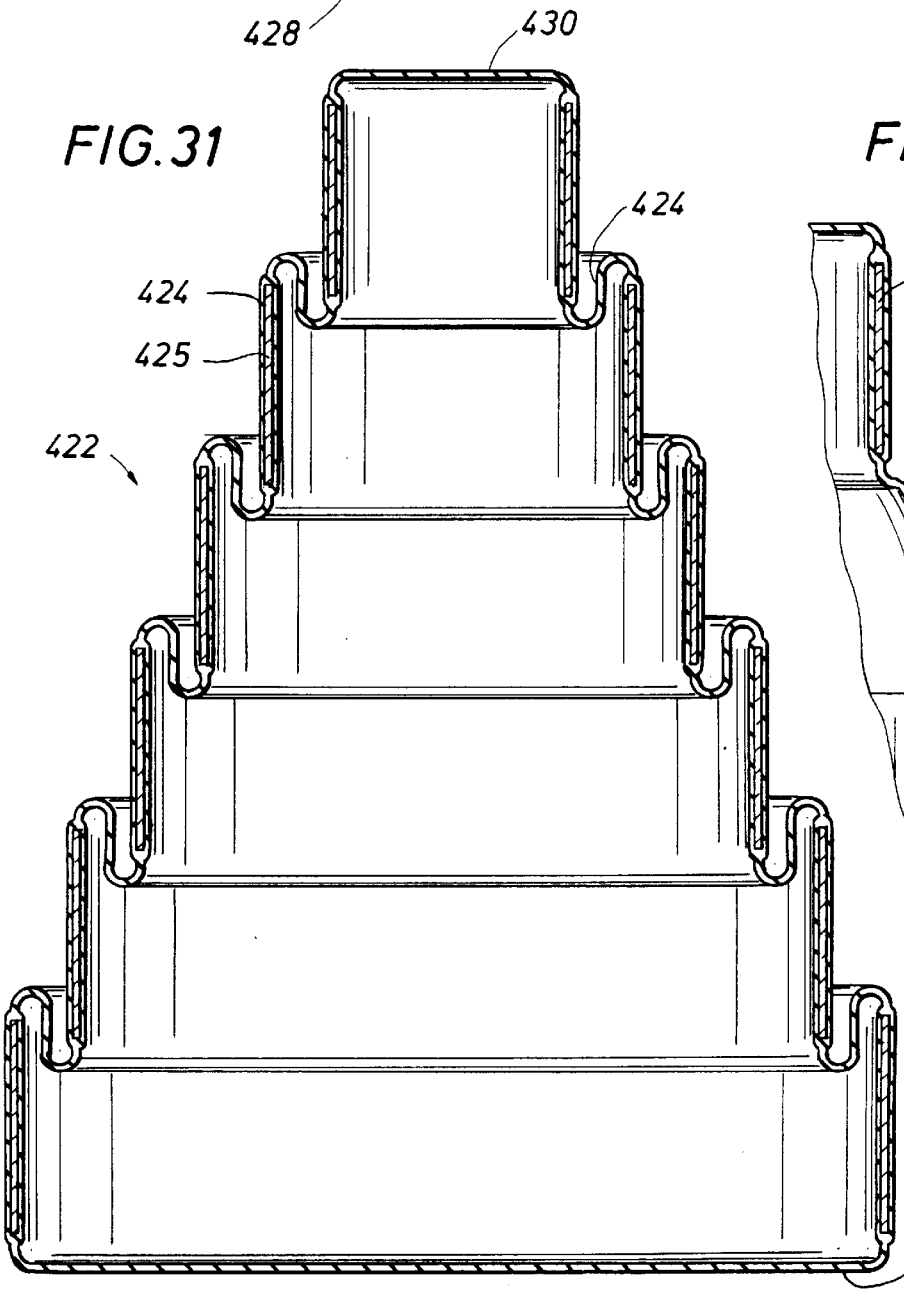
FIG. 31 is a view similar to FIG. 30 but with the bellows in a partially deployed or partially expanded state.
Figure 32:
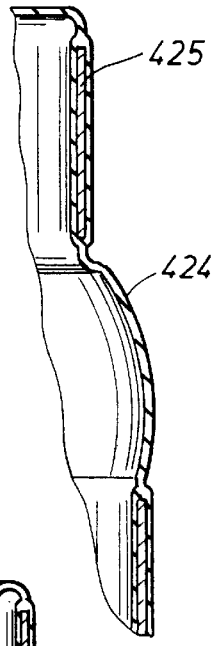
FIG. 32 is a partial view of a side wall of the bellows of alternative straight up retrofit embodiment E in the fully deployed or expanded state.
Figure 33:
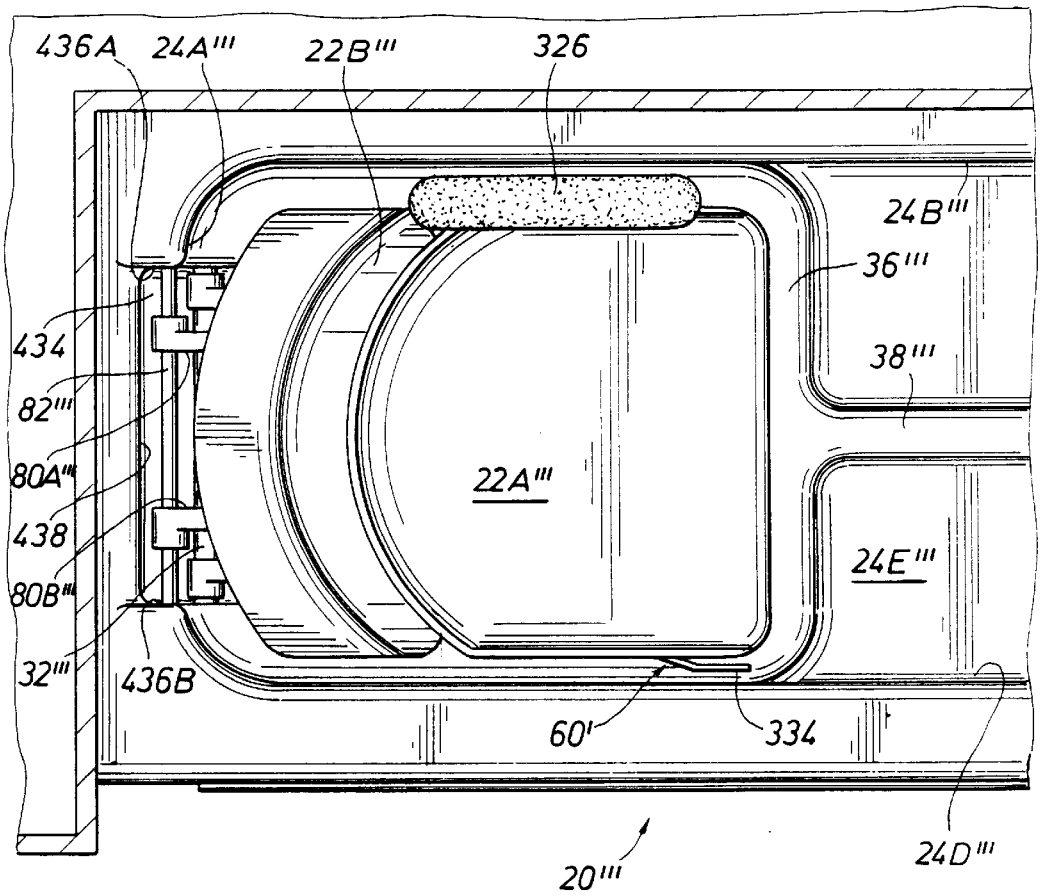
FIG. 33 is a top view of a preferred composite embodiment with the rotatable member positioned in a recess in the bath wall behind the seat and showing the seat in the lowered position.
Figure 34:
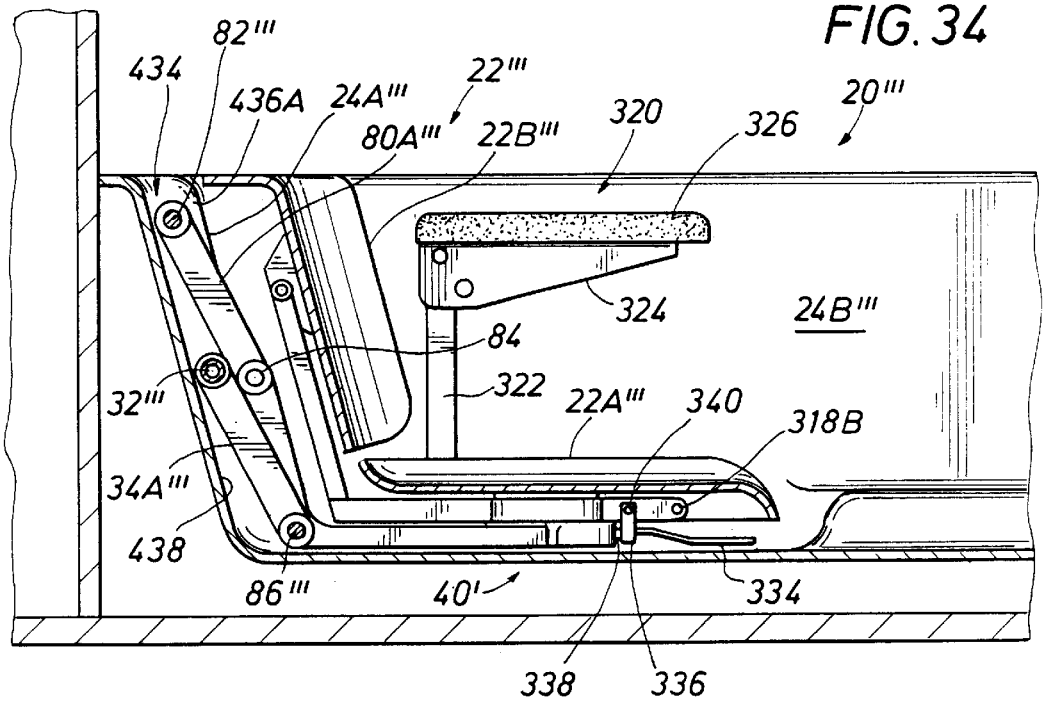
FIG. 34 is a side elevational view of the preferred composite embodiment showing the seat in the lowered position.
Figure 35:
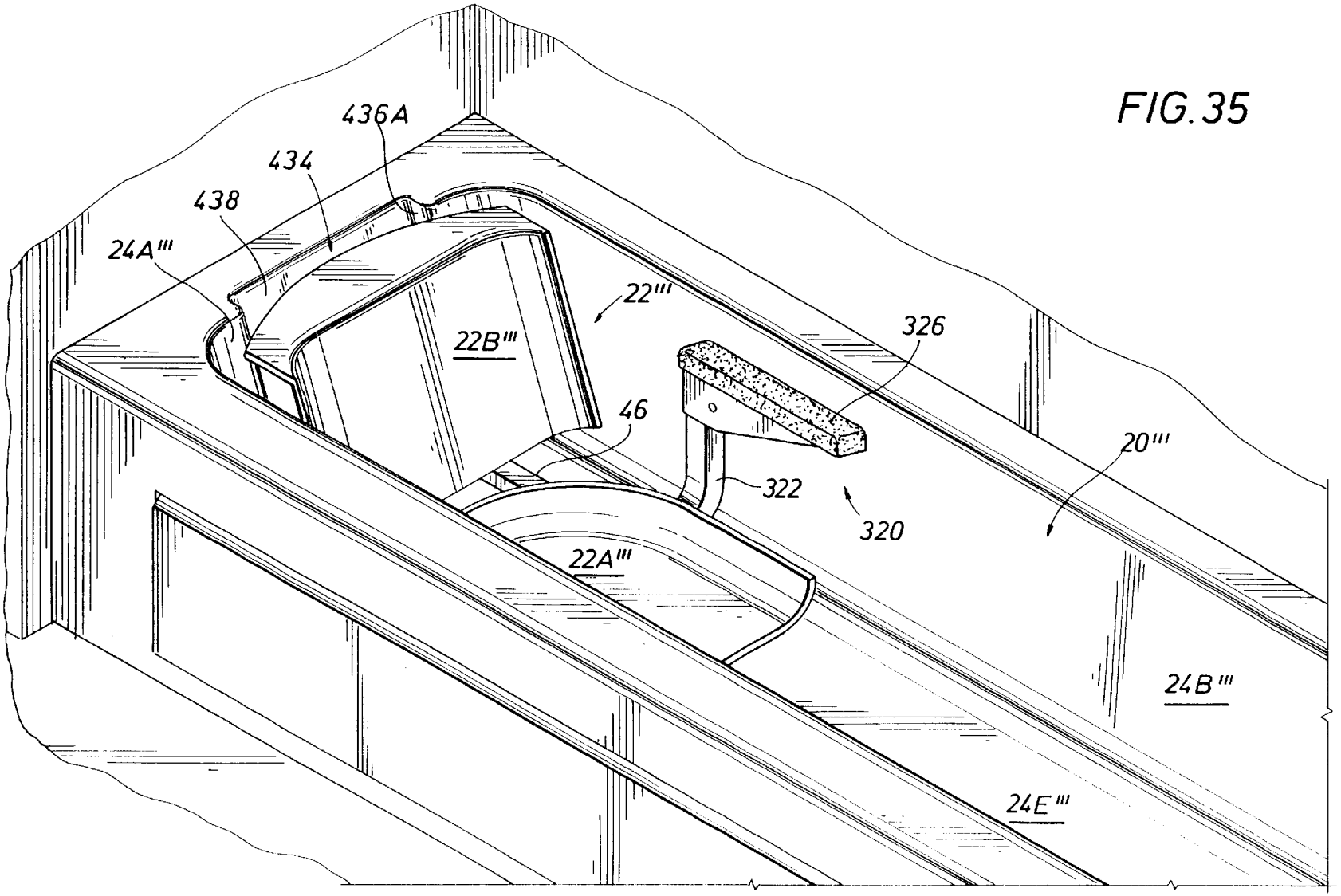
FIG. 35 is a perspective view of the preferred composite embodiment looking down, and towards the back of the bath, from a location outside the bath, with the seat in the lowered position.
Figure 42:
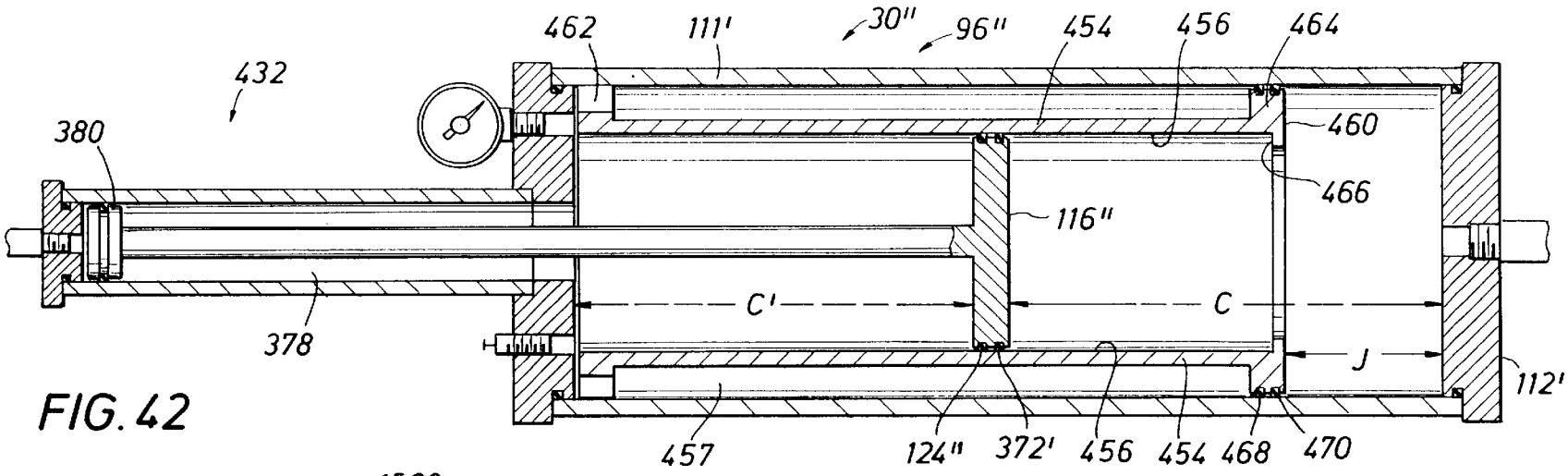
FIG. 42 is the lifting power system of FIGS. 40 and 41 with both the primary cylinder bushing and the primary piston in their fully extended positions.
Figure 43:
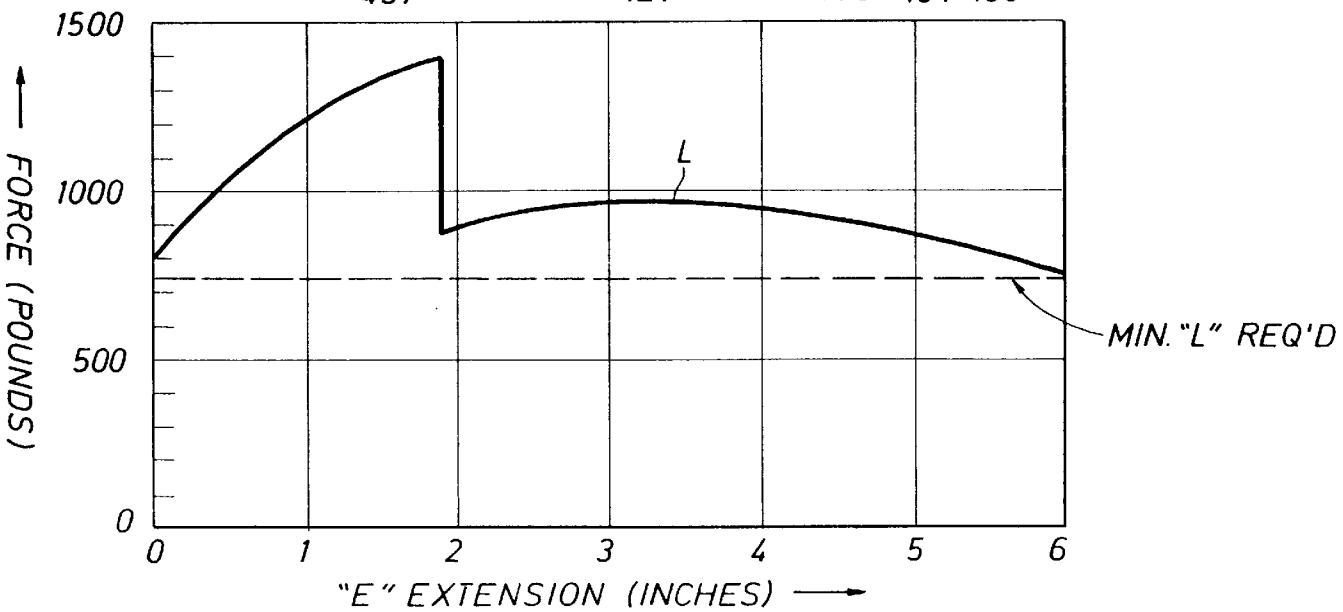
FIG. 43 is a chart of the lifting power system of FIGS. 40–42 showing the corresponding vertical force "L" occurring at the end of the guiding arm relative to the minimum force "L" required.
Figure 44:
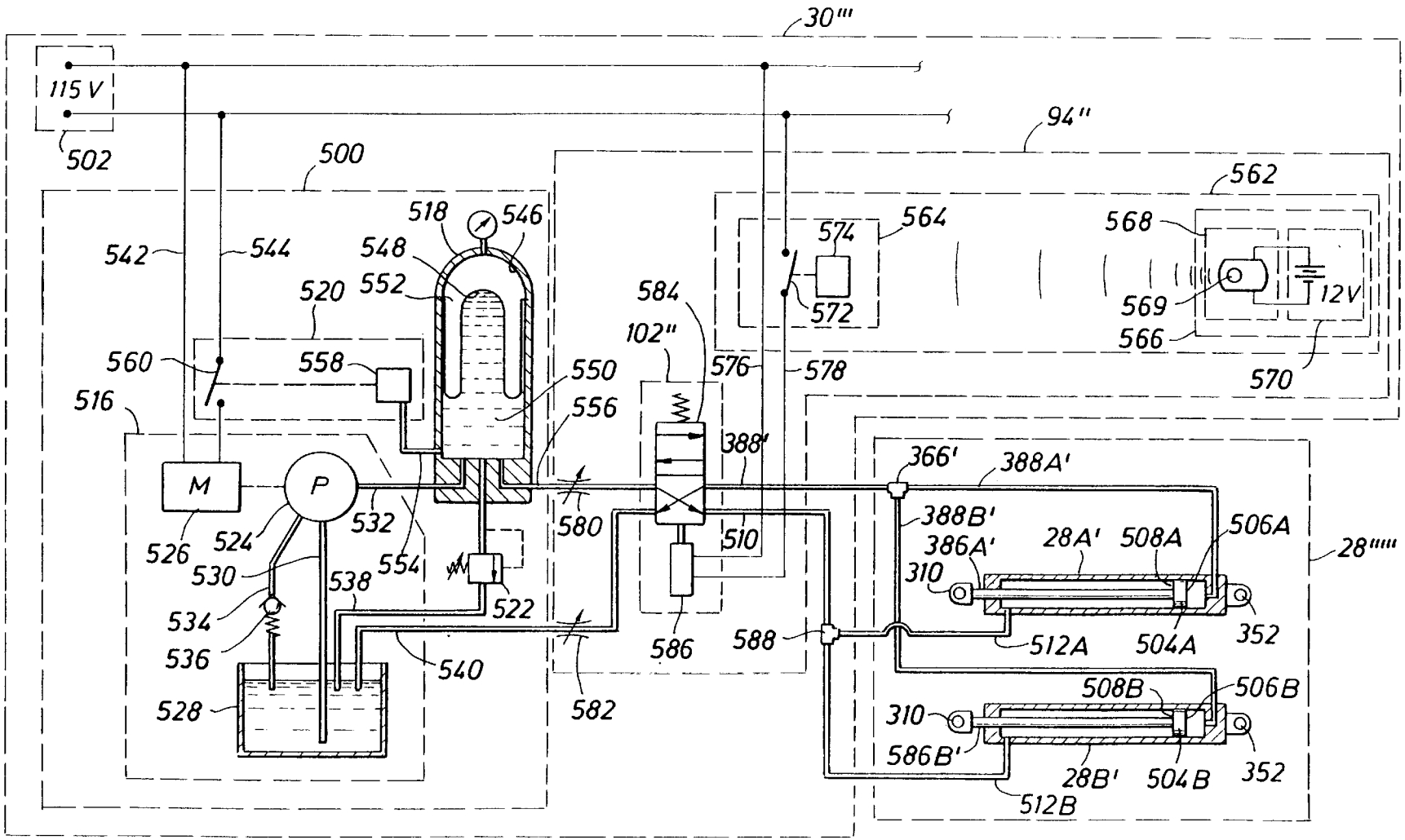
FIG. 44 is a schematic diagram of a self-pressurized system that can be use with all the embodiments.

The bath lift system of the present invention is shown in the Figures (FIGS.) In particular, the preferred composite embodiment of the bath lift system is shown in FIGS. 33–35, the alternative composite embodiment A, without a back recess 434, is shown in FIGS. 1–9, the alternative composite embodiment B, using a bellows member 148, is shown in FIGS. 10–11, the alternative composite embodiment C, with a power piston system 184 and power cam system 186, is shown in FIG. 12, the preferred straight up retrofit embodiment is shown in FIGS. 13–25, the preferred laterally offset retrofit embodiment is shown in FIGS. 36–43, the alternative straight up retrofit embodiment D, with frame extension 406, is shown in FIGS. 26 and 27, the alternative straight up retrofit embodiment E, with alternative bellows member 422, is shown in FIGS. 28–32, and a self-pressurized system that can be use with all the embodiments is shown in FIG. 44.

DETAILED DESCRIPTION OF THE ALTERNATIVE COMPOSITE EMBODIMENT A

The alternative composite embodiment A, shown in FIGS. 1–9, comprises: a bath, generally indicated at 20, a seat, generally indicated at 22, guiding assembly, generally indicated at 26, lifting device, generally indicated at 28, and lifting power system, generally indicated at 30. As shown in the Figures, bath 20 includes bath walls 24A, 24B, 24C, 24D, and bath bottom 24E, along with other standard bath features including openings 24F and 24G for drains. Alternative composite embodiment A includes a seat recess 36 in the bath bottom 24E and channel recess 38 for communicating fluid from the seat recess 36 to the drain opening 24F. Other recess formations may be used or no recess formations could be used. Also, other embodiments may relocate standard bath features, such as the drain, or may modify standard bath features, for example, by using multiple drains. In addition, other embodiments may use a hot tub, pool, a whirlpool bath or shower in place of a bath tub, all of which are considered a bath.

Figure 1:
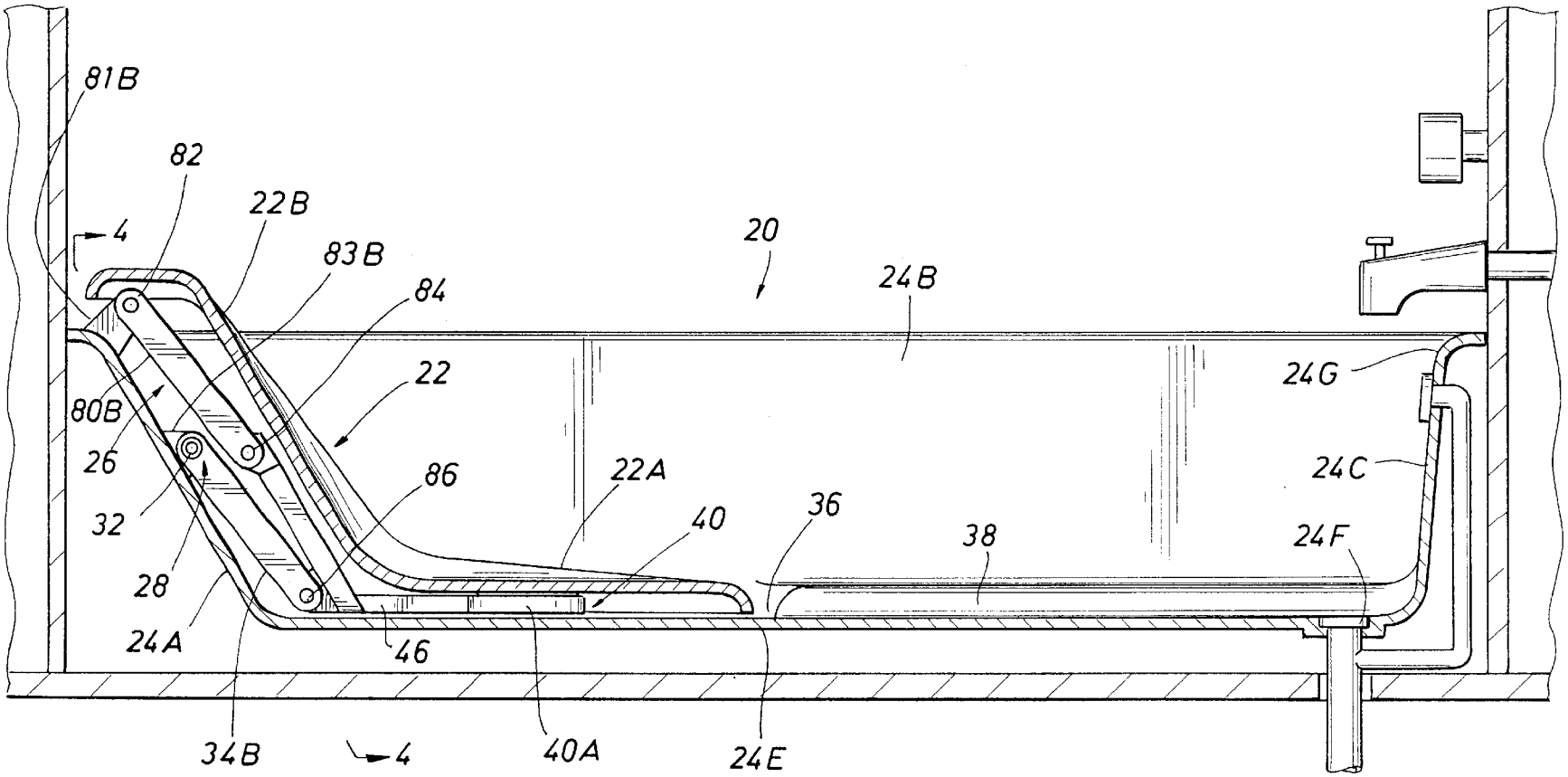
FIG. 1 is a cut-away side elevational view of the alternative composite embodiment A of the bath lifting system with the seat in the lowered position.
Figure 2:
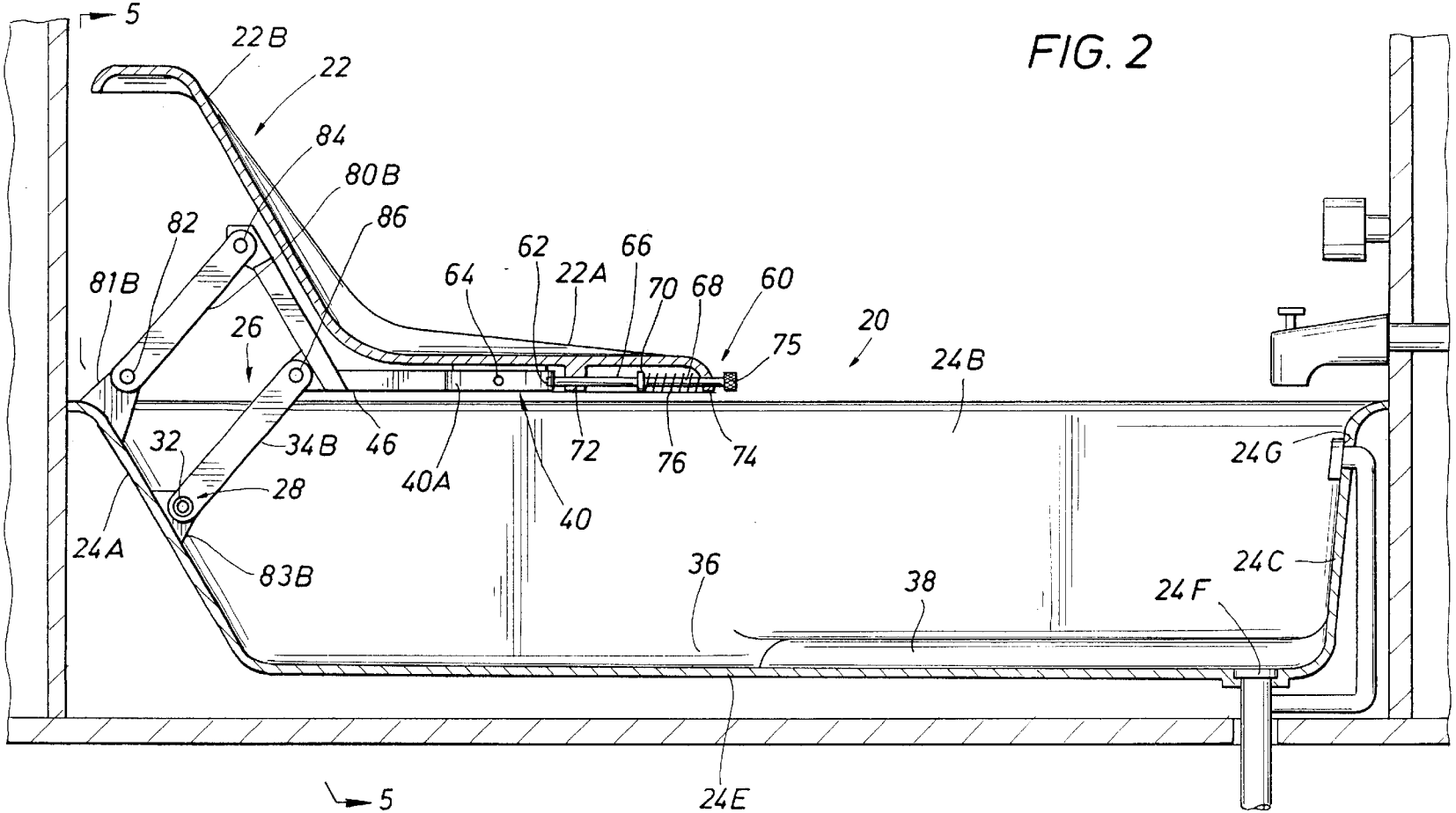
FIG. 2 is a view similar to FIG. 1 with the seat in the raised position.

Seat 22, preferably fabricated from a non-corrosive material such as plastic, can be seen in FIGS. 1–7. Seat 22 is sized and positioned to substantially cover both the guiding assembly 26 and the lifting device 28, when seat 22 is in the lowered position. As best shown in FIGS. 2, 8 and 9, seat 22 is rotatably attached to a seat rotation assembly, generally indicated at 40, via seat bottom 22A. As best shown in FIG. 9, seat bottom 22A is attached to rotor 48 of rotation assembly 40 by means of stainless steel bolts 56. Rotor 48 rotates about post 50 within housing 44 of rotation assembly 40 and is secured about post 50 via securing ring 54. Rotor 48 rotates within housing 44 contacting bearings 52 and bushings 58. Housing 44 is preferably integral with cantilevered seat bracket 46, which is in turn attached to guiding assembly 26. Other embodiments may not substantially obscure or cover the view of guiding assembly 26, such as with an opening in seat back 22B. In addition, other embodiments may exclude rotation assembly 40 and directly fixedly attach the seat bottom 22A directly to the seat bracket 46.

Figure 3:
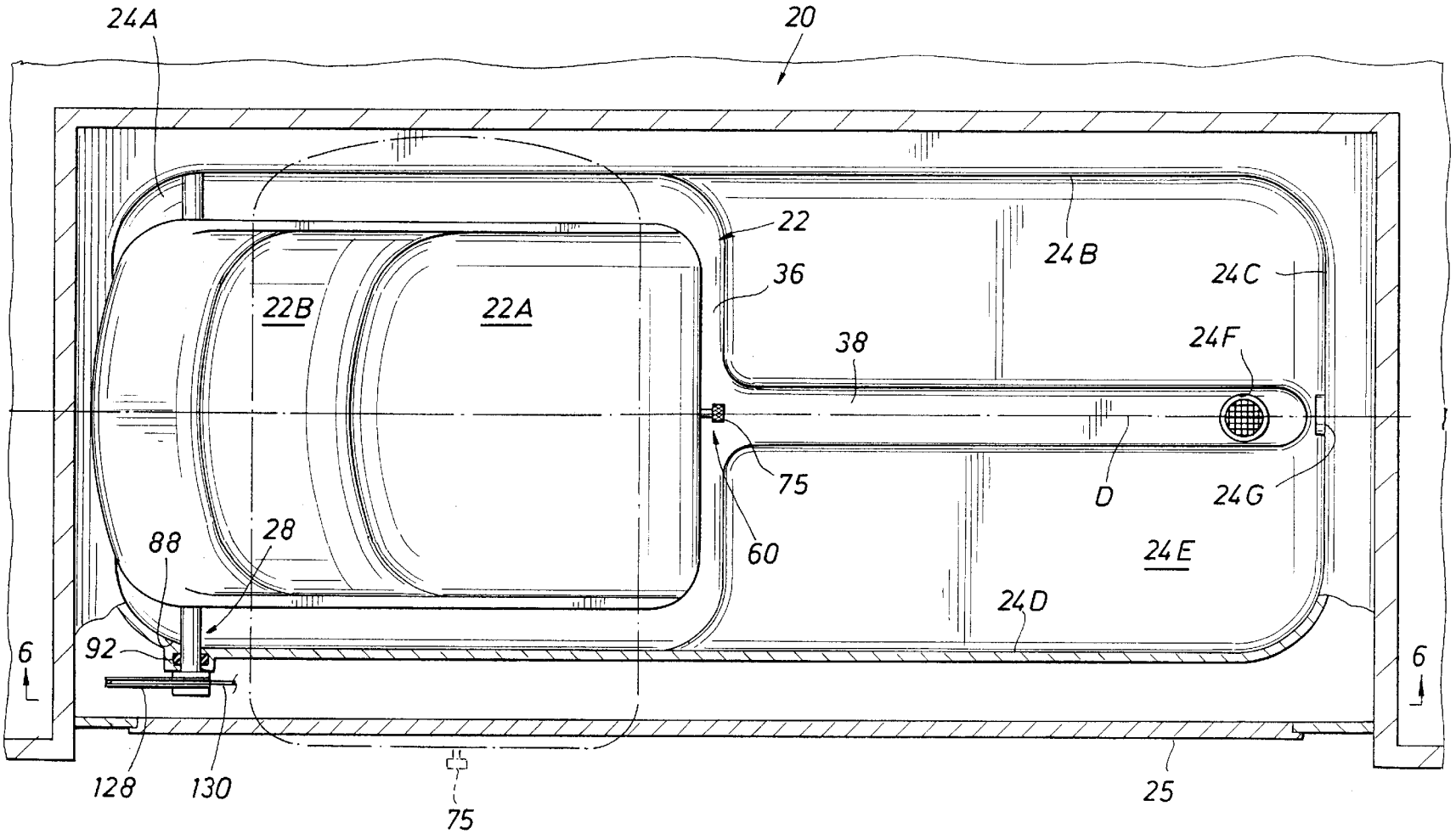
FIG. 3 is a top view of the bath lifting system as shown in FIG. 1, with the seat also shown in phantom view in its rotated entry/exit position.
Figure 5:
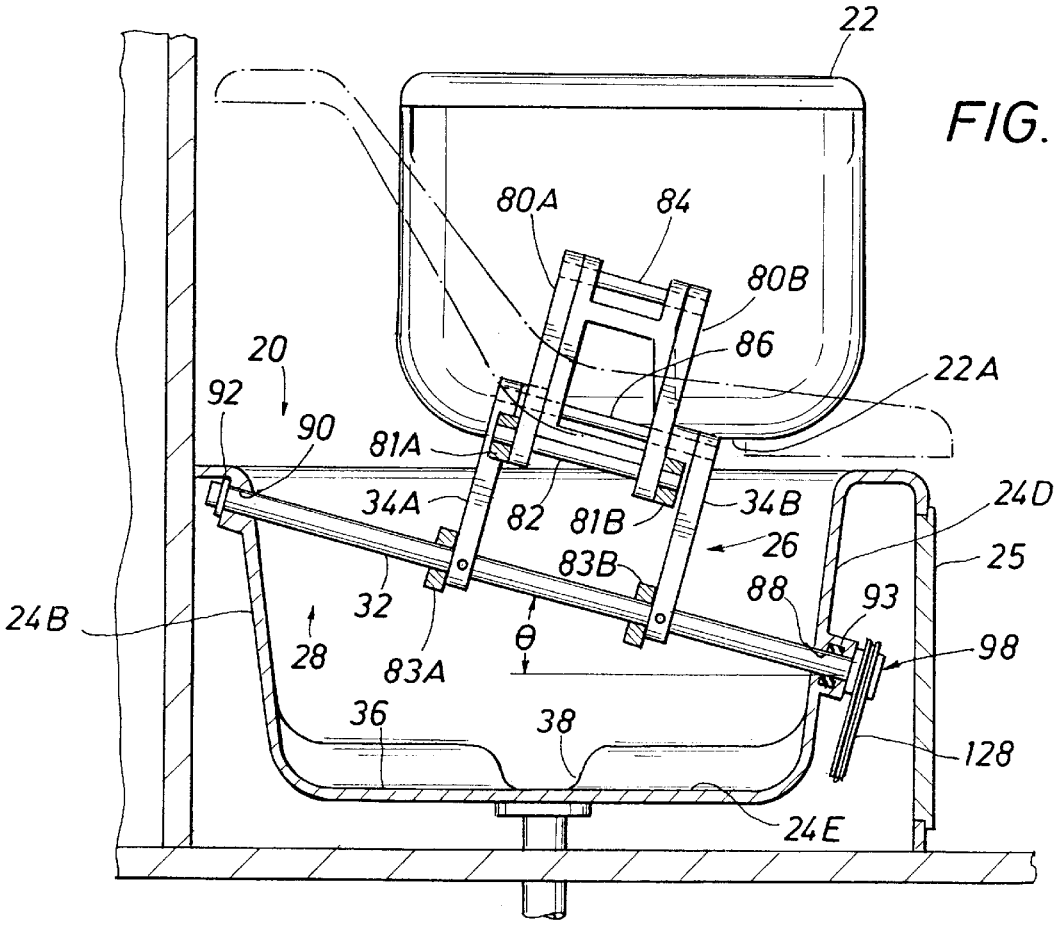
FIG. 5 is a view taken along line 5—5 of FIG. 2, with the seat also shown in phantom view in its rotated entry/exit position.

As best shown in FIGS. 2, 3 and 5, locking pin, generally indicated at 60, along with pin holes 62 and 64 in rotation assembly 40 are used to lock seat 22 into predetermined desired positions. Locking pin 60 has a pin head 75, a left and right (when viewing FIG. 2) shaft portions, 66 and 68, respectively, separated by collar 70 therebetween. Left shaft portion 66 extends through seat bottom extension 72. Right shaft portion 68 extends through seat bottom opening 74. Collar 70 is urged away from seat bottom opening 74 by a coil spring 76 compressed between collar 70 and seat bottom opening 74 to urge the end of locking pin 60 to contact the cylindrical exterior 40A and the desired pin holes 62 and 64 of rotation assembly 40. Locking pin hole 62, located on the front cylindrical exterior 40A of rotation assembly 40, is located in the rotation path of locking pin 60. When the desired pin hole is aligned with locking pin 60, coil spring 76 urges locking pin 60 to be received in selected pin hole to lock the seat in the desired position as shown in FIG. 2. Locking pin hole 64, preferably located 90° from hole 62 on the side of the cylindrical exterior 40A of rotation assembly 40, is also located in the rotational path of locking pin 60. When the locking pin 60 engages pin hole 64, the seat 22 is locked in the lateral position, as shown in phantom view in FIGS. 3 and 5. Other alternative embodiments may use other forms of locking mechanisms and locked positions.

Guiding assembly 26 of the alternative composite embodiment A is best shown in FIGS. 1, 2, 4, 5, 7 and 8. In the alternative composite embodiment A, the guiding assembly 26 is made up of first set of arms 34A and 34B and second set of arms 80A and 80B, and the entire assembly is mounted to wall 24A at an angle Ø, as best shown in FIG. 5, with respect to the bottom 24E of bath 20. The angle Ø at which the arms are attached is such that when the seat is in the lowered position, the seat is located substantially along the longitudinal axis D of the bath, as best shown in FIG. 3, and when the seat is in the raised position, the seat overlaps the top of the side wall 24D of the bath, as best shown in FIG. 5. In the alternative composite embodiment A, both sets of arms are attached at one end to the bath wall 24A and at the other end to seat bracket 46. As best shown in FIGS. 1, 2, 4 and 5, the second set of arms 80A and 80B are pivotally attached at one end to upper wall rod 82 and at the other end to upper seat rod 84. Upper wall rod 82 is, in turn, attached to bath wall 24A via attachment blocks 81A and 81B. The first set of arms 34A and 34B are fixedly attached at one end to rotatable member 32, and, at the other end, to lower seat rod 86. Rotatable member 32 is attached to bath wall 24A via attachment blocks 83A and 83B. Other alternative embodiments may use a single first arm and a single second arm, and others only a structurally stable first set of arms, and yet others with only a single first arm. Also, other alternative embodiments may mount any existing first or second sets of arms straight up horizontally, rather than at an angle Ø to the bottom of the bath. Other embodiments may not use rods that extend the full width of the bath, but rather, only extend between the side of the bath and the connection arm(s). Yet even other alternative embodiments may utilize different types of guiding assemblies which transform rotational movement into vertical displacement of the seat.

Figure 4:
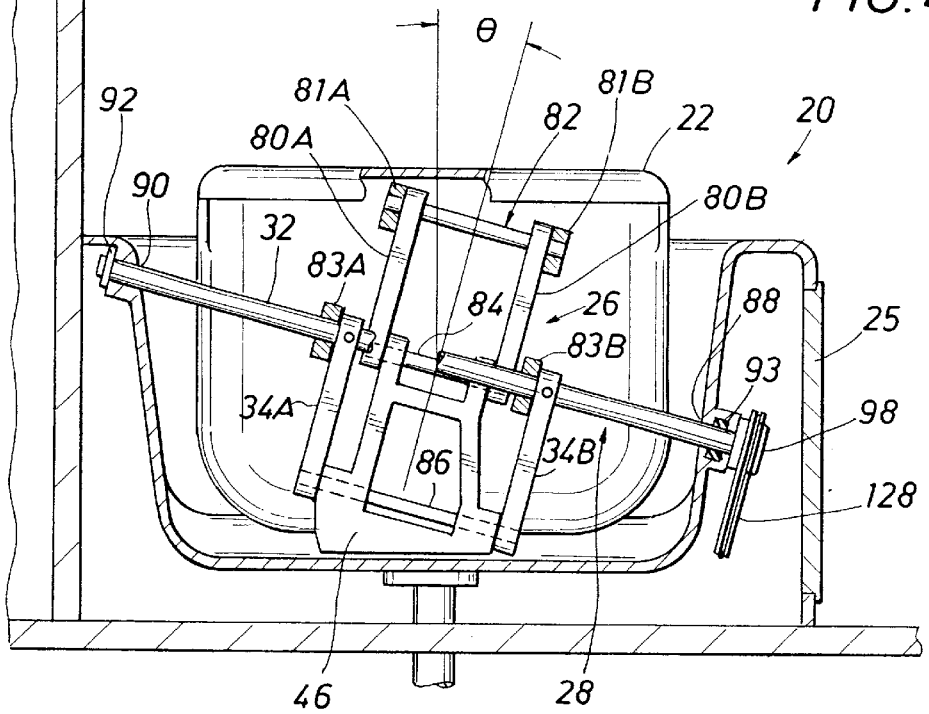
FIG. 4 is a view taken along line 4—4 of FIG. 1.
Figure 6:
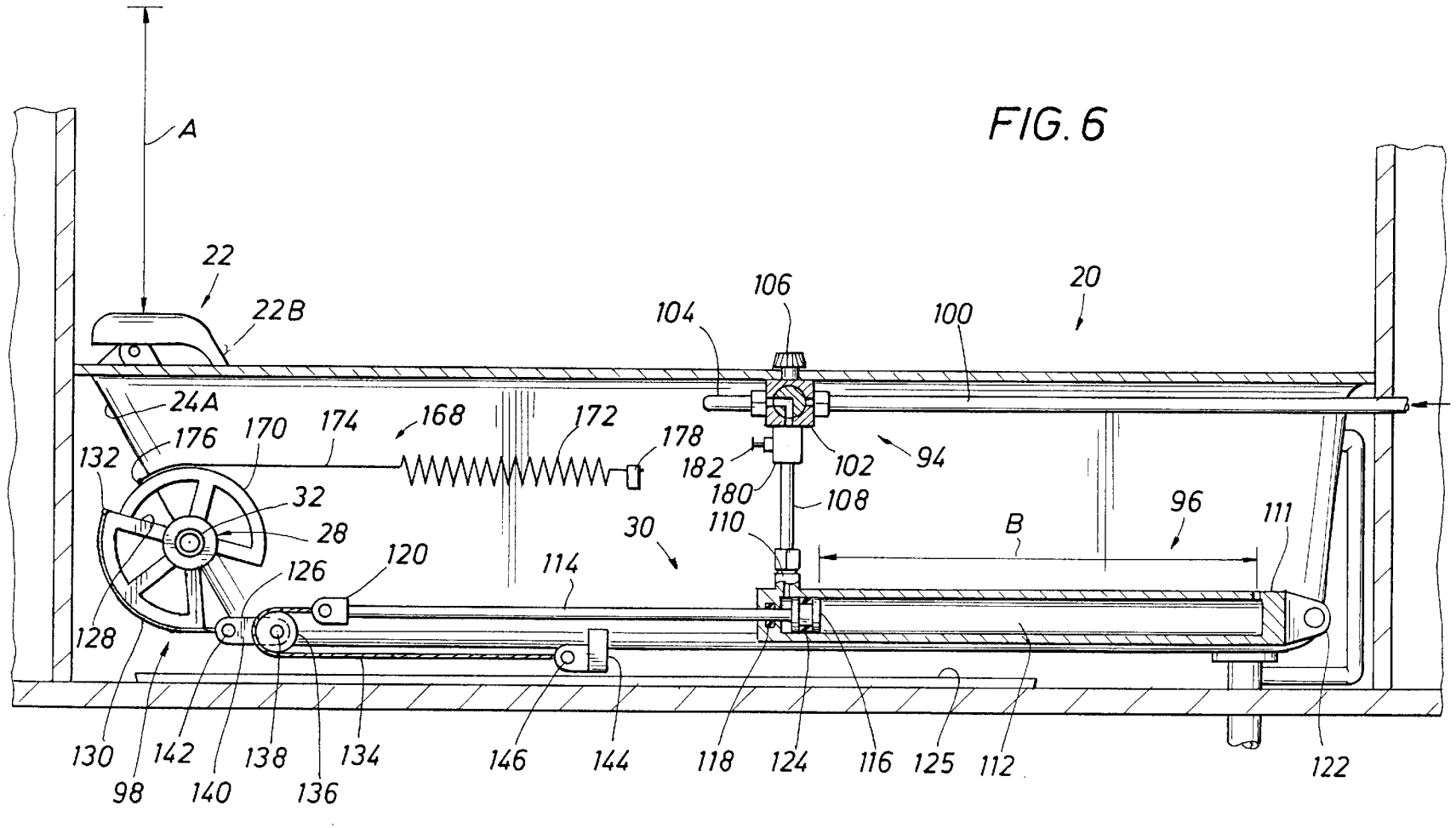
FIG. 6 is a side elevational view taken along line 6—6 of FIG. 3 showing the lifting power system of the composite embodiments.
Figure 7:
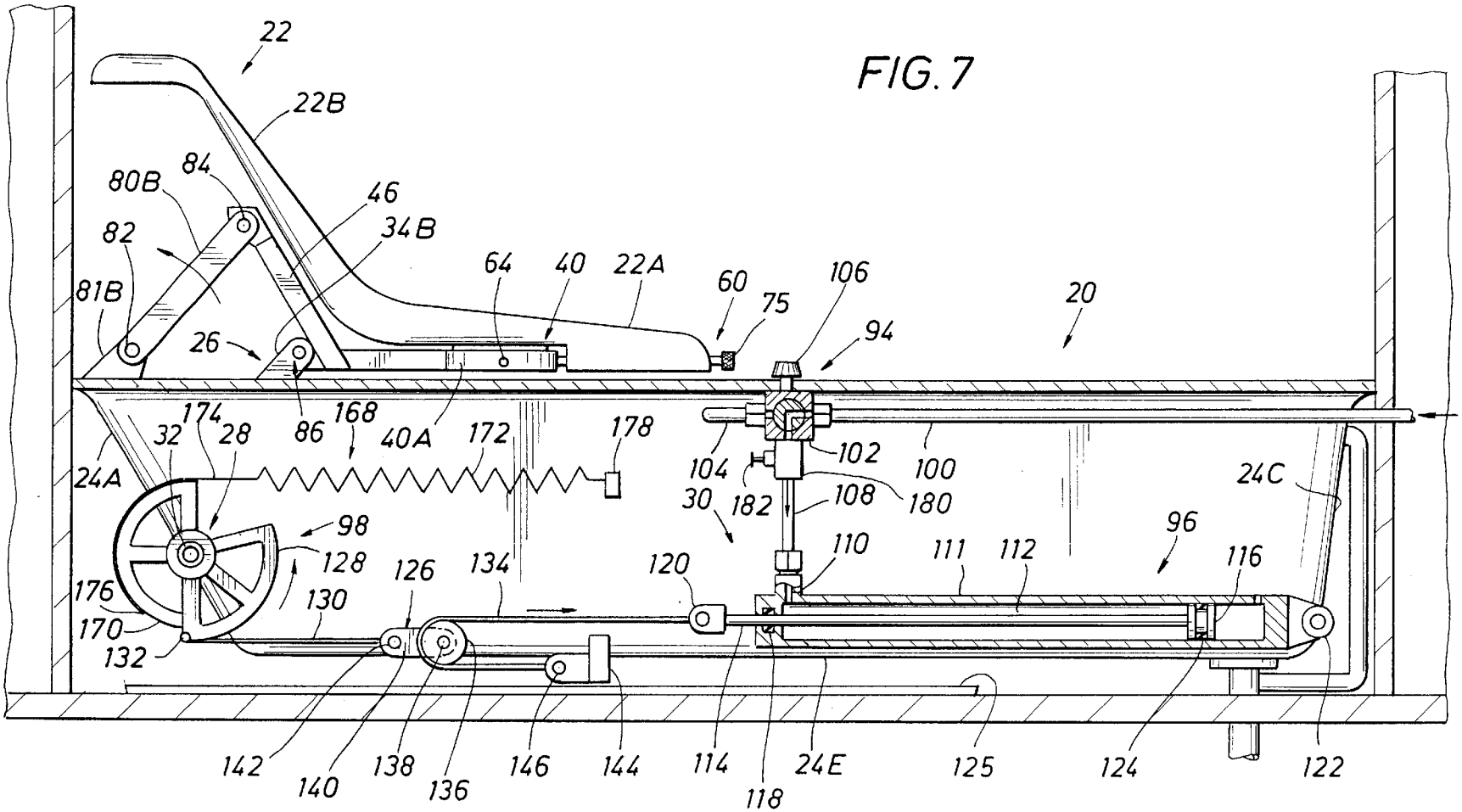
FIG. 7 is a side elevational view, similar to FIG. 6, showing the seat in the raised position.

Lifting device 28 can best be seen in FIGS. 1, 2, 3, 4, 5, 6, 7, and 8. In the alternative composite embodiment A, as best shown in FIGS. 4 and 5, the lifting device 28 is rotatable member or steel rod 32. The rod 32 is positioned in the bath 20 using lower wall opening 88, upper wall opening 90, washer 92, and rotatable member seal 93. The seal 93 is preferably fabricated from an elastomer, such as rubber. The rotatable member 32 extends from upper wall opening 90 and through lower wall opening 88. Upper wall opening 90 is located above lower wall opening 88 such that rotatable member 32 is positioned at angle Ø with respect to the bottom 24E of bath 20. Washer 92 is positioned in bath wall 24D such that washer 92 aides the rotation of rotatable member 32 relative to wall opening 90. Rotatable member seal 93 sealing opening 88 provides a water tight seal about rotatable member 32. Since seal 93 surrounds cylindrical rod 32, the rotation of rod 32 about its cylindrical axis does not significantly distort the seal 93. Thus, the seal 93 is maintained under constant static pressure which is an advantageous condition for maintaining a good seal. Other embodiments may use upper wall rod 82 as the lifting device and in doing so may alleviate the need for seal 93 by locating the lowest wall opening above the water line of the bath. As best shown in FIGS. 6 and 7, leverage mechanism, generally indicated at 98, attaches to the portion of rotatable member 32 which extends though lower wall opening 88 to provide lifting device 28 its lifting force. Yet, other embodiments may use entirely different lifting devices, including such mechanisms which are not connected with the guiding assembly, or such mechanisms which require no proposed openings in bath walls 24, as discussed below in preferred retrofit embodiments, the alternative retrofit embodiments as well as the alternative composite embodiment B.

A preferred lifting power system 30 is best shown in FIGS. 6 and 7. The lifting power system 30 has the following four components: a fluid control system, generally indicated at 94, a drive system, generally indicated at 96, a leverage system, generally indicated at 98, and a return mechanism, generally indicated at 168. The fluid control system 94 controls the in-flow and the out-flow of fluid, such as liquid, into the drive system 96 and, therefore, controls the lifting and raising of the seat 22. The drive system 96 transforms the fluid pressure into a mechanical linear force. The leverage system 98 transforms mechanical linear force into a torquing force applied to rotatable member 32. The return mechanism 168 supplies a force to lower seat 22 to its lowered position. In the alternative composite embodiment A, the lifting power system 30 is located out of view, within the walls of bath 20. For easy access to the components of lifting power system 30, a removable outer panel 25, as best shown in FIGS. 4 and 5, is preferably incorporated into the bath 20. Other embodiments may place the lifting power system within the adjacent bathroom walls, or, if necessary, even expose such a system in the bathroom itself. Other alternative embodiments may even use other forms of lifting power systems that provide torque to rotatable member 32, for example, an electric motor.

As best shown in FIGS. 6 and 7, the fluid control system 94 of the alternative composite embodiment A is made up of the following components: a feeder pipe 100, a control valve 102, a discharge pipe 104, a control knob 106, a needle valve 180, a needle valve adjustment mechanism 182, and a control pipe 108 between needle valve 180 and a chamber inlet 110. Feeder pipe 100 communicates fluid which lifts seat 22. In alternative composite embodiment A, the fluid used is preferably water supplied under standard tap water pressure. However, it is contemplated that the fluid could be pressurized by a pump or by a hydraulic pressure multiplier, as discussed below in detail. In addition, and as shown in FIGS. 6 and 7, as a safeguard, drip pan type mechanism 125 may be used under lifting power system 30, and under all other components which may leak fluids, such as lower wall opening 88, or any other component which might accumulate and drip condensation. Other alternative embodiments may use other forms of fluid control systems that control the flow of fluid into and out of fluid control system 94 or the drive system 96. Also, it is contemplated that other embodiments may utilize other fluids other than water, such as other liquids or even gaseous materials in place of tap water.

Control valve 102 controls the flow of fluid between feeder pipe 100 and control pipe 108. Control knob 106 operates control valve 102 to allow fluid to enter into, and exit from, the drive system 96 which, in turn, raises and lowers seat 22. Control pipe 108 communicates fluid into and out of drive system 96. Discharge pipe 104 empties fluid from drive system 96 into bath 20 by moving the control knob 106 so the control valve 102 is in the discharge position, as shown in FIG. 6. It is contemplated that the fluid control system 94 would be initially adjusted through the manipulation of needle valve adjustment mechanism 182, such that when control valve 102 is fully open the restricted setting of needle valve 180 would result in the bather descending at a comfortable rate of speed. It should be noted that control knob 106 can be moved such that control valve 102 is in misalignment with feeder pipe 100 and control pipe 108 allowing the operator to further control the volume of fluid entering or exiting pipe 108, and as a result, control the speed at which seat 22 rises or lowers. FIG. 7 shows control valve 102 in the lifting power position, where seat 22 would rise at its fastest rate. The diameter of control valve 102, feeder pipe 100, and/or control pipe 108, should be sized such that the resulting seat movement moves at rate that is within a comfort level for bathers.

As best shown in FIGS. 6 and 7, drive system 96 comprises a chamber housing 111, a chamber 112, a piston rod 114, a piston head 116, a rod seal 118, a rod connector 120, a chamber housing mount 122, and a piston head seal 124. Chamber housing 111 defines chamber 112. Chamber 112 is filled and emptied of fluid from the fluid control system 94 causing piston head 116 to travel within chamber 112. Piston head 116 and piston head seal 124 provide a seal between the filled and unfilled portion of chamber 112. Chamber housing 111 is secured to bath 20 via chamber housing mount 122. Piston rod 114 is connected to piston head 116 and moves linearly with the movement of piston head 116. Rod seal 118 provides a seal about the piston rod 114 at the exit point of chamber 112. Rod connector 120 connects the piston rod 114 to the leverage system 98. In the alternative composite embodiment A, as best shown in FIG. 6, the travel distance B of piston head 116 is greater than the distance A traveled by seat 22, thus giving a leverage advantage to drive system 96 over seat 22. Other alternative embodiments are contemplated that may use other forms of drive systems to transform fluid pressure into mechanical energy.

Continuing with FIGS. 6 and 7, the leverage system 98 of the alternative composite embodiment A comprises a pulley assembly 126, cam 128, cam cable 130, and cam cable connection 132. Pulley assembly 126 comprises a pulley wheel cable 134, pulley wheel 136, pulley wheel post 138, pulley body 140, pulley body cable connection 142, pulley wheel cable anchor 144, and anchor connection 146. Pulley wheel cable 134 is connected between rod connector 120 at the end of piston rod 114, and anchor connector 146 located on pulley wheel cable anchor 144. Pulley wheel cable 134 is looped about pulley wheel 136. Pulley wheel 136 is rotatably attached to pulley body 140 on pulley wheel post 138. Cam cable 130 is attached between pulley body 140 at the pulley body cable connection 142, and cam 128 at cam cable connection 132. Since cam 128 is fixedly attached about rotatable member 32, any movement of cam cable 130 results in the rotation of cam 128 which, in turn, rotates rotatable member 32 to move seat 22. Other alternative embodiments may utilize upper wall rod 82 as the rotatable member, with upper wall rod 82 only spanning between the wall connections and not extend into the side walls of the bath, and thus avoiding the need for any sealing means associated with opening 88 in the alternative composite embodiment A since the upper wall rod is accessible above the water line of the bath. Yet, other alternative embodiments may use other forms of leverage systems which transform a supplied mechanical energy into rotational energy.

Still continuing with FIGS. 6 and 7, the return mechanism 168 of the alternative composite embodiment A comprises a return cam 170, a spring 172, a return cam cable 174, a return cam cable connection 176, and a spring mooring 178. Spring 172 is connected at one end to spring mooring 178, and at the other, to return cam cable 174. Return cam cable 174 is, in turn, connected to return cam cable connection 176. Since return cam 170 is fixedly attached about rotatable member 32, any movement of return cam cable 174 results in the rotation of return cam 170 which, in turn, rotates rotatable member 32 to move seat 22. Other alternative embodiments may use other configurations to supply the force needed to return seat 22 to its lowered position, for example, a weight attached to seat 22, such that gravitational force provides the force necessary to lower the seat, or a torsional spring attached to rotatable member 32, such that rotational force urges the seat in the lowering direction. In addition, alternative embodiments may use springs of different sizes and strength or may use cams with a different radius. Yet, other alternative embodiments may utilize a single cam to perform both the functions of cam 128 and return cam 170.

Use and Operation of Alternative Composite Embodiment A

A typical bather, being wheelchair assisted, would typically leave the bath system with seat 22 in its lowered position, as shown in FIG. 1. To transfer to the bath 20, bather wheels his or her chair along side of bath 20. The operator of the bath system then uses control knob 106 to initiate the flow of water from feeder pipe 100 through control pipe 108 into chamber 112. As water fills chamber 112, the water pressure forces piston head 116 along chamber 112 towards the bath wall 24C.

As shown in FIGS. 6 and 7, as piston head 116 travels along chamber 112, piston rod 114 and pulley wheel cable 134 move. Since pulley wheel cable 134 is threaded through pulley wheel 136 and anchored by pulley wheel cable anchor 144, the movement of pulley wheel cable 134 causes pulley wheel 136 to rotate and move in the same direction. The use of this leverage system 98 requires less force from the drive system 96 to lift seat 22. The movement of cam cable 130 causes cam 128, return cam 170, fixedly attached to rotatable member 32 to rotate. Return mechanism 168 is also set into motion with the movement of cam cable 130, however, its operation is essentially inconsequential while seat 22 is occupied with a bather, as the force supplied by return mechanism 168 is small in comparison to the weight of the bather. As shown in FIGS. 4 and 5, as rotatable member 32 rotates, guiding assembly 26, moves seat 22 in a smooth fashion along a straight line path from its central location at or near the longitudinal axis D of the bath bottom 24E, as best shown in FIG. 3, to a location, as best shown in FIG. 5, where the side of seat 22 is at or beyond the top of side wall 24D. The angle Ø of the path is preferably between 10° and 20° from the orthogonal of the bath bottom 24E. Preferably Ø is 15°. In so moving, the arm sets 34A, 34B and 80A, 80B of guiding assembly 26 move in unison from a position pointing substantially towards the bottom 24E of bath 20 to a position pointing substantially away from the bottom 24E of bath 20 to raise connected seat bottom 22A above the top of bath 20.

In its fully raised position, seat 22 is at or beyond the top of the side wall 24D of bath 20, so that bather can transfer to seat 22. To transfer to seat 22, the bather maneuvers his or her wheelchair so that it is substantially parallel to the bath and next to the seat 22. The bather then slides off the chair onto the ledge of bath 20 and/or, if capable, directly onto seat 22. Then, the bather brings the bather's legs over side wall 24D and into bath 20.

As best shown in FIGS. 4, 5 and 6, and discussed above, once securely in seat 22, control knob 106 is operated to release the water from chamber 112 and lower the bather into bath 20. The discharged water travels through control pipe 108 and discharge pipe 104 into bath 20. During this process, seat 22, guiding assembly 26, lifting device 28, and lifting power system 30, all reverse direction. During the lowering mode, the bather sitting on the seat 22 experiences a constant and smooth descent along a straight line path away from the side 24D of bath 20, towards the central position longitudinal axis D of the bath bottom 24E. When seat 22 has been properly lowered, the bather can begin bathing. The filling of the bath with bath water may be done at any point before, during or after this process, or, if a shower is desired, may not be filled at all. If the seat 22 is used in conjunction with a shower, the seat may be stopped in any desired position along the path that seat 22 travels. Allowing the operator to choose to stop seat 22 in any location along the path of seat 22, i.e., an infinite number of locations, the bather can choose the most comfortable position. For example, the bather may want the seat slightly elevated while taking a shower as compared to the lowest position to be more fully submerged while taking a bath. To stop the seat in any position along the path traveled by seat 22, the operator need only position control knob 106 such that control valve 102 is in a position that it does not communicate control pipe 108 to either discharge pipe 104 or feeder pipe 100.

To allow the bather to exit bath 20, the operator simply follows the steps described earlier to position the seat for transfer. However, now the operator operates the control knob 106 while the bather is in seat 22. The operator and bather can be different or the same person. While exiting bath 20, seat 22 ascends smoothly, in one continuous straight line movement, along a proportional angular path, from the lowered position at or near the longitudinal axis D of the bath bottom 24E, to a raised position at or above the side of bath 20. Once fully raised, the bather reverses his/her earlier movements to transfer back into the wheelchair. Once in the chair, the operator would use control knob 106 to return the seat 22 to its lowered position. To lower the unoccupied seat 22, the operator simply follows the steps described earlier for lowering the seat. However, with the absence of a bather from seat 22, the additional force generated by return mechanism 168 assist the return of seat 22, guiding assembly 26, lifting device 28, and lifting power system 30 to their respective positions when seat 22 is in its fully lowered position.

Rotation assembly 40 allows for the rotation of seat 22 at a location above the top of bath 20. The operation of this mechanism has not been fully described, as seat 22 has only been shown in the rotated position with phantom views, but may be useful for bathers. It is contemplated that bathers, not in wheelchairs, could mount the seat 22 when rotated to face the side of the bath, as shown in phantom view in FIGS. 3 and 5.

Alternative Composite Embodiment B

Turning now to the alternative composite embodiment B shown in FIGS. 10–11, the alternative composite embodiment B utilizes similar component parts to the alternative composite embodiment A, including bath 20, seat 22 and guiding assembly 26, but includes an alternative bellows member 148. The bellows member 148 includes an upper connector ring 150, a lower connector ring 152, a bellows casing 154, and a bellows inlet member 156. This alternative embodiment includes the additional feature of bellows recess 158 in the bath bottom 24E. The bellows recess 158 provides adequate space below the seat when the bellows is in its compressed mode. The presence of bellows recess 158 may require a deeper channel recess 38 communicating between bellows recess 158 and the drain opening 24F, or alternatively another drain opening could be provided in bellows recess 158. Other embodiments may use a different recess formation or may have no recess formations at all.

Bellows casing 154 is attached between the seat bottom 22A and the bottom 24E of bath 20 via upper ring 150 and lower ring 152. The lower ring 152 is located within bellows recess 158. Bellows inlet member 156 allows for fluid to move between the fluid control system 94 including the needle valve 180 (not shown in FIGS. 10 and 11), as previously described, and bellows member 148. As the bellows member 148 fills with a fluid, the bellows member 148 expands and raises seat 22. Guiding assembly 26 controls the direction that seat 22 moves, as movement is imparted to seat 22 by expanding bellows member 148. Here, unlike the alternative composite embodiment A, rotatable member 32 is a passive rotatable member, that does not need to extend through any bath wall, like the other above-described guiding assembly rods 82, 84 and 86. With this exception, the guiding assembly, in this alternative embodiment, is essentially the same as the one in the alternative composite embodiment A. Other embodiments may use other guiding assemblies, such as, the use of a simple guide pole or poles that extend from the walls of the bath. Such a pole might be disposed within the bellows member 148 itself. Other embodiments may follow a path other than the described angular path, for example, the seat may rise at a 90° angle to the bottom 24E and, therefore, not have any lateral movement. Other embodiments may also place the bellows member 148 in a location other than below seat 22. For example, the bellows may instead contact a guiding assembly connected to the seat, which, in turn, causes seat 22 to move. In addition, other embodiments may use other forms of an expandable member, which when expanded, causes the raising of seat 22, for example, a balloon type member or the bellow described below and shown in FIGS. 28–32.

Use and Operation of Alternative Composite Embodiment B

The bather mounts and dismounts seat 22 in the same manner as described in the alternative composite embodiment A. However, as best shown in FIGS. 10 and 11, to raise seat 22, an operator uses control knob 106 to initiate the flow of fluid, such as water, from feeder pipe 100 through control pipe 108 into alternative bellows member 148. As water fills bellows member 148, the water pressure expands bellows member 148.

As bellows member 148 expands, it pushes against seat 22 and moves seat 22 away from the bottom 24E of bath 20. Guiding assembly 26 guides seat 22 along a smooth and continuous straight line proportional angular path from the longitudinal axis D of bath bottom 24E, to a location where the side of seat 22 is at or beyond the top of side wall 24D. In so moving, the set of arms 34A, 34B and 80A, 80B of guiding assembly 26 move in unison from a position pointing substantially towards the bottom 24E of bath 20 to a position pointing substantially away from the bottom 24E of bath 20, and raise seat bottom 22A above the top of bath 20.

To lower seat 22, the operator moves control knob 106 to release water from bellows member 148 to discharge pipe 104 into bath 20. The weighted seat 22, or, in case a bather is located thereon, the weight of a bather and the seat on bellows member 148 urges the water within bellows member 148 to be discharged into control pipe 108, through control valve 102 to discharge pipe 104 into bath 20. During the lowering mode, seat 22 experiences a constant and smooth straight line decent along a proportional angular path away from the side 24D of bath 20, towards at or near the longitudinal axis D of the bath bottom 24E.

Alternative Composite Embodiment C

Turning now to the alternative composite embodiment C shown in FIG. 12, the alternative composite embodiment C utilizes similar component parts as those found in the alternative composite embodiment A except that lifting power system 30 is significantly altered. Although the fluid control system 94 and the return mechanism 168 have remained very similar to those in the alternative composite embodiment A, the drive system 96 and the leverage mechanism 98 of the alternative composite embodiment A have been replaced with a preferred lifting power system comprising a power piston system 184 and power cam system 186, respectively.

The power piston system 184 comprises a power piston housing 188, a power piston chamber 190, a power piston rod 192, a power piston head 194, a power piston rod seal 196, a power piston rod connector 198, a power piston housing mount 200, and a power piston head seal 202. A power piston housing 188 defines power piston chamber 190. Power piston chamber 190 is filled and emptied of fluid from the fluid control system 94, through power inlet member 210, causing power piston head 194 to travel within power piston chamber 190. Power piston head 194 and power piston head seal 202 provide a seal between the filled and unfilled portion of power piston chamber 190. Power piston chamber 190 is secured to bath 20 via power piston housing mount 200. Power piston rod 192 is connected to power piston head 194 and moves linearly with the movement of power piston head 194. Power piston rod seal 196 provides a seal about the power piston rod 192 at the exit point of power piston chamber 190. Power piston rod connector 198 connects power piston rod 192 directly to the cam system 186 via power cam cable 204. The amount of liquid needed to fill piston chamber 190 is approximately 2.5 quarts.

Use and Operation of Alternative Composite Embodiment C

The operation of alternative composite embodiment C is similar to that of the alternative composite embodiment A. However, power cam cable 204 is instead connected directly between power piston rod connector 198 and power cam connector 206, eliminating pulley assembly 126 of the alternative composite embodiment A. Rather than using a pulley assembly 126 to provide leverage to the force supplied by power piston system 184, power cam cable 204 provides a direct connection between power piston system 184 and power cam system 186. As shown in FIG. 12, as power piston head 194 travels along power piston chamber 190, power piston rod 192 and power cam cable 204 move along a linear path. The movement of power cam cable 204 causes both power cam 208 and fixedly attached rotatable member 32 to rotate. This rotation, as described in the alternative composite embodiment A, results in the lifting movement of seat 22.

Preferred Composite Embodiment

Turning now to the preferred composite embodiment, shown in FIGS. 33–35, the preferred composite embodiment uses a bath 20''', along with similar component parts as those found in the alternative composite embodiment A except for the following: upper arms 80A''' and 80B''' pivot from slightly below the top of the back 24''' of the bath 20''', all arms 80A''', 80B''', 34A''' and 34B''' pivot from within back recess 434, in addition, and like shown in the preferred straight up retrofit embodiment described below, seat 22''', having an arm rest 320, pivots on rotation assembly 40' using a form of locking pin 60' having an engagement pin 338, a rotation block 336, a pivot pin 340 as well as an arm rest 320. In addition, and like the preferred straight up retrofit embodiment, seat back 22B''' is pivotally connected such that the seat back 22B''' may tilt backwards allowing the bather greater mobility. Further, as best shown in FIGS. 34 and 35, seat back 22B''' does not extend above the top of bath 20''' when seat 22''' is in its lowered position. Unlike bath 20 of the alternative composite embodiment A, bath 20''' is slightly larger being four inches wider, twelve inches longer and six inches deeper, and has a back bath wall 24A''' having a 15° angle away from the vertical, rather than the 30° angle found in bath 20.

Both the decreased angle of bath wall 24A''', and back recess 434 allow seat 22''' to be located closer to the back 24''' of bath 20''', thus allowing greater distance between seat back 22B''' and the front 24C''' of the bath 20''', resulting in more leg room for the bather. The back recess 434 having back recess sides 436A and 436B, and back recess wall 438. Rotatable member 32''' penetrating back recess side 436B and connected to back recess side 436A, and upper wall rod 82''' connected between the same back recess sides 436B and 436A. The rotatable member 32''' and upper wall rod 82''' may be mounted on an angle with respect to the bottom 24E''' of bath 20''' such that seat 22''' follows a path, from the lowered position to the raised position, from the longitudinal center of the bath to a location near the top of side wall 24D'''. The lesser the slope of back wall 24A''' the less distance upper arms 80A''' and 80B''' and bottom members 34A''' and 34B''' extend towards front bath wall 24C''' (not shown), thus providing greater room for the bather.

A list of component parts from the preferred composite embodiment that are similar to those found in the alternative composite embodiment, but subject to slight modification due to the inherent differences in design, include, but are not limited to: upper wall rod 82''', rotatable member 32''', lower seat rod 86''', bottom member 34A''', bottom member 34B''', upper arm 80A''', upper arm 80B''', bath 20''', bath wall 24A''', bath wall 24B''', bath wall 24C''' (not shown), bath wall 24D''', bath bottom 24E''', seat 22''', seat bottom 22A''' and seat back 22B'''.

Use and Operation of Preferred Composite Embodiment

The operation of preferred composite embodiment is similar to that of the alternative composite embodiment A. However, because both the angle of the back side wall 24A''' is steeper, and the bath recess 434 allows arms 80A''', 80B''', 34A''' and 34B''' to be mounted within back recess 434, when seat 22''' is in its lowered position the seat 22''' is located at a distance that is further away from front wall 24C''' than seat 22 is from front wall 24C in the alternative composite embodiment A.

Preferred Retrofit Embodiments

The preferred retrofit embodiments ARE shown in FIGS. 13–25 and 36–43. Specifically, the preferred straight up retrofit embodiment is shown in FIGS. 13–25 and the preferred laterally offset retrofit embodiment, (whose figure numbers are indirectly referred to in this section in the parenthetical), is shown in FIGS. 36–43. The preferred retrofit embodiments comprise: a frame, generally indicated at 300 (300"), a seat, generally indicated at 22', guiding assembly, generally indicated at 26' (26"), lifting device, generally indicated at 28', and lifting power system, generally indicated at 30'. The preferred retrofit embodiments are intended to be compatible with a majority of standard baths, old or new. In addition, it is contemplated that the proposed system could be subsequently removed from such baths while leaving them in substantially the same condition as they were in pre-installation.

Figure 13:
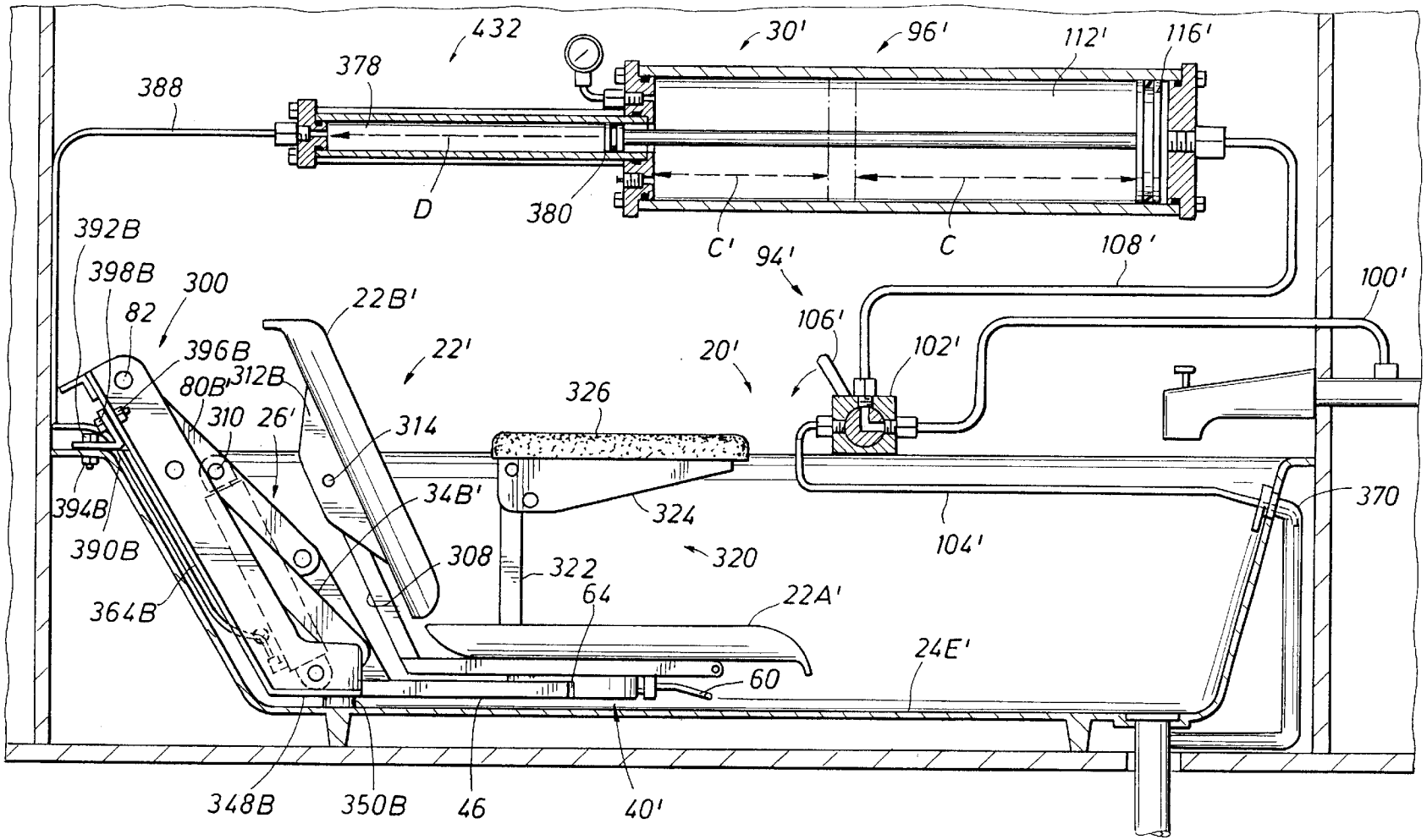
FIG. 13 is a cut-away side elevational view of the preferred straight up retrofit embodiment with the seat in the lowered position along with a cut-away of its lifting power system.
Figure 15:
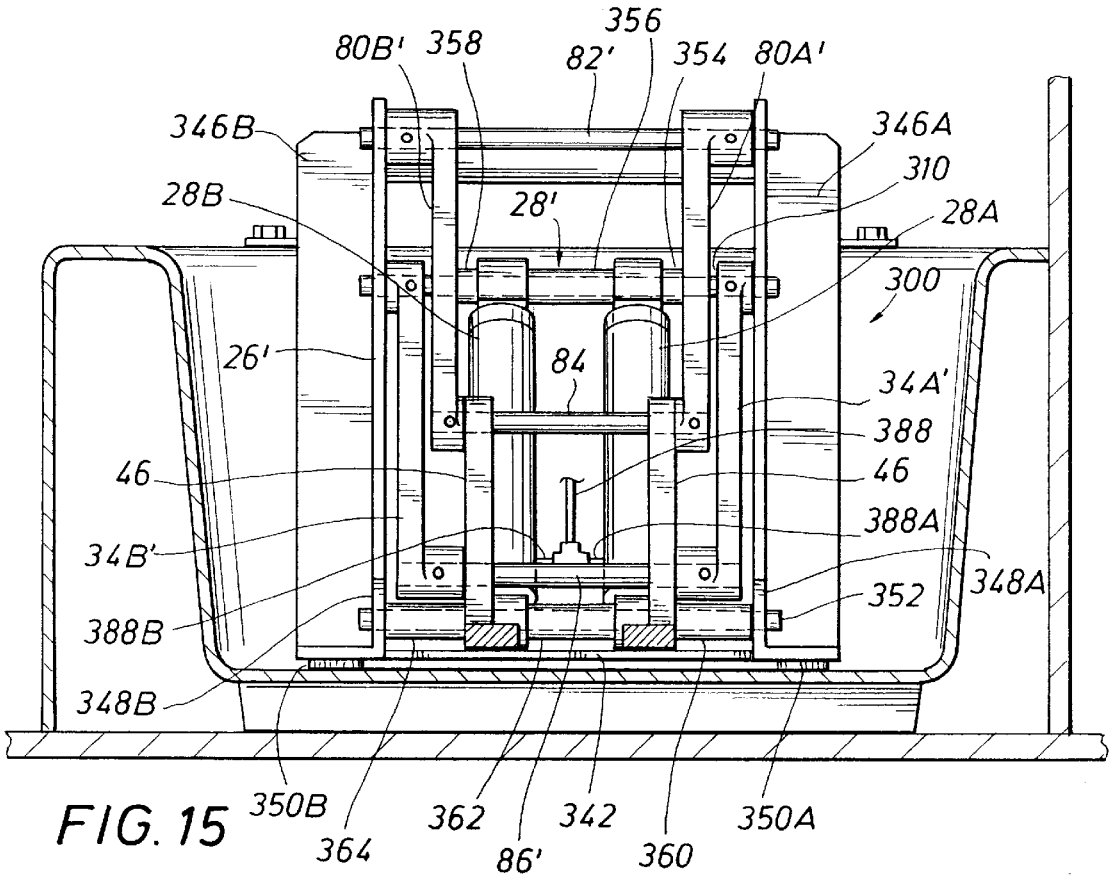
FIG. 15 is a view of the preferred straight up retrofit embodiment taken along line 15—15 of FIG. 14 to better show its guiding assembly and lifting device.
Figure 19:
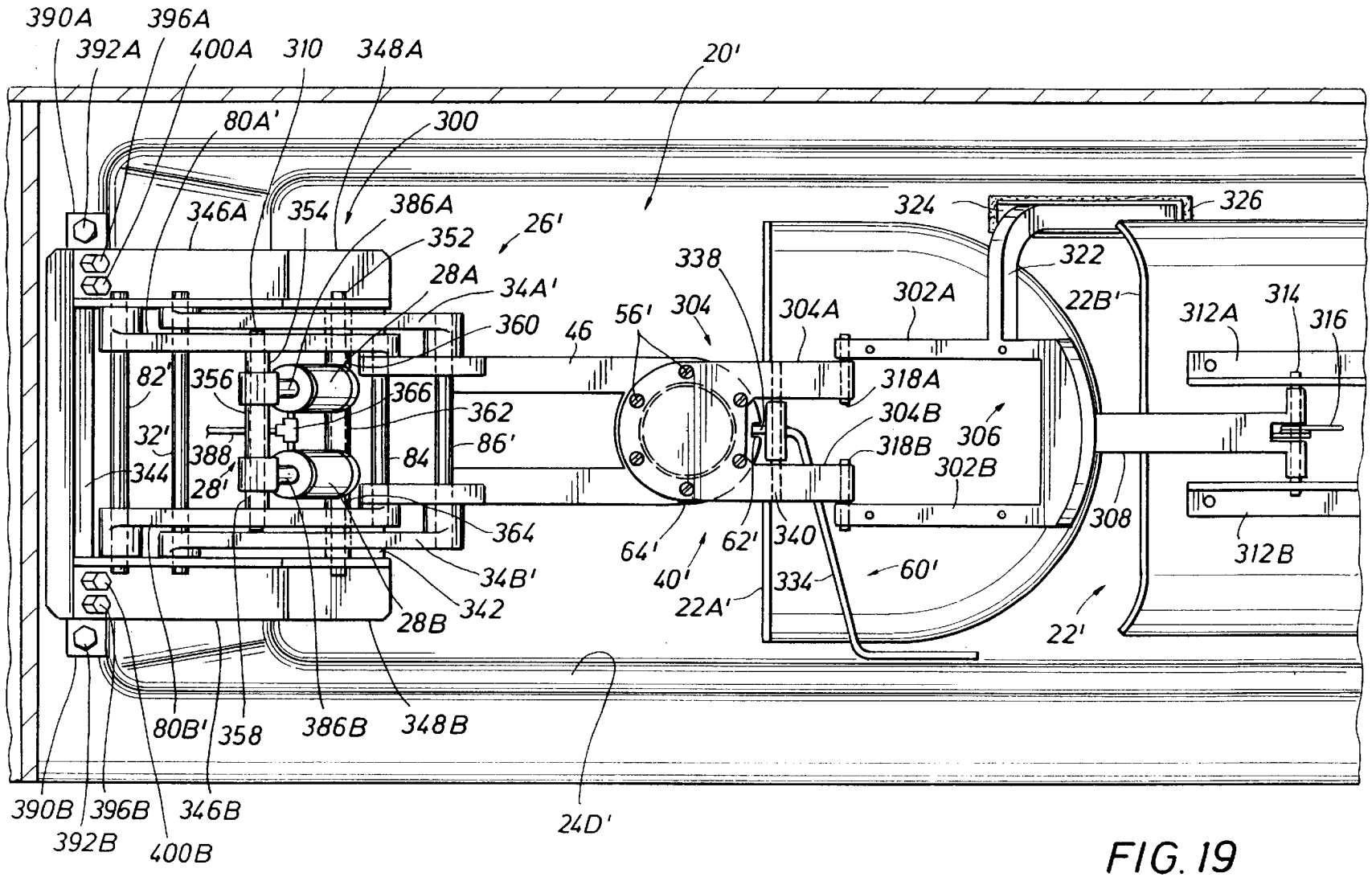
FIG. 19 is a top view of the preferred straight up retrofit embodiment with the seat pivoted forward to its access position as shown in FIG. 18.
Figure 37:
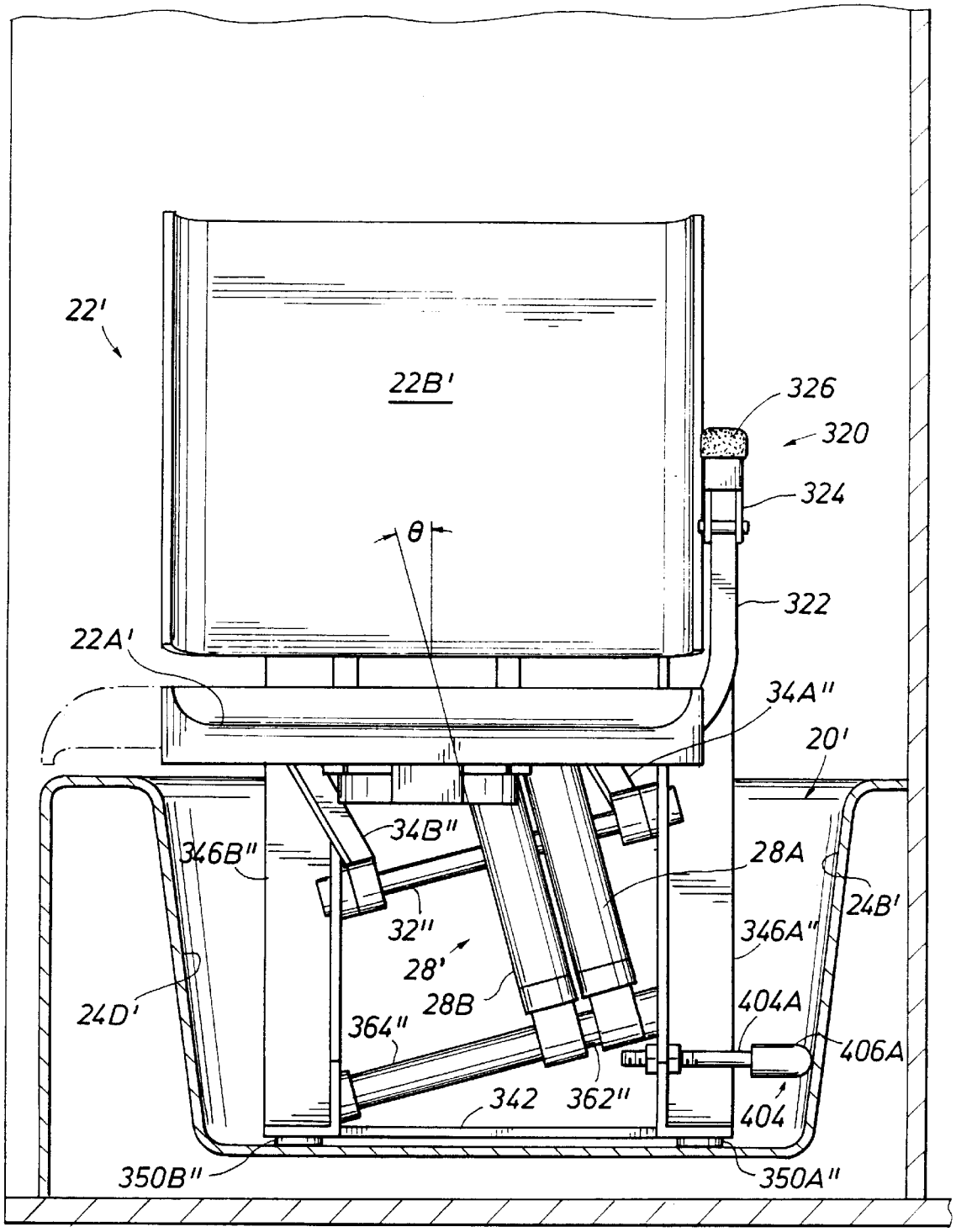
FIG. 37 is a cut-away length view of the preferred laterally offset retrofit embodiment looking in the direction of the back of the bath showing the seat in a raised position.

Frame 300 (300"), best shown in FIGS. 13, 15 and 19, has two side members 346A (346A") and 346B (346B"), two bottom members 348A (348A") and 348B (348B") and two cross-members 342 and 344. The two cross-members 342 and 344 have a length that allows frame 300 (300") to fit within standard bathtub widths, and to provide sufficient stability during high torque activities, such as shown in FIG. 37, where seat 22' is occupied with a bather and is swiveled to extend over the side of bath 20'. Other retrofit embodiments may use, for example, a single center placed frame side and bottom members while extending the cross-members towards the side of the bath, rather than between such frame side members.

Side members 346A (346A") and 346B (346B"), as shown in FIGS. 13, 15 and 19, are fixedly attached to bottom members 348A (348A") and 348B (348B") such that the side members 346A (346A") and 346B (346B") rest substantially parallel to the back wall 24A' of a standard bathtub and the bottom members rest substantially parallel to the bottom 24E' of the bath 20' (i.e., 90° from vertical). In the preferred retrofit embodiments shown in such Figures, the angle of the back wall 24A' is 30° from the vertical, and as such, the side members 346A (346A") and 346B (346B") are attached at a 120° angle from the bottom members 348A (348A") and 348B (348B"). At such an angle, the preferred retrofit embodiments are operable for any bath with a back angle steeper than 30°, as the side members 346A (346A") and 346B (346B"), need not rest parallel with the back wall 24A' of the bath 20' as long as the top of the side members 346A (346A") and 346B (346B") can be connected to the top of the back bath wall 24A'. It is preferable to use a steeper angle in the design, as the farther back the frame 300 (300") rests, the farther back the seat 22' also rests.

Figure 17:
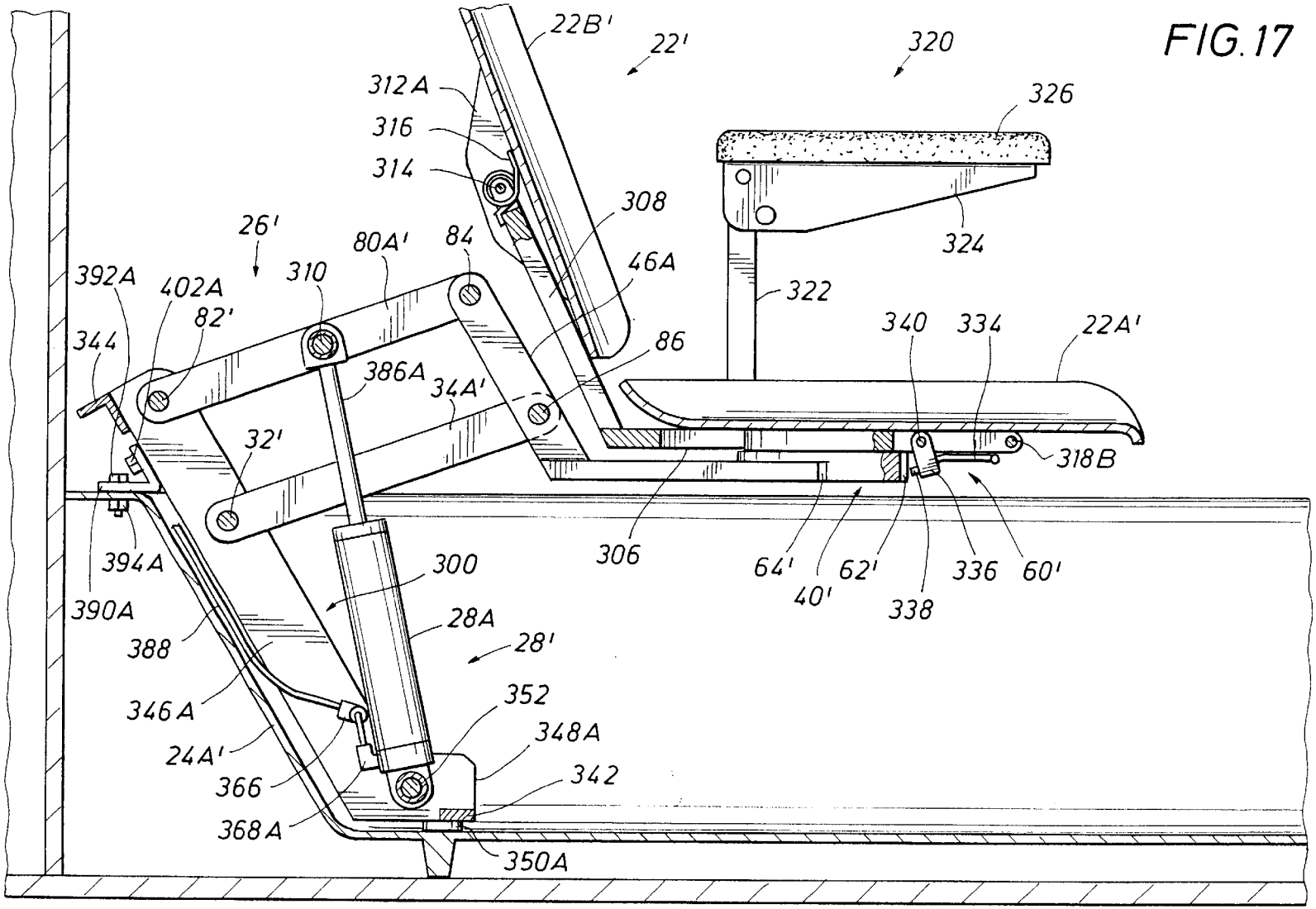
FIG. 17 is a view of the preferred straight up retrofit embodiment similar to FIG. 14 showing the seat in the raised position.

The cross-members 342 and 344, as shown best in FIGS. 15 and 19, are attached to the upper ends of the side members 346A (346A") and 346B (346B") and at the far ends of bottom members 348A (348A") and 348B (348B"). Other embodiments may place such cross-members elsewhere, or utilize a smaller or greater number of cross-members, or have no cross-members at all, for example, where the upper wall rod 82' (82"), rotatable rod 32' (32") and/or lower power lifting rod 352 (352") would provide the rigidity otherwise provided by the cross-members 342 and 344. Attached to the bottom of bottom members 348A (348A") and 348B (348B"), as shown in FIGS. 14, 17 and 38, are rubber feet 350A and 350B.

Securing frame 300 (300") to bath 20', as best shown in FIGS. 13, 15 and 19, is accomplished by attaching the frame 300 (300") to the top of back bath wall 24A' via back brackets 390A and 390B, bolts 392A, 392B, 396A, 396B, 400A and 400B, and nuts 394A, 394B, 398A (398A not shown), 398B, 402A and 402B. Specifically, bolts 396A, 396B, 400A and 400B, along with nuts 398A (not shown), 398B, 402A and 402B, secure brackets back 390A and 390B to the frame 300 (300"), and bolts 392A and 392B along with nuts 394A and 394B secure the same brackets to the back of the bath. Preferably, nuts 394A and 394B are expanding anchor "butterfly" nuts (not shown). Although the preferred straight up retrofit embodiment uses the described brackets, bolts and nuts, at a location at the top of the back of the bath, it is contemplated that other embodiments may utilize other appropriate attachment locations and means, including the use of suction cups, and the use of the suction cups along the frame.

Seat 22', preferably fabricated from a non-corrosive material such as plastic or fiberglass, can be seen in FIGS. 13–14, 17–19, 27 and 37–38. As best shown in FIGS. 13–14, 16–19, 35, 37 and 38, seat 22' includes a seat back 22B' and a seat bottom 22A'. The seat back 22B' and seat bottom 22A' are attached together, respectively, via seat back support 308 and seat base 306 which are rigidly connected to one another as shown in FIGS. 13, 14 and 17–19.

Figure 14:
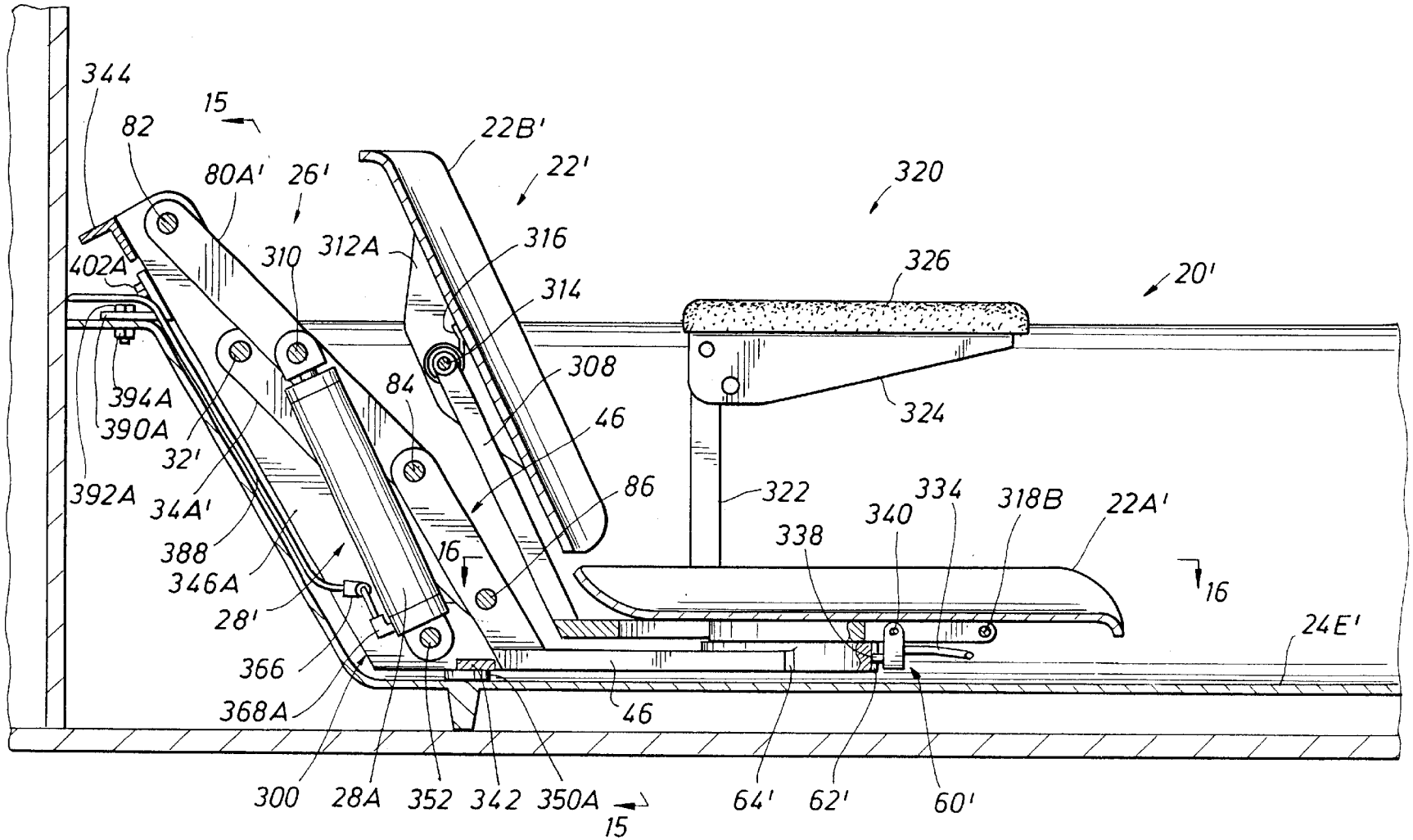
FIG. 14 is a partial cut-away side elevational view of the preferred straight up retrofit embodiment taken along the longitudinal center of the bath.
Figures 38, 39:
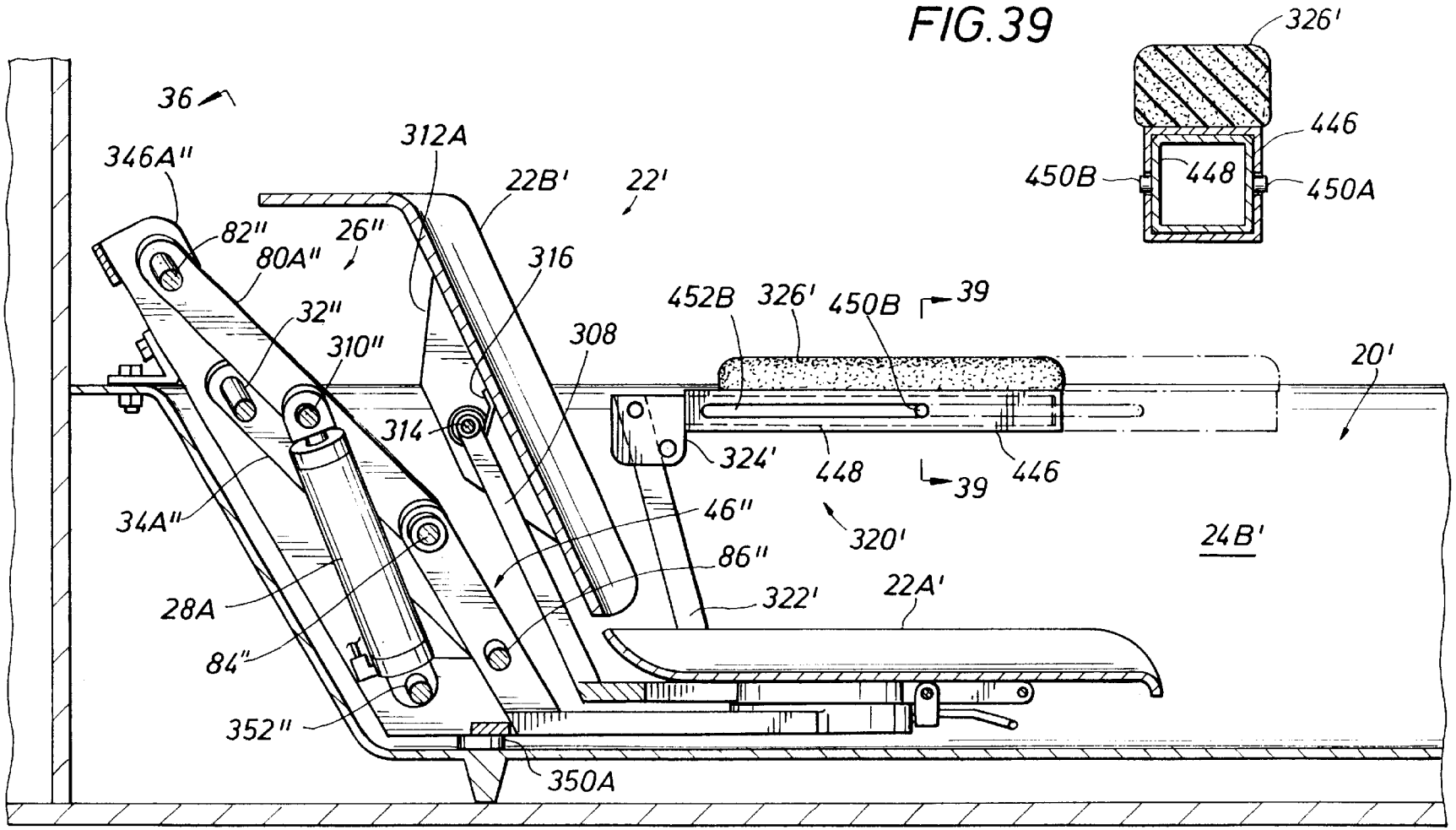
FIG. 38 is a cut-away side elevational view of the preferred laterally offset retrofit embodiment of the bath lift system with the seat in the lowered position.
FIG. 39 is a section taken along line 39—39 of FIG. 38 to better show the telescoping armrest.

Seat back support 308, as best shown in FIGS. 14, 19 and 38, is connected to seat back 22B' via seat back brackets 312A and 312B, and pivot bar 314. Pivot bar 314 passes through the top of seat back support 308 and extends either side thereof. Such extensions are pivotally connected to seat back brackets 312A and 312B, such that seat back 22B' may pivot forward and backward about the connection. Tension coil spring 316 constantly provides a force about pivot bar 314 urging the seat back 22B' towards the vertical, as seen in FIG. 14. The ability of seat back 22B' to move away from the vertical towards the horizontal, when a force is applied to the top of seat back 22B', allows a bather to move his nor her upper body lower into the water and allows them also to easily slide his or her body forward towards the front of seat bottom 22A', allowing a bather to submerge more of their body into the water.

Figure 16:
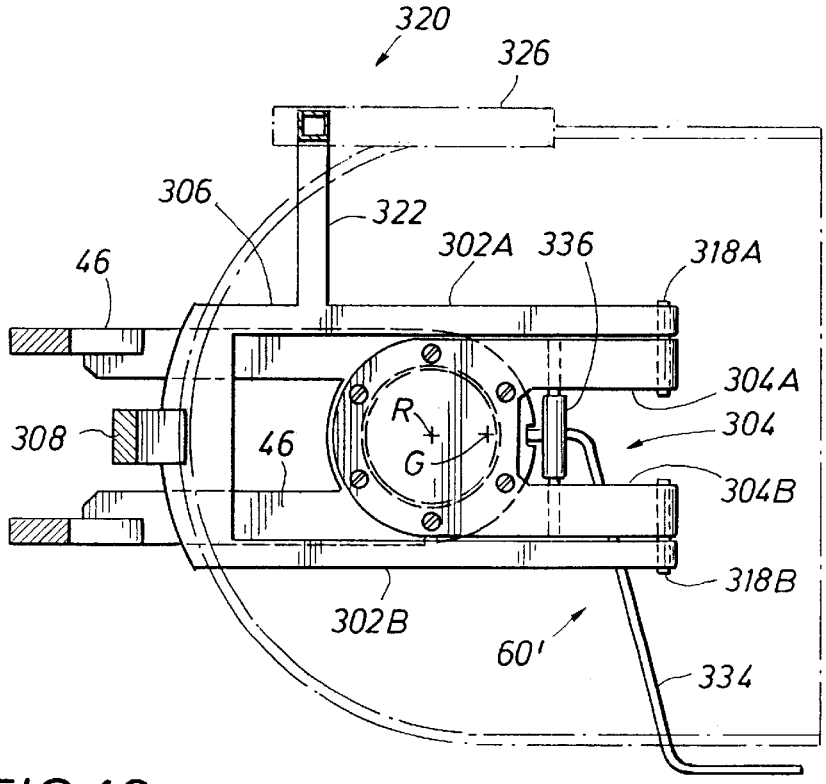
FIG. 16 is a view of the preferred retrofit embodiment taken along line 16—16 of FIG. 14 to better show the rotation assembly and locking pin.
Figure 18:
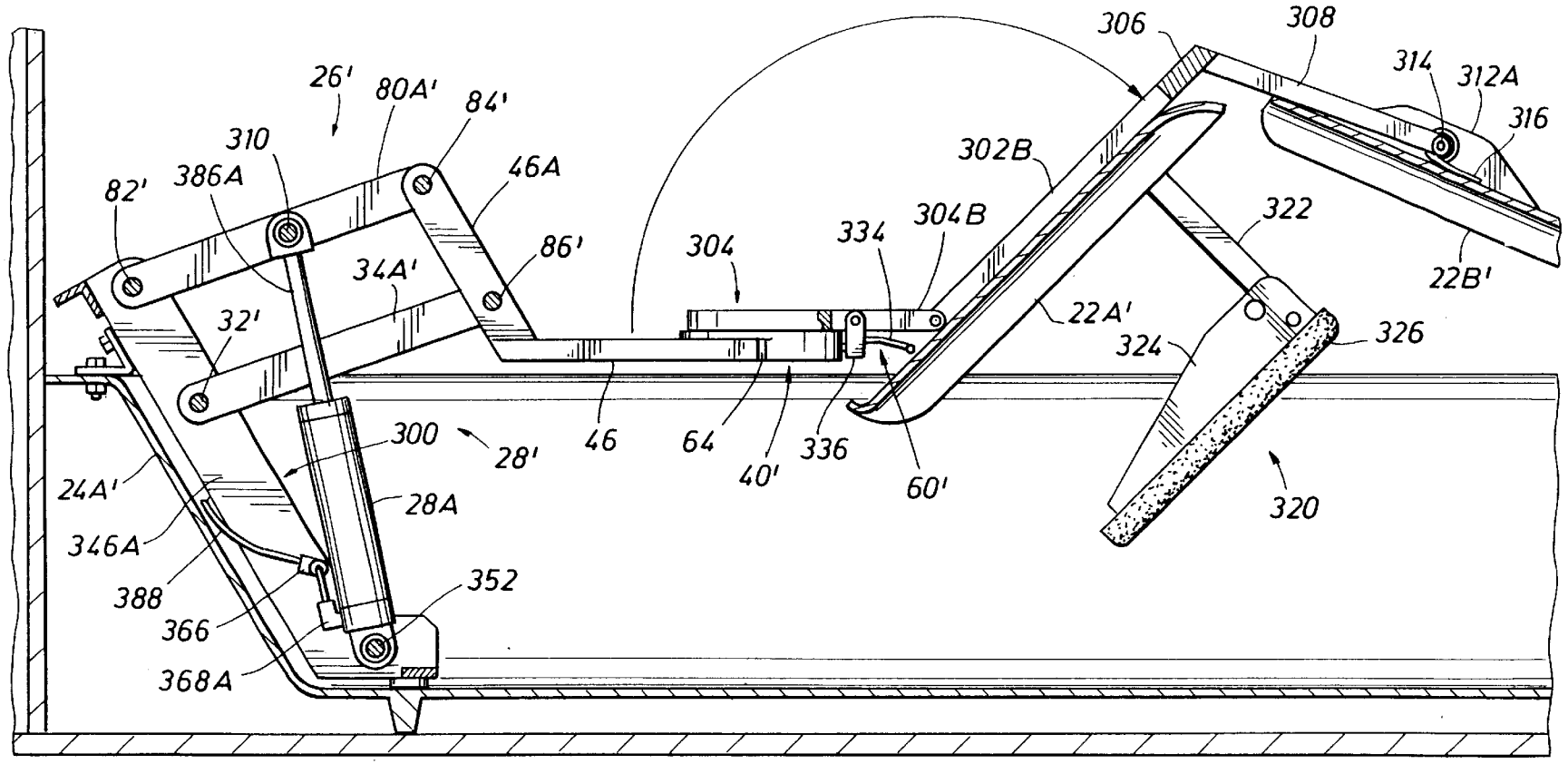
FIG. 18 is a view of the preferred straight up retrofit embodiment similar to FIG. 17, but with the seat pivoted forward about the seat hinge from an operating position to an access position.

Seat base 306, as best shown in FIGS. 16–18, is pivotally connected to seat anchor plate 304 via pivot pins 318A and 318B, which in turn, is rotatably connected to seat bracket 46 (46") via rotation assembly 40'. The seat base 306 is formed in a "U" shape with seat base arms 302A and 302B pointing towards the front of bath 20'. At the ends of the seat base arms 302A and 302B are holes through which pivot pins 318A and 318B are located. Seat base 306 and seat 22', as shown in FIG. 17, are in the operating position for holding a bather. As shown, seat base 306 is substantially parallel to the bottom of the bath 20'. When the seat 22' is in the access position for cleaning, as shown in FIG. 18, seat base 306 is rotated about pivot pins 318A and 318B exposing the mechanisms located beneath seat 22A', as shown in FIG. 19.

Arm rest 320, as shown in FIGS. 13, 14, 16–19 and 37, is made up of an arm rest bracket 322, an arm rest arm 324, and an arm rest cushion 326. As shown in FIGS. 16 and 19, the arm rest bracket 322 is formed in an "L" shape and is connected to seat base 302 underneath seat bottom 22A'. The arm rest bracket 322 extends around and above seat bottom 22A'. Connected at or near the top of arm rest bracket 322 is arm rest arm 324 which extends perpendicular to arm rest bracket 322 and substantially parallel with seat bottom 22A'.

In FIGS. 38 and 39, arm rest 320' has features not shown in the other Figures. Arm rest arm 324' and arm rest bracket 322' are shown where the arm rest arm 324' is able to extend outward along its length away from seat back 22B'. The arm rest bracket 322' is different in that it includes a backwards "7" shape. This shape allows for a longer arm cushion 326' so that telescoping arm rest arm 324' can extend further out. Arm rest arm 324' is shown attached to angled arm rest bracket 322'. Arm rest arm 324' is shown having the additional components of an outer member 446 with tracks 452A and 452B, an inner member 448, and the telescope pins 450A and 450B. Telescope pins 450A and 450B are attached to the outer sides of inner member 448 and located in a position so that the pins extend through tracks 452A and 452B of outer member 446 allowing outer member 446 to slide about inner member 448, but not allowing the outer member 446 to slide so far as to extend beyond the length of inner member 448. The retraction of outer member 446 to its retracted position, as shown in bold in FIG. 38, is blocked when either telescope pins 450A and 450B contact the end of tracks 452A and 452B near seat back 22B', or when outer member 446 contacts the portion of arm rest bracket 322' that attaches to arm rest arm 324'.

Seat anchor plate 304, best shown in FIG. 16, like seat base 306 also has holes in the ends of its arms 304A and 304B and which the same pivot pins 318A and 318B are located there through. As such, the pivot pins 318A and 318B connect the seat base 306 to the seat anchor plate 304 such that when the seat is in its operating position, as shown in FIG. 17, the seat base arms 302A and 302B, as best seen in FIG. 16, are parallel to, and positioned outside and adjacent to the seat anchor plate arms 304A and 304B. Further, the pivot pins 318A and 318B allow the seat to move from the position, shown in FIG. 17, to the access position, shown in FIG. 18, which allows a user to have open access to the components underneath the seat 22' as well as access to the bottom of the seat 22' and the components attached thereto, as best shown in FIG. 19. Therefore, seat anchor plate 304 is indirectly connected to seat 22'.

Seat rotation assembly, generally indicated at 40', and as best shown in FIG. 19, is located under seat anchor plate 304. As best shown in FIGS. 20 and 21, seat base 306 is attached to rotor 48' of rotation assembly 40' by means of stainless steel bolts 56'. Rotor 48' rotates about post 50' within housing 44' of rotation assembly 40' and is secured about post 50' via the upper lip 331 of post 50'. Post 50' is secured to seat bracket 46 within the center of housing 44' via bolts 328. Rotor 48' rotates within housing 44' contacting lower bearings 52', upper bearings 332, as well as seals (o-rings) 58' and 330. Lower bearings 52' are maintained at a constant distance from one another by spacer ring 335. Similarly, upper bearings 332 are maintained at a constant distance from one another by spacer ring 333. Both spacer rings 333 and 335 are of a flat ring design. Housing 44' is preferably integral with cantilevered seat bracket 46, which is in turn attached to guiding assembly 26' (26").

Locking pin, generally indicated at 60', and as best shown in FIGS. 17–21, along with pin holes/notches 62' and 64' in rotation assembly 40', are used to lock seat 22' into two predetermined positions. Locking pin 60' has a pin arm 334, engagement pin 338, rotation block 336 and pivot pin 340. As best shown in FIG. 19, pivot pin 340 extends between seat anchor plate arms 304A and 304B and through rotation block 336 located between the two arms. Pin arm 334 is attached to the forward portion of rotation block 336 while the engagement pin 338 is attached to the back portion. As shown in FIGS. 17 and 19, pin arm 334 extends to the side of the seat bottom 22A' near bath wall 24D'. Pin arm 334 overbalances locking pin 60' such that engagement pin 338 is urged into contact with the cylindrical exterior 40A' of rotation assembly 40'. Therefore, without the application of an outside force, the engagement pin 338 will engage pin holes/notches 62' or 64' as seat rotation assembly 40' is rotated, and once engaged with the appropriate pin hole/notch 62' or 64', engagement pin 338 will remain engaged until an outside force is applied to disengage the engagement pin 338.

Guiding assembly 26', of the preferred straight up retrofit embodiment, is similar to the guiding assembly 26 of alternative composite embodiment A. However, where the alternative composite embodiment A discusses applying a torque about rotatable member 32 resulting in the lifting of seat 22, the preferred straight up retrofit embodiment uses actuators 28A and 28B attached between the second set of arms 80A' and 80B' and the frame 300. Further, and as best shown in FIGS. 13–15, 17–18 and 27–29, upper arms 80A' and 80B' and lower arms 34A' and 34B' may be attached to the frame 300, or to the back wall of the bath 24A', (i.e. for composite embodiments not using a frame), and/or such attachments may be so spaced, such that when seat 22' is in its raised position the upper and lower arms 80A', 80B', 34A' and 34B' are substantially closer to horizontal than when seat 22' is in its lowered position, and as a result, seat 22' is positioned further away from back bath wall 24A', and closer to the middle of the length of the bath 20' when the seat is in its raised position than when it is in its lowered position. An advantage of this operation is that in the lowered position the bather, along with seat 22', is positioned at or near the back of the bath 20' allowing for maximum leg room, and when in the raised position the bather, along with seat 22', is further from the back bath wall 24A' and closer to the middle of the bath 20' allowing for ingress and egress to the seat at a location less likely obstructed by bathroom fixtures such as sinks, cabinets, toilets or the like.

Figure 36:
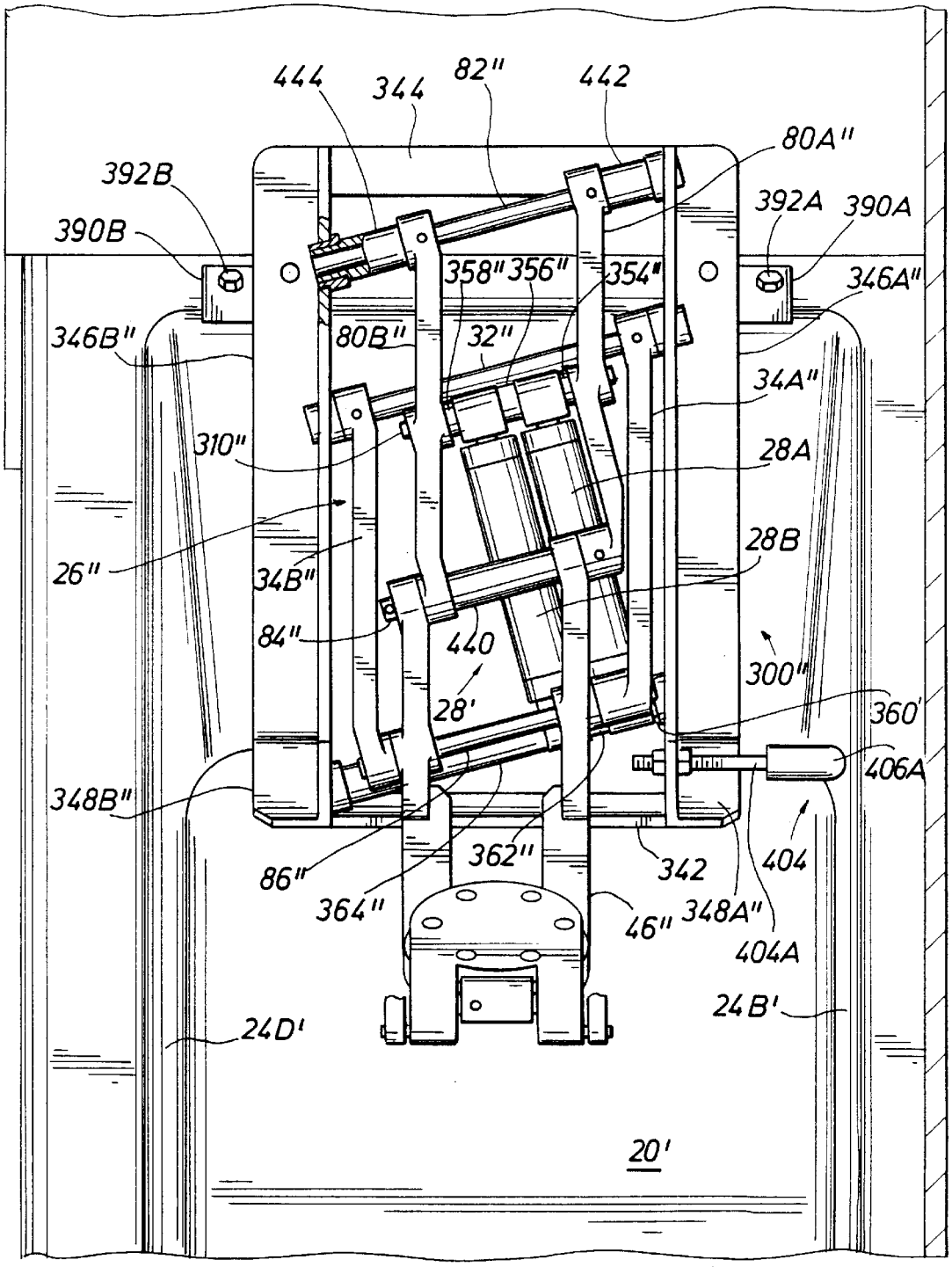
FIG. 36 is a perspective view of the preferred laterally offset retrofit embodiment looking down and towards the back of the bath, with the seat removed.

Also, like the alternative composite embodiment A, as shown in FIGS. 36–38, the preferred laterally offset retrofit embodiment may have its first and second set of arms, 34A", 34B", 80A" and 80B", mounted at an angle Ø with respect to the bath bottom 24E', such that the guiding assembly 26" guides seat 22' from a lowered position, at or near the longitudinal center of the bath, to a raised position, where seat 22' is laterally offset near side wall 24D'. As shown in FIG. 37, angle Ø is 15°, which allows seat 22', in the raised position, to be within four inches or less of the edge of the bath and provides a significant increase in convenience for getting in and out of bath 20'. It is contemplated that the adjacent bathroom wall may be located on the opposite side of the bath, (i.e., faucet and drain at other end of bath), and angle Ø reversed to allow seat 22' to travel towards the entry side of bath 20', as seat 22' moves from the lowered position to the raised position. With the guiding mechanism mounted at an angle on the preferred laterally offset retrofit embodiment the components of the bath lifting system may require slight modifications, for example: guiding assembly arms 34A", 34B", 80A" and 80B", may be modified to accommodate angled rods 32", 82", 84", 86", 310" and 352"; frame 300" may be modified such that side members 346A" and 346B" and extension bottom members 348A" and 348B" can accommodate the angled rods 32", 82" and 352"; seat bracket 46" may be modified accordingly; and spacers 354", 356", 358", 364", 362" and 360" may be modified to be longer or shorter, or eliminated altogether (see FIG. 37 where spacer 360', otherwise visible about lower lifting rod 352 in FIG. 19, has been eliminated as the connection to frame side 346A" provides the stability otherwise required by spacer 360'), to accommodate the new location of lifting actuators 28A and 28B. In addition, other parts and components may be added to accommodate the angled position of the guiding assembly 26" including: one or more stabilizer assembly 404 components for added stability as well as additional spacers 440, 442 and 444, as shown in FIGS. 36 and 37, for stabilizing guiding assembly 26" about rods 82" and 84". Yet other parts and components may be modified or added to accommodate the angular positioning of guiding assembly 26" without diverging from the spirit of the invention.

Further, and like the same angled mounting of guiding assembly 26 of the alternative composite embodiment A, when the guiding system 26" is mounted at an angle in the preferred laterally offset retrofit embodiment, any rearward extension of the top of seat back 22B' can be made longer. This is because when rotated to an angle approaching 90° to that of seat 22''s orientation when it is in its lowered position, seat back 22B' is farther from side wall 24B', and any room wall adjacent thereto, and thus may extend further rearward without contacting the surface of any such adjacent room wall. Such an angled mounting, i.e., preferred laterally offset retrofit embodiment, not only provides an advantage of easier ingress and egress to seat 22', but also allows a longer rearward extension of seat back 22B' which, when seat 22' is in its lowered position, provides greater coverage over the guiding assembly 26" and lifting device 28', thus reducing the visibility to such mechanical items.

In the preferred retrofit embodiments, lifting device, generally indicated at 28', and as best shown in FIGS. 15, 19 and 36, is a pair of high pressure hydraulic actuators mounted between the frame 300 (300") and the guiding assembly 26' (26"). Spanning between the approximate center of the upper rod arms 80A' (80A") and 80B' (80B") of the guiding assembly is upper lifting rod 310 (310"). Attached between the two bottom members 348A (348") and 348B (348B") of frame 300 (300") is lower lifting rod 352 (352"). Connected between lower lifting rod 352 and upper lifting rod 310 are the two lifting actuators 28A and 28B. In the preferred straight up retrofit embodiment these lifting actuators 28A and 28B are held in position along the length of lifting rods 352 and 310 by cylindrical spacers. Spacers 354, 356 and 358 are located about upper lifting rod 310 where spacer 354 and 358 are of approximate equal length and located between upper arms 80A' and 80B' and lifting actuators 28A and 28B, and spacer 356 is located between the two lifting actuators. Spacers 360, 362 and 364 are located about lower lifting rod 352 where spacer 360 and 364 are of approximate equal length and are located between bottom members 348A and 348B and lifting actuators 28A and 28B, and spacer 362 is located between the two lifting actuators. In the preferred retrofit embodiments, as shown best in FIGS. 15 and 19, high pressure pipe 388 communicates hydraulic pressure is provided to the two lifting actuators 28A and 28B. High pressure pipe 388 is diverted into two control pipe paths 388A and 388B at "T" connector 366. As best shown in FIGS. 15 and 17, control pipe paths 388A and 388B are connected through lifting actuator inlets 368A and 368B (not shown) into the lifting actuators 28A and 28B. Other embodiments may use a different number of actuators. Also, other embodiments may use a larger or smaller number of spacers.

Lifting power system 30' is best shown in FIGS. 13 and 25. In the preferred retrofit embodiments, the lifting power system 30' has the following three components: a fluid control system, generally indicated at 94', a drive system, generally indicated at 96', and a hydraulic pressure multiplier system, generally indicated at 432. The fluid control system 94' controls the in-flow and the out-flow of fluid, such as liquid, into the drive system 96' and, therefore, controls the lifting and raising of the seat 22'. The drive system 96' transforms the relatively low fluid pressure into a mechanical linear force. The hydraulic pressure multiplier system 432 transforms the mechanical linear force into a relatively higher fluid pressure and directs the higher hydraulic pressure into high pressure pipe 388. In the preferred retrofit embodiments, the lifting power system 30' is located out of view, behind a bathroom wall adjacent the bath 20'. Other embodiments may place the lifting power system above the bathroom ceiling, or, if necessary, even expose such a system in the bathroom itself. Other alternative embodiments may use other forms of lifting power systems that provide pressurized fluid through high pressure pipe 388, for example, an electric pump. It is also contemplated that the lifting power system 30' may be used in conjunction with a constant pressure pump for the purpose of providing adequate pressure for those instances where the low fluid pressure is below the minimum pressure required for its operation. For example, it is contemplated that the lifting power system requires 40 PSI to function normally, if the water pressure available is below such PSI, a constant pressure pump can be used to provide adequate pressure for the normal operation of lifting power system 30'.

As best shown in FIGS. 13 and 25, the fluid control system 94' of the preferred retrofit embodiments, is made up of the following components: a feeder pipe 100', a control valve 102', a discharge pipe 104', a control knob 106', a needle valve 180' (FIG. 25), a needle valve adjustment mechanism 182' (FIG. 25), and a high pressure pipe 388 between needle valve 180' and lifting actuator inlets 368A and 368B. In the preferred retrofit embodiments, the fluid in the fluid control system 94' contains water under standard tap water pressure. Further, it is noted that standard water pressure is typically between 40 and 70 PSI. However, it is contemplated that the fluid could be pressurized by other means, such as a pump. Other alternative embodiments may use other forms of fluid control systems that control the flow of fluid into and out of fluid control system 94' or the drive system 96'. Also, it is contemplated that other embodiments may use a fluid control system 94' that contain other fluids other than water, such as gas.

As shown in FIG. 13, control valve 102' controls the flow of fluid between feeder pipe 100' and high pressure pipe 388. Control knob 106' operates control valve 102' to allow fluid to enter into, and exit from, drive system 96' which, in turn, raises and lowers seat 22'. Control pipe 108' communicates fluid into and out of drive system 96'. Discharge pipe 104' empties fluid from drive system 96' into bath overflow drain 370 by moving the control knob 106' so the control valve 102' is in the discharge position.

As best shown in FIGS. 13 and 25, the drive system 96' of the preferred retrofit embodiments comprises a primary chamber housing 111', a primary chamber 112', a connecting piston rod 114', a primary piston head 116', and primary piston head directional seals 124' and 372. Primary chamber housing 111' defines primary chamber 112'. Both primary chamber 112' and primary piston head 116' are approximately 6 inches in diameter. The primary chamber 112' is dynamically divided between the rod side and the non-rod side. The non-rod side of primary chamber 112' contains varying volumes of liquid and is in fluid communication with control pipe 108'. The rod side of the primary chamber 112' contains a varying amount of gas, under a varying amount of pressure. As, primary chamber 112' is filled and emptied of fluid from and to the fluid control system 94', primary piston head 116' travels within primary chamber 112'. Primary piston head 116' and primary piston head directional seal 372 provide a seal such that the liquid cannot pass into the gas filled portion of primary chamber 112'. Initially, the rod side of primary chamber 112' contains a gas pressurized to 10 PSI, as measured by gauge 374. This 10 PSI of pressure provides enough force to overcome overall system frictional forces, and other inherent forces, to urge primary piston head 116' towards the non-rod side of the primary chamber 112', allowing seat 22' to be lowered into the bath. The gas filled portion of primary chamber 112' is in fluid communication with valve 385. Valve 385 is similar to an inner tube valve. Using valve 385, air can be pumped into, or let out of the gas filled portion of primary chamber 112'. Thus, the valve 385 can be used to raise or lower the pressure in the chamber 112' to its recommended at rest pressure of 10 PSI. An overpressure condition might occur, where the valve 385 may need to be used to remove some of the gas, where there is an over pumping condition or where the cause is related to heat influence. Primary piston head 116' and primary piston head directional seal 124' provide a seal such that the gas cannot pass into the liquid filled portion of primary chamber 112'. Shared piston rod 114' is connected to primary piston head 116' and moves linearly with the movement of primary piston head 116'. In the preferred straight up retrofit embodiment, as best shown in FIG. 13, the maximum travel distance C of primary piston head 116' is less than the entire length of primary chamber housing 111', and in the preferred straight up retrofit embodiment, is 12 inches. At distance C it is contemplated that the amount of fluid to fill primary chamber 112' is approximately 6 quarts. This design maintains a minimum amount of pressurized gas defined by the volume represented by C'. Other alternative embodiments are contemplated that may use other forms of drive systems to transform fluid pressure into mechanical energy.

Returning to FIG. 25, the hydraulic pressure multiplier system 432 of the preferred retrofit embodiments comprise a secondary chamber housing 376, a secondary chamber 378, shared piston rod 114', a secondary piston head 380, and secondary piston head directional seals 382 and 384. Secondary chamber housing 376 defines secondary chamber 378. Both secondary chamber 378 and secondary piston head 380 are approximately 1.5 inches in diameter. The secondary chamber 378 is dynamically divided between the rod side and the non-rod side. The non-rod side of secondary chamber 378 contains varying volumes of liquid. The rod side of the secondary chamber 378 is in fluid connection with the rod side of primary chamber 112', and as such, contains the same varying amounts of gas pressure as in the primary chamber 112'. Secondary piston head 380 and secondary piston head directional seal 384 provide a seal such that the liquid cannot pass into the gas filled portion of secondary chamber 378. Secondary piston head 380 and secondary piston head directional seal 382 provide a seal such that the gas cannot pass into the liquid filled portion of secondary chamber 378. Shared piston rod 114' is connected to secondary piston head 380 and moves linearly with the movement of secondary piston head 380, and in the preferred retrofit embodiments, is 12 inches. In the preferred retrofit embodiments, as best shown in FIG. 13, the maximum travel distance D of secondary piston head 380 is the same maximum travel distance C of primary piston head 116'. The design of the hydraulic pressure multiplier system 432 described immediately above, could be modified by reducing its dimensions, i.e., by reducing the diameter of the primary chamber 112', and reducing the amount of water needed to operate the system. It is contemplated that such a design would be more expensive, but as designed above, and explained below in greater detail, the lifting force "L" at the zero extension "E" is the smallest, but has enough lift to raise a heavy person. And even after a short lifting distance, i.e., where "E" is approximately 2 inches, the force "L" is almost 75% larger than is necessary, and therefore represents a wasted use of tap water. A reduced diameter primary chamber 112' could reduce the above design's use of 6 gallons of water to a lesser amount of 4 gallons. Other alternative embodiments are contemplated that may use other forms of drive systems to transform a lower fluid pressure into a higher fluid pressure.

The preferred lifting power system 30", in FIGS. 40–43 uses two of the same components as the lifting power system 30': the fluid control system 94', as shown in FIG. 13, and the hydraulic pressure multiplier system 432, as shown in FIGS. 13 and 25. However, a third component, preferred drive system 96" is used in place of drive system 96'. Like the drive system 96', shown in FIGS. 13 and 25, the preferred drive system 96" transforms the relatively low fluid pressure into a mechanical linear force. However, unlike drive system 96', preferred drive system 96" uses a smaller diameter primary piston head 116" in conjunction with a larger surrounding cylinder bushing 454.

Figure 40:
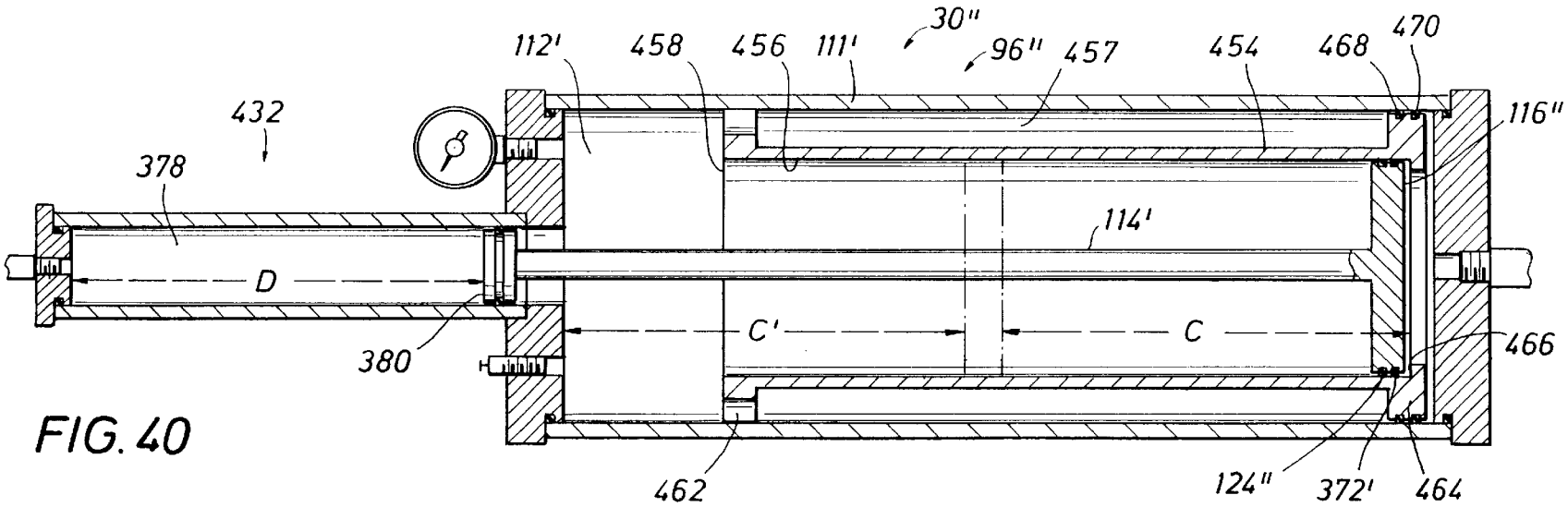
FIG. 40 is a side elevational view of a preferred lifting power system for the retrofit embodiment including an additional primary cylinder bushing shown in a fully retracted position.
Figure 41:
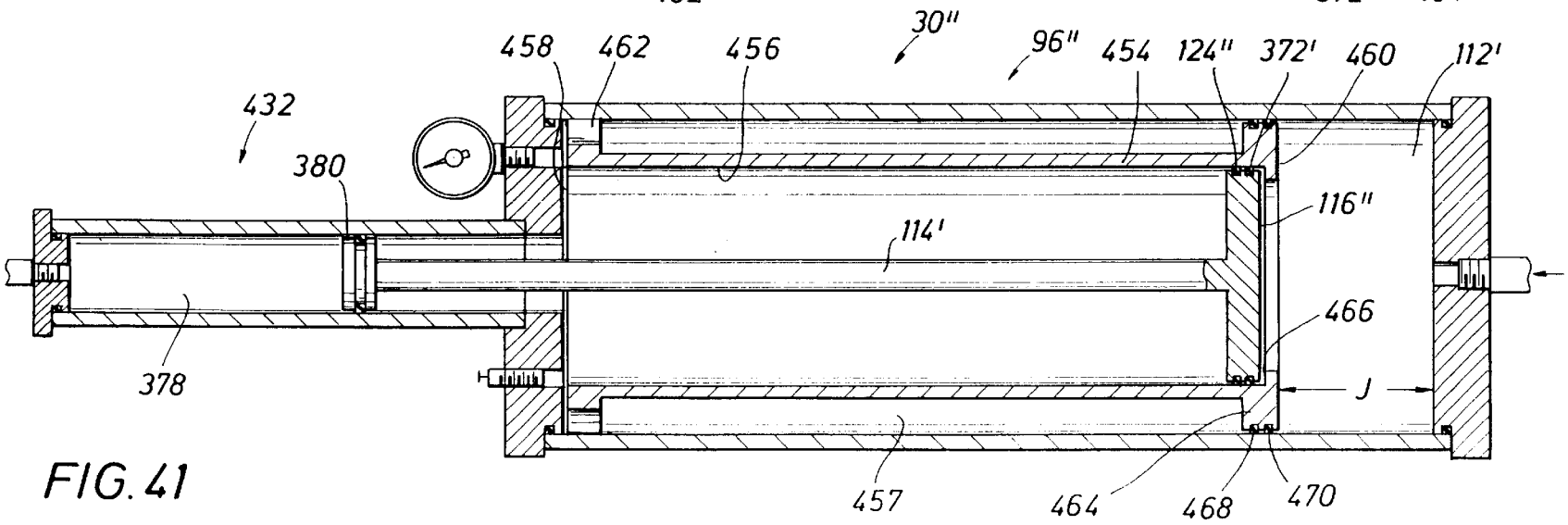
FIG. 41 is the lifting power system of FIG. 40 with the primary cylinder bushing shown in its fully extended position.

Specifically, primary piston head 116" has a diameter of four inches. This smaller diameter allows it to fit within the inner walls 456 of primary cylinder bushing 454. Cylinder bushing 454 includes a cylinder bushing end 458, a cylinder bushing end 460, a plurality of spacer extensions 462, outer head extensions 464, and an inner head extension lip 466. As shown in FIGS. 40–42, primary cylinder bushing 454 contacts primary chamber housing 111' with its spacer extensions 462 near its end 458, and contacts primary chamber housing 111' with its outer head extensions 464 at its other end 460. The intermittent radial spaced placement of these spacer extensions 462 allow for the fluid communication of the gas between the bushing void 457 and the primary chamber 112'. The outer head extensions 464 further include cylinder bushing directional seals 468 and 470. Cylinder bushing directional seal 470 provides a seal such that the liquid cannot pass into the gas filled portion of primary chamber 112'. Cylinder bushing directional seal 468 provides a seal such that the gas cannot pass into the liquid filled portion of primary chamber 112'.

Fully retracted, the end 460 of primary cylinder bushing 454 is at or near the right of primary chamber 112', as viewed and best shown in FIG. 40. When fully extended, the end 458 of primary cylinder bushing 454 is at or near the left of primary chamber 112' and the end 460 of primary cylinder bushing 454 is at a distance "J" in the primary chamber 112', as best shown in FIGS. 41 and 42. When the primary piston head 116" is in its fully extended position, as shown in FIG. 42, the primary piston head 116" is positioned along the inside wall 456 of primary cylinder bushing 454 at a distance "C" in the primary chamber 112'.

Primary piston head 116" has two seals 124" and 372' that perform similarly to seals 124' and 372, respectively, of primary piston head 116'. However, unlike primary piston head 116', piston head 116" travels within the inside wall 456 of primary cylinder bushing 454 for distance "J," a sub-length of distance "C." The primary cylinder bushing 454 travels as one with primary piston head 116" such that the two seals 124" and 372' remain in static contact with inside wall 456. As such, these seals experience less wear and tear than their 124' and 372 counterparts, which experience sliding contact for the entire distance "C" along primary chamber housing 111'.

Further, and unlike the embodiment depicted in FIGS. 13 and 25, the embodiment shown in FIGS. 40–43 uses a primary cylinder bushing 454 which reduces the volume of liquid necessary to fully retract primary piston head 116" from 6 quarts to 4 quarts. Thus, less water is required to move the seat 22 from its lowered position to its extended position. Also, unlike the embodiment depicted in FIGS. 13 and 25, where a force "L" at a distance "E" of two inches, is of a force that is almost 75% larger than necessary (i.e., 1312.5 lbs=1.75*750 lbs), the embodiment of FIGS. 40–42 results in the reduction of the force "L" at a distance "E" of about two inches to an amount of approximately 850 lbs.

Use and Operation of Preferred Retrofit Embodiments

A typical bather, being wheelchair assisted, would typically leave the bath system with seat 22' in its lowered position, as shown in FIG. 13. To transfer to the bath 20', bather wheels his or her chair along side of bath 20'. The operator of the bath system then uses control knob 106' to initiate the flow of water from feeder pipe 100' through control pipe 108' into primary chamber 112'. As water fills chamber 112', the water pressure forces piston head 116' along primary chamber 112' towards the rod-end of primary cylinder 112'.

When using the drive system 96' as shown in FIGS. 13 and 25, as primary piston head 116' travels along primary chamber 112', piston rod 114' pushes secondary piston head 380 in secondary chamber 378. Since the area of the primary piston head 116' is greater than the surface area of secondary piston head 380, any PSI applied to the primary piston head 116' will result in a larger applied PSI from secondary piston head 380, see FIG. 22. This PSI multiplying mechanism is an effective way of increasing PSI levels such that small high pressure piston mechanisms, such as high pressure lifting actuators 28A and 28B, can be disposed entirely in the frame of the retrofit embodiment behind seat 22'. The movement of primary piston head 116' towards the rod-end portion of primary cylinder 112' causes shared piston rod 114' to move in the same direction along with secondary piston head 380, which for secondary piston head 380, is away from the rod-end portion of secondary cylinder 378. It should be noted that as primary piston head 116' moves in the rod-end direction, the pressurized gas becomes further pressurized until the maximum movement C (FIG. 13) is achieved. It is contemplated that the minimum and maximum pressure of such gas is approximately 10 PSI and 30 PSI, respectively, however, this build-up of pressure is essentially inconsequential while seat 22' is occupied with a bather, as the force supplied by such gas pressure is small in comparison to the additional pressure introduced by the weight of the bather on seat 22'. With the movement the primary piston head 116', toward the rod-end portion of primary cylinder 112', secondary piston head 380 forces water through high pressure pipe 388. As shown in FIGS. 14, 15 and 17, the pressurized fluid travels down high pressure pipe 388 and into the lifting actuators 28A and 28B. Being under high pressure, a relatively smaller volume of liquid is necessary to effectuate the lifting force required to lift a bather. As the fluid fills the two actuators 28A and 28B, their respective lifting piston rods 386A and 386B (FIG. 19) expand outwardly, spacing apart upper lifting rod 310 (310") and lower lifting rod 352 (352") (FIG. 17) resulting in the upward movement of guiding mechanism 26' and, therefore, seat 22' from a location near the back and at the bottom of bath 20', to a location away from the location near the back and slightly above the top of the bath 20'.

However, when using the drive system 96", as shown in FIGS. 40–42, where both primary piston head 116" and a primary cylinder bushing 454 are used, a slightly different operation occurs. Here, from an initial position where both primary piston head 116" and primary cylinder bushing 454 are positioned at the right of primary chamber 112', as viewed and shown in FIG. 40, primary piston head 116" travels in unison with primary cylinder bushing 454 until a distance "J" is achieved, as shown in FIG. 41. At this point the bottom of cylinder bushing 454 contacts the left of primary chamber 112' blocking further leftward movement. Although the cylinder bushing 454 is blocked, piston head 116" continues to move. Piston head 116" then begins to move relative to cylinder bushing 454, and in so doing, is guided by the walls 456 of cylinder bushing 454.

Here, like the embodiment in FIGS. 13 and 25, piston rod 114' moves with piston head 116", and pushes secondary piston head 380 in secondary chamber 378. Since the surface area of primary piston head 116" alone, much less the area of primary piston head 116" plus end 460 of primary cylinder bushing 454 together, are greater than the surface area of secondary piston head 380, any PSI applied to the primary piston head 116" will result in a larger applied PSI from secondary piston head 380. The resulting force differences achieved between the two embodiments, i.e., the embodiments depicted in FIGS. 13 and 25 as opposed to those depicted in FIGS. 40–43, is evident when comparing FIG. 24 with FIG. 43, respectively. In FIG. 43 a drastic drop is shown in the lifting force "L" when "E" is just short of two inches. Also, the forces are also shown to be different where after reaching "E" of two inches, the maximum "L" attained is less than 1000 lbs and reaches a further low at "E" equal to six inches. In contrast, in FIG. 24 the lifting force "L" continues to rise after reaching an "E" value of two inches until the maximum "L" reaches approximately 1420 lbs and never falls below a level of approximately 1100 lbs. In sum, the embodiment using drive system 96" uses less water than those embodiments using drive system 96' but maintains a force above the minimum required.

In its fully raised position, seat 22' is at or beyond the top of the side wall 24D' of bath 20', so that bather can transfer to seat 22'. Once above the side wall 24D' of bath 20', the seat can be rotated 90° so that locking pin 60' is engaged with pin hole/notch 64'. In the preferred laterally offset retrofit embodiment, this 90° rotation results in seat bottom 22A' extending over side wall 24D' as shown in phantom view in FIGS. 3 and 37, while in the preferred straight up retrofit embodiment, the 90° rotation leaves seat bottom 22A' short of extending over such side wall. As shown in FIG. 16, and as intended for use in both preferred laterally offset retrofit embodiments, seat 22' is attached to rotation assembly 40' such that seat 22''s center of gravity G is forward, and therefore eccentric, from the rotation axis R of rotation assembly 40'. This design has the front of seat 22A' following an arc that is otherwise further from the rotation axis R of rotation assembly 40' than designs that essentially place the center of gravity G of the seat 22' on top of the rotation axis R of rotation assembly 40'. As shown, the center of gravity G of seat 22' is 3 inches forward the rotation axis R of rotation assembly 40'. If the telescoping arm rest 320' is used (FIG. 38), the outer arm member 446, with attached arm cushion 326', could be pulled out to extend outer arm member 446 beyond the front of the seat. To transfer to seat 22', the bather, if capable, maneuvers his or her wheelchair such that they can slide themselves onto seat 22'. To do so, the bather could use the extended arm member 446 to assist the bather in getting on the seat 22'. Once on seat 22', the bather then can slide the arm cushion 326' and outer arm member 446 back to its retracted position. Then the bather disengages locking pin 60' from pin hole/notch 64' and rotates the seat while bringing their legs over side wall 24D' and into bath 20'. The bather then engages the locking pin 60' with pin hole/notch 62'.

As best shown in FIG. 13, and discussed above, once securely in seat 22', control knob 106' is operated to release the water from the primary chamber 112' allowing primary piston head 116' to move in the direction of the non-rod end portion of the primary cylinder 112', causing secondary piston head 380 to move in the direction of the rod end section of secondary chamber 378, and thus lower the bather into bath 20'. The discharged water from primary cylinder 112' travels through control pipe 108' and discharge pipe 104' into bath 20'. During this process, seat 22', guiding assembly 26', lifting device 28', and lifting power system 30', all reverse direction. During the lowering mode, the bather sitting on the seat 22' experiences a constant and smooth descent towards the bath bottom 24E'. Like the alternative composite embodiment A discussed above, the device can be used with a shower and seat 22' can be stopped at any position along its path.

To allow the bather to exit bath 20', the operator simply follows the steps described above to position the seat for transfer. The operator and bather can be different, or the same person. While exiting bath 20', seat 22' ascends smoothly along a path from the lowered position at or near the bath bottom 24E', to a raised position at or above the side of bath 20'. Once fully raised, the bather reverses his/her earlier movements to transfer back into the wheelchair. Once in the chair, the operator would use control knob 106' to return the seat 22' to its lowered position. To lower the unoccupied seat 22', the operator simply follows the steps described earlier for lowering the seat. However, with the absence of a bather from seat 22', the additional force generated by the pressurized gas behind primary piston head 116', assists the return of seat 22', guiding assembly 26' (26"), lifting device 28', and lifting power system 30' to their respective positions where seat 22' is in its fully lowered position.

Figure 22:
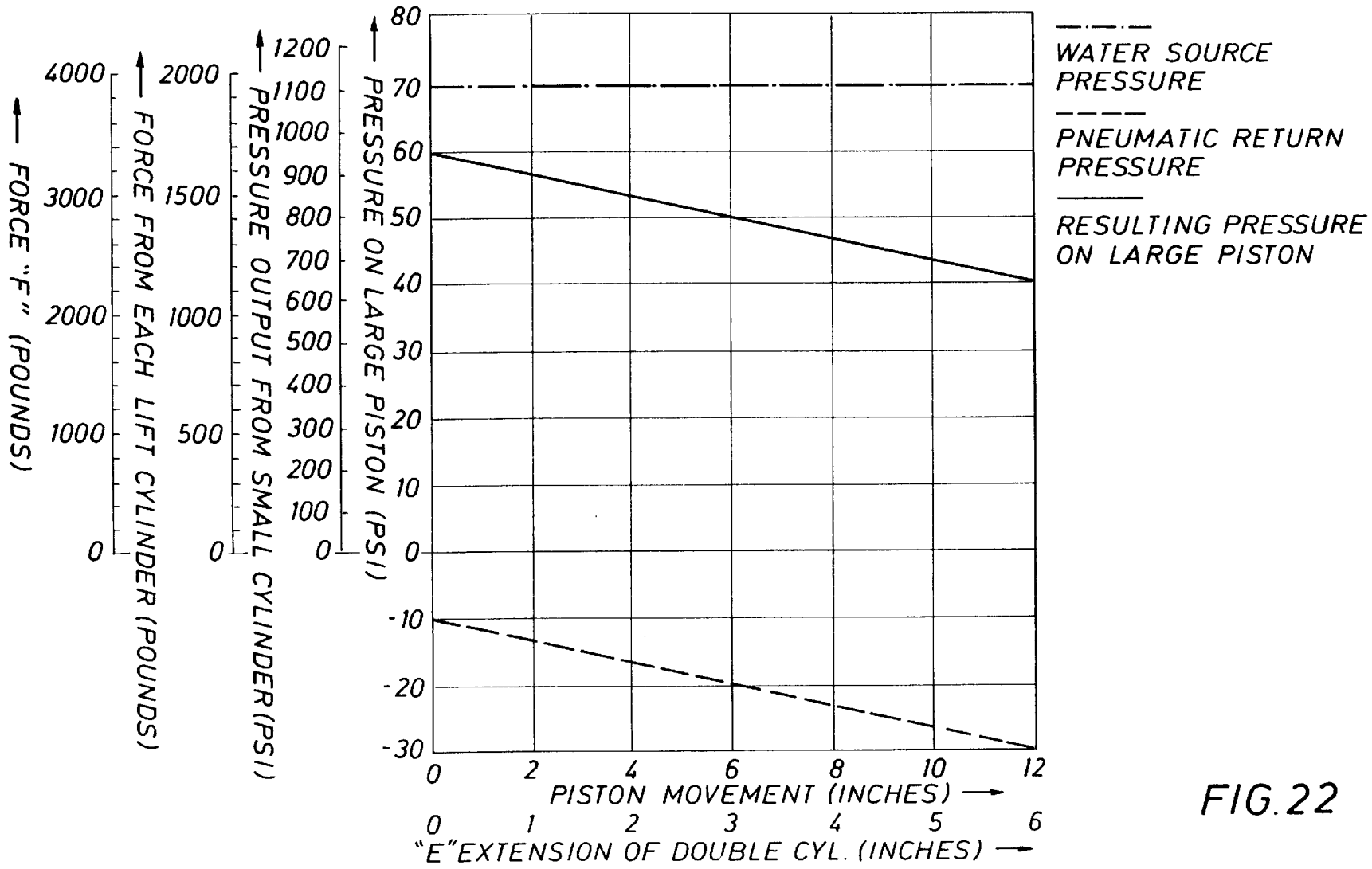
FIG. 22 is a chart for the preferred straight up retrofit embodiment showing a comparison of the pressures and forces generated throughout the system, including the force "F" generated by each of the dual lift cylinders of the lifting device as the seat is moved between the lowered and the raised position.
Figure 23:
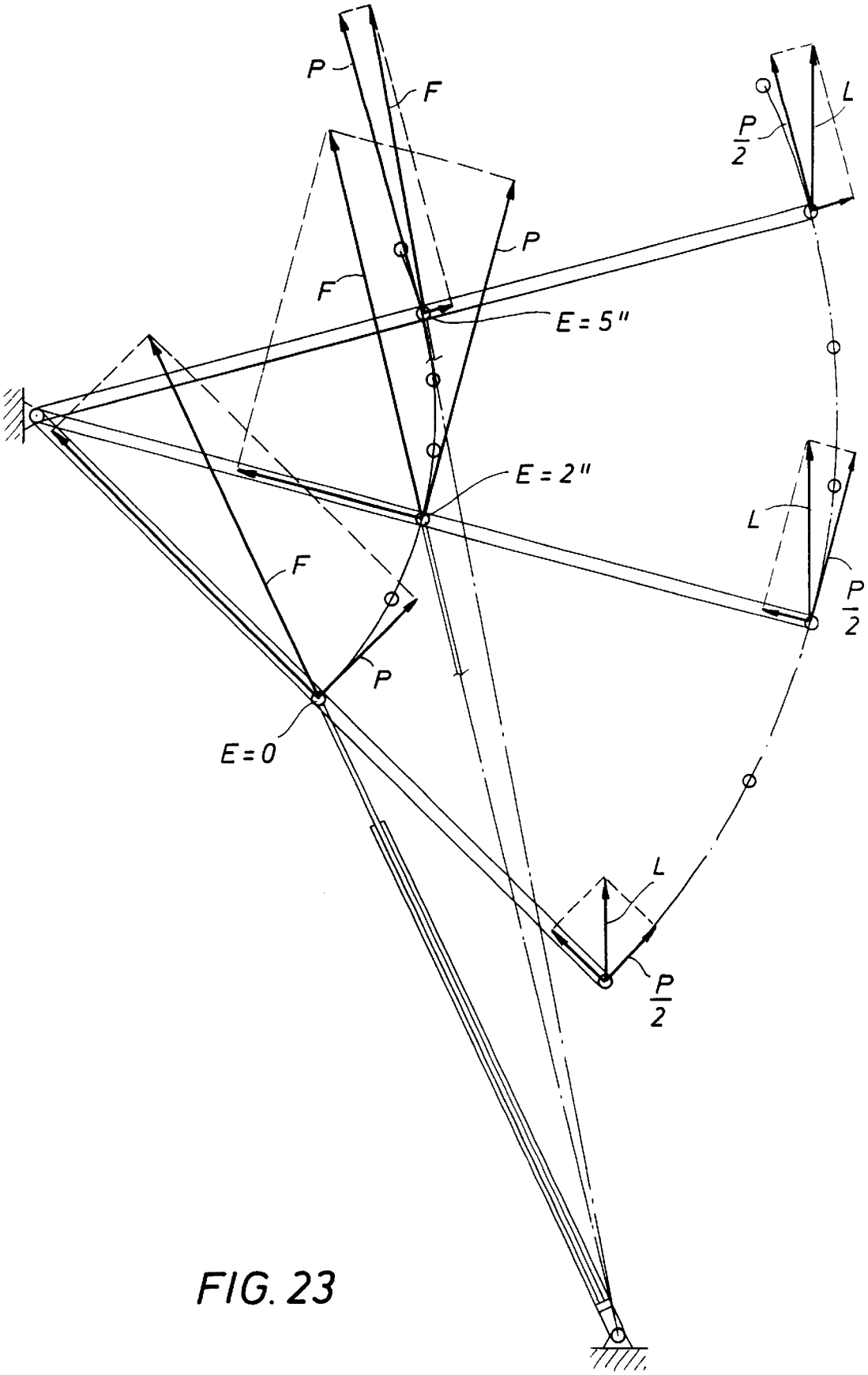
FIG. 23 is a diagram for the preferred straight up retrofit embodiment showing the vector forces generated at the guiding arm's middle connection point and the guiding arm's outer end as the seat is moved between the lowered position and the raised position.
Figure 24:
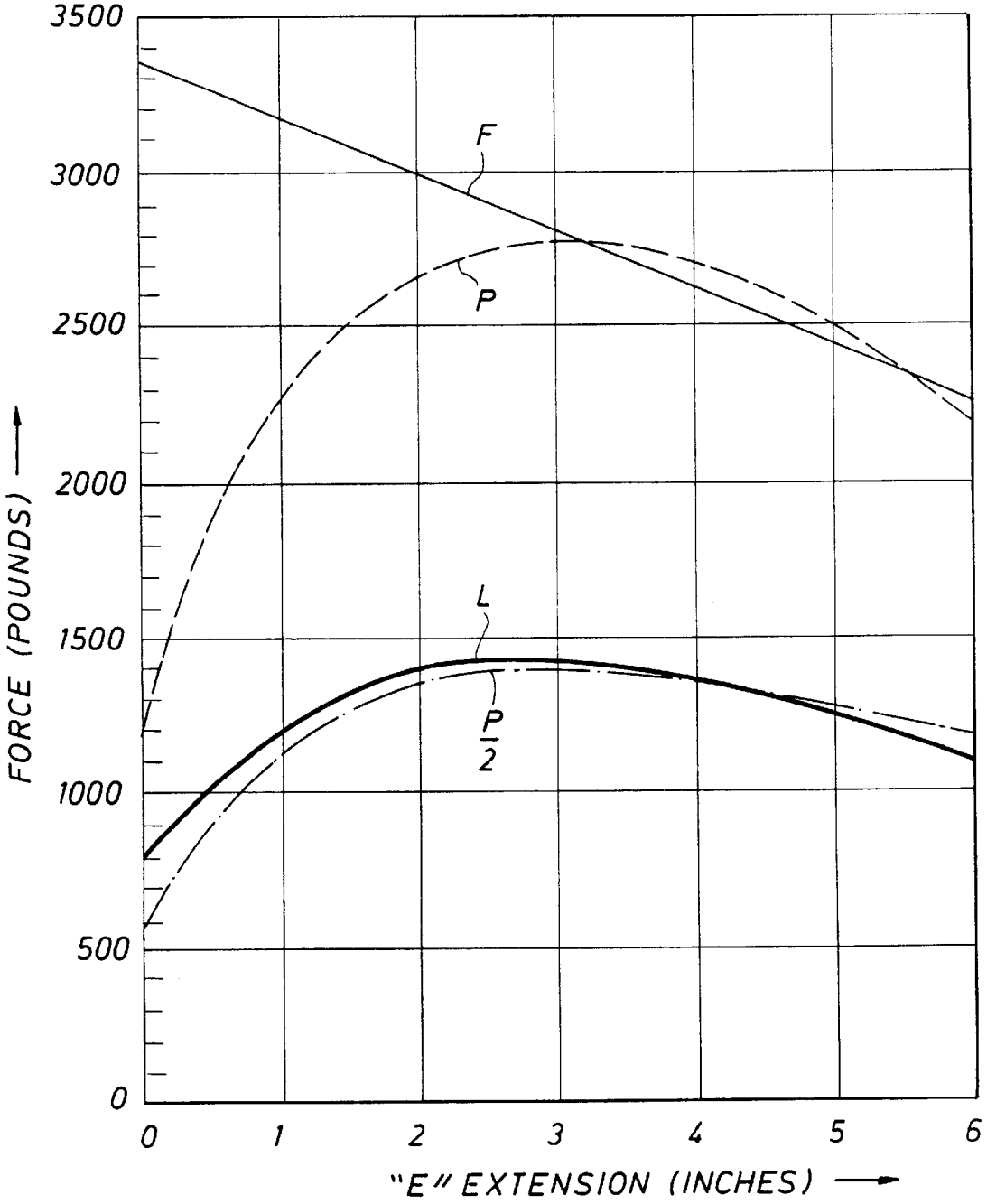
FIG. 24 is a chart for the preferred straight up retrofit embodiment showing the force "F" generated by the combined dual lift cylinders of the lifting device, and the forces "P" and "P/2" occurring at 90° angles to the guiding arms at the middle connection point and the outer end, respectfully, and the vertical force "L" occurring at the end of the guiding arm.

When using the drive system 96' as shown in FIGS. 13 and 25, the resulting forces and pressures acting throughout the preferred straight up retrofit embodiment are further disclosed in FIGS. 22–24. Specifically, FIG. 22 shows the pressures and forces generated with respect to the movement of the primary or large piston, secondary piston or small cylinder and lifting pistons or lift cylinder. Standard tap water source pressure is shown at about 70 PSI, although it is contemplated that the preferred straight up retrofit embodiment will work with as little pressure as 40 PSI. The resulting pressure on primary piston head 116' is the sum of the standard source water pressure on the non-rod side of primary chamber 112' less the gas pressure against the rod side of primary chamber 112'. The initial gas pressure is 10 PSI where the primary piston 116' is fully extended as show in FIG. 13, and the net pressure on piston head 116' is 60 PSI (70 PSI−10 PSI). When both the primary piston head and secondary piston heads have traveled the full 12 inches of C to the phantom view piston shown in FIG. 13, the gas pressure is at its maximum of 30 PSI. At this position the net pressure on piston head is 40 PSI (70 PSI−30 PSI). As the primary piston head 116' travels from its initial position to the position at distance C, the net pressure on primary piston 116' falls linearly with the distance traveled. Again, as shown in FIG. 22, the total net range in pressure on the primary piston ranges between 60 PSI and 40 PSI, and the corresponding resultant pressure on secondary piston head 380 ranges approximately between 950 PSI to 630 PSI respectively. Also, the resultant force over this same range from each of the two lifting actuators 28A and 28B is approximately 1650 PSI to 1100 PSI, while the resulting force F along lifting actuator rods 386A and 386B is from approximately 3200 lbs. to 2100 lbs.

However, when using the drive system 96" as shown in FIGS. 40–42, where both a primary piston head 116" and a primary cylinder bushing 454 are used, some of the resulting forces and pressures vary. In operation, as primary piston head 116" travels the distance "J," essentially the same resulting forces and pressures exist as in drive system 96'. For example, when comparing the charts in FIGS. 43 and 24, the graph of "L," with a vertical component of force and a horizontal component of extension, shows that from an "E" of 0 to an "E" of just short of 2 inches, both graphs are approximately the same. In contrast, as "E" approaches two inches, primary cylinder bushing 454 reaching its maximum extension "J," and at that time the effective surface area of the piston head is reduced from the area of piston head 116" plus the area of the end 460 of primary cylinder bushing 454 to an area of the alternative piston head 116" alone. This change in surface area results in the change in "L" reflected in FIG. 43 where beyond "E" equal to about 2 inches.

FIG. 23 shows drive system 96' and the net forces along lifting arms 80A and 80B as a result of the forces generated by lifting actuator rods 386A and 386B. Specifically, FIG. 23 shows how the force F, applied along lifting actuator rods 386A and 386B, acts upon lifting arms 80A' and 80B'. Where actuator rods 386A and 386B are extended a distance E=0 inches, the forces exerted on lifting rod 310 are directed both along lifting arms 80A' and 80B', and along the direction perpendicular, force P, to the lifting arms. Further, a resulting force P/2 is experienced at the seat ends of lifting arms 80A' and 80B' along with a corresponding lifting force L in the vertical direction. As the lifting actuator rods extend towards the 3 inch extension mark, the direction of the perpendicular force P/2 approaches that of the vertical lifting force, to a point where lifting arms 80A' and 80B' are completely horizontal, and force P/2 is equal to L. An additional graph is supplied in FIG. 24 that shows the change in values of the forces F, P, P/2 and L as the lifting rods 386A and 386B are extended through their operating reach of between 0 and 6 inches.

Alternative Straight Up Retrofit Embodiment D

Turning now to the alternative straight up retrofit embodiment D shown in FIGS. 26-27, the alternative straight up retrofit embodiment D utilizes similar component parts to the preferred straight up retrofit embodiment, including frame 300, seat 22', guiding assembly 26', lifting device 28', and lifting power system 30'. In addition, alternative straight up retrofit embodiment D includes stabilizer assembly 404 and frame extension 406 for added stability. This embodiment is particularly useful for installation into a bath constructed from such relatively weak materials as acrylic or other weak materials or designs requiring additional support or for such embodiments that use such less intrusive attachment means, for example, suction cups or the use of additional stabilizer arms.

Frame extension 406 extend along the bottom 24E' of the bath 20'. Frame extension 406 includes extension bottom members 408A and 408B, each fixedly attached to bottom members 348A and 348B respectively, and are attached with the respective fasteners 412A, 414A, 416A (not shown), 418A (not shown) and 412B, 414B, 416B and 418B. The far ends of extension bottom members 408A and 408B are connected by extension cross member 410. Below the corners of such far ends are two rubber feet 420A and 420B.

Stabilizer assembly 404 utilizes stabilizer arms 404A and 404B on opposite sides of frame 300 and are in contact with the side walls of the bath. This design impedes the horizontal shifting and the torquing movement otherwise present due to the loads placed on the seat, and specifically, to the loads placed on seat 22' when the seat is both laterally offset and rotated over the wall of the bath along with a bather. The stabilizer arms 404A and 404B include elastomer end cushions 406A and 406B, respectfully, to provide both a compressible material that would allow the stabilizer arms 404A and 404B to be tightened against the walls of the bath without causing damage, and a surface with a high coefficient of friction to prevent slippage during the application of a torquing force. The stabilizer arms 404A and 404B are connected to either, or both, the frame side members 346A and 346B and the extension bottom members 348A and 348B.

Use and Operation of Alternative Straight Up Retrofit Embodiment D

The operation of alternative embodiment C is similar to that of the preferred retrofit embodiments. However, forces present in the preferred straight up retrofit embodiment, otherwise distributed over the limited points of contact of back brackets 390A and 390B and bottom member rubber feet 350A and 350B, would, in alternative straight up retrofit embodiment D, be additionally distributed through stabilizer arms 404A and 404B, as well as frame extension 406. As such, alternative straight up retrofit embodiment D reduces the stress at any one contact point between itself and the bath, by spreading the total force among additional contact points.

Alternative Straight Up Retrofit Embodiment E

Turning now to the alternative straight up retrofit embodiment E shown in FIGS. 28–32, the alternative straight up retrofit embodiment E utilizes similar component parts to the preferred straight up retrofit embodiment, including frame 300, seat 22', guiding assembly 26', lifting device 28"", and lifting power system 30', but includes an alternative bellows member, generally indicated at 422.

Figure 28:
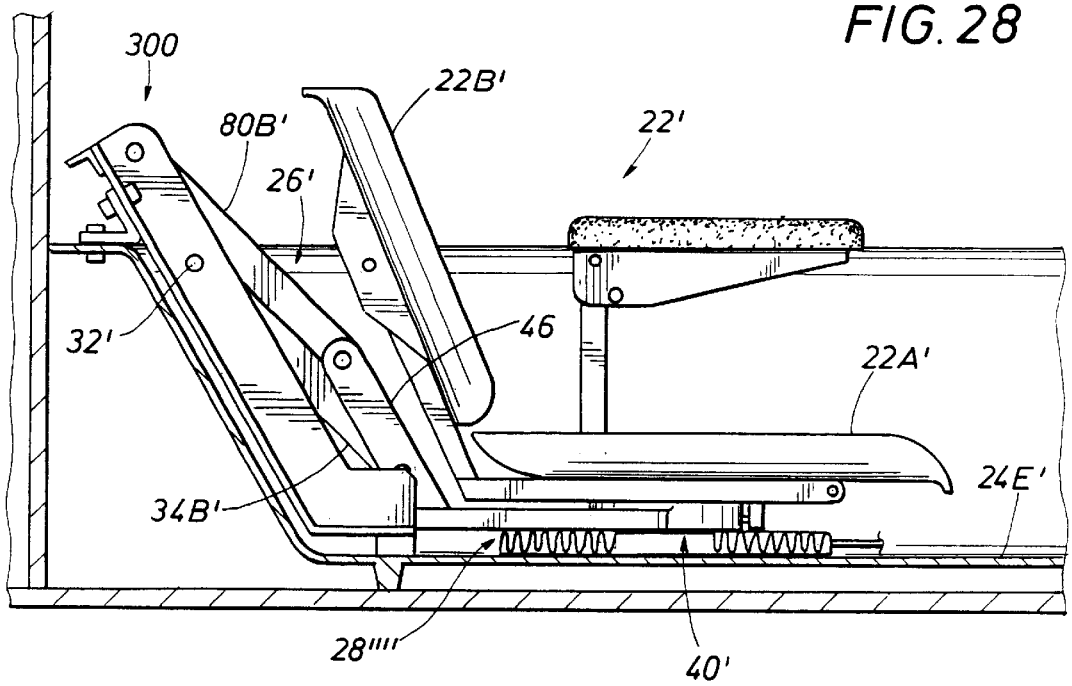
FIG. 28 is a cut-away partial side elevational view of an alternative straight up retrofit embodiment E using a bellows with the seat in the lowered position.
Figure 29:
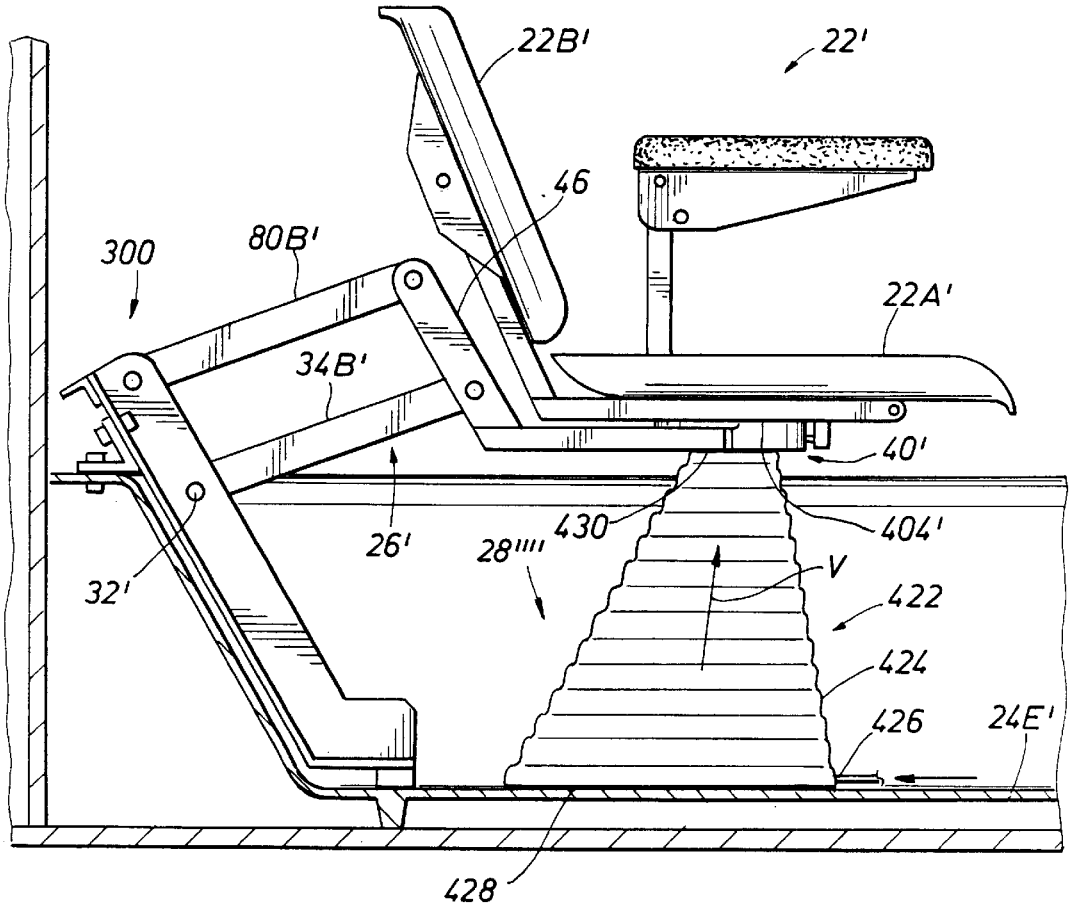
FIG. 29 is a view of an alternative straight up retrofit embodiment E, similar to FIG. 28, showing the seat in the raised position.
Figure 30:
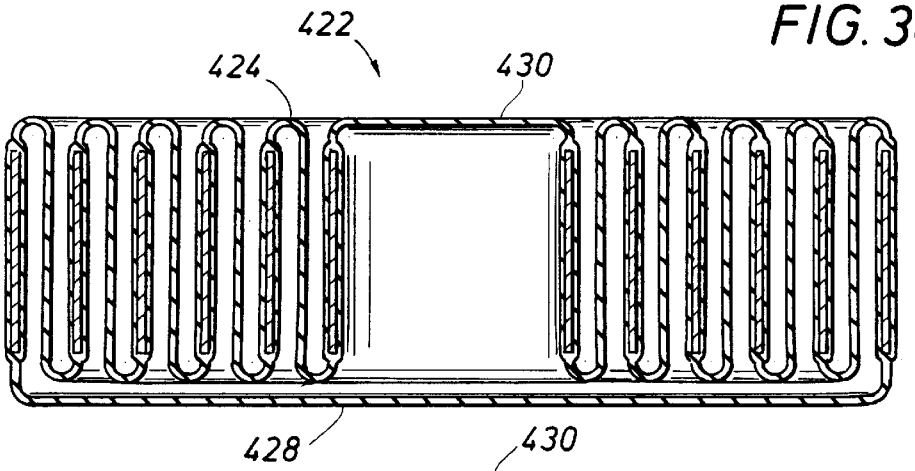
FIG. 30 is an enlarged detail cut-away view of the bellows of alternative straight up retrofit embodiment E with the bellows in the collapsed or folded position.

The bellows member 422 folds into a low profile clearance position (FIG. 28) and expands outwardly in a pyramid shape position, as shown in FIG. 29. The low profile clearance position of deflated bellows member 422 allows the seat 22' to rest close to the bottom 24E' of the bath 20'. The bellows member 422 includes a bellows casing 424, bellows rings 425, a bellows inlet member 426, a bellows bottom 428, and a bellows top 430.

It is contemplated that bellows casing 424 will be attached underneath seat 22', and more specifically, to cylindrical exterior 40A' (FIG. 20) of rotation assembly 40'. Bellows rings 425 are embedded in casing 424 or are otherwise attached thereto to provide structural integrity including expansion resistance and otherwise direct the bellows expansion upwardly, as shown by the arrow V in FIG. 29, rather than bulging outwardly in a direction generally perpendicular to arrow V. As best shown in FIG. 31, bellows rings 425 are embedded in bellows casing 424 such that as the bellow member expands, the concentric rings 425 begin to unfold such that the casing 424 conforms generally to a stair-step like appearance. When fully deployed or expanded the bellows member 422 takes the pyramid shape, as best shown in FIGS. 29 and 32. Such bellows rings 425 could be made of plastic, metal, fiberglass or any other expansion resistant material that would tend to direct the bellows expansion along a path between the bellows top 430 and the bellows bottom 428, rather than side-to-side.

Bellows bottom 428 rests upon bath bottom 24E'. Bellows inlet member 426 allows for fluid to move between the fluid control system 94' (FIG. 13) and bellows member 422. As the bellows member 422 fills with a fluid, it expands and raises seat 22'. With the cantilevered design of the guiding assembly 26', the seat 22' moves along an arcuate path, and as the bellows member 422 is fixedly attached to seat 22', the bellows bottom 428 is pressed against bath bottom 24E, where friction between the bellows bottom 428 and bath bottom 24E' resists movement of such bellows bottom 428 relative to the bath bottom 24E' as the seat is raised and lowered. Here, the bellows casing 424 would expand such that bellows top 430 moves horizontally, and/or forward and/or backward, in relation to bellows bottom 428 and thereby experiences a deformation of its symmetric pyramid shape into an asymmetric form, while efficiently raising seat 22'. Besides the advantages discussed above, the proposed design is advantageous over other bellows design for at least the reason that that the bellows are not attached at the bath bottom, thus allowing for easy cleaning thereunder.

Other embodiments may attach the bellows in an inverted position. Yet other embodiments may attach the bellows bottom 428 to a plate that is otherwise attached to frame 300. Yet other embodiments may use other guiding assemblies, such as, the use of a simple guide pole or poles that extend from frame 300.

Use and Operation of Alternative Straight Up Retrofit Embodiment E

The bather mounts and dismounts seat 22' in the same manner as described in the preferred straight up retrofit embodiment. However, as best shown in FIGS. 13, 28 and 29, to raise seat 22', an operator uses control knob 106' to initiate the flow of fluid, such as water, from feeder pipe 100' through control pipe 108' and ultimately into inlet member 426 of bellows member 422. As water fills bellows member 422, the water pressure expands bellows member 422.

As bellows member 422 deploys or expands, it pushes away from the bottom of seat 22' against the bath bottom 24E' causing seat 22' to move upward. The guiding assembly 26' guides seat 22' along an arcuate path in a vertical plane along the longitudinal direction to a location where the side of seat 22' is at or beyond the top of side wall 24D'. In so moving, the set of arms 34A', 34B' and 80A', 80B' of guiding assembly 26' move in unison from a position pointing substantially towards the bottom of bath 20' to a position pointing substantially away from bath wall 24A' of bath 20', and raise seat bottom 22A' above the top of bath 20'. As bellows member 422 is pushed and pulled along the longitudinal direction (or lateral direction if used with laterally offset embodiment), bellows bottom 428 slides along the bath bottom 24E'.

To lower seat 22', the operator moves control knob 106' to release water from bellows member 422 to discharge pipe 104' into the bath. The weighted seat 22', or, in case a bather is located thereon, the weight of a bather and the seat on bellows member 422 urges the water within bellows member 422 to be ultimately discharged out of inlet member 426 into control pipe 108' and out discharge pipe 104' into the bath overflow drain 370. During the lowering mode, seat 22' experiences a constant and smooth descent towards bath bottom 24E'. It is contemplated that bellows member 422 could be substituted for actuators 28A and 28B in a laterally offset retrofit bath lifting system.

Self-Pressurized System

FIG. 44 is a schematic diagram showing a self-pressurized system, which can be used in all the above embodiments of the invention. The self-pressurized system utilizes many similar component parts as those found in the preferred laterally offset retrofit embodiment (shown in FIGS. 36–43). However, some component parts that differ significantly include the component parts of the lifting power system 30". Some component parts that differ less significantly include component parts of lifting device 28'. More specifically, the lifting power system 30'" is different than its 30" counterpart at least in the following areas: the constant pressure generation mechanism 500 is used to transform electrical power into hydraulic pressure, the fluid control system 94"'s remote control system 562 acts as the user control knob 106 and its four-way valve 584 in combination with its valve controller 586 acts as control valve 102. Lifting power device 28""' is different from its 28' counterpart at least because it contains a second high pressure pipe 510 and corresponding control pipe paths 512A and 512B used in the lowering of seat 22. Further, lifting device 28""' also utilizes hydraulic fluid below the piston heads 504A and 504B so that hydraulic pressure can be applied to the underside of such piston heads to cause the piston to travel in the opposite (seat lowering) direction. It is contemplated that other embodiments of the current invention could instead only use hydraulic fluid on the non-piston rod side of the piston head, as is used in the preferred laterally offset retrofit embodiment. It is also contemplated that the constant pressure generation mechanism 500 could be powered by means other than electricity, for example an internal combustion engine. It is further contemplated that the control valve 102" functionality can be achieved by non-remote and mechanical systems. Further, it is also contemplated that the pressure supplied by constant pressure generation mechanism 500 could be supplied by other sources, such as water tap pressure, stepped-up water tap pressure, or any water pressure means.

Power system 30'" comprises a constant pressure generation mechanism 500, a fluid control system 94" and an outside power source 502. Further, constant pressure generation mechanism 500 contains a pump device 516, an accumulator 518, a constant pressure switch 520 and a safety valve 522. Pump device 516 comprises a hydraulic pump 524, a pump motor 526, a hydraulic fluid reservoir 528, a pump draw line 530, a pump/accumulator line 532, a pump return line 534, a check valve 536, an accumulator/reservoir line 538, a lifting device return line 540 and motor power lines 542 and 544. Accumulator 518 comprises a housing 546, a bladder 548, hydraulic fluid 550, an air pocket 552, a constant pressure switch/accumulator line 554, a pump/accumulator line 532, an accumulator/reservoir line 538 and a lifting device supply line 556. Further, safety valve 522 is mounted in series in accumulator/reservoir line 538. Constant pressure switch 520 contains a pressure sensor 558 connected to a motor power switch 560 in series in motor power line 544. Pressure sensor 558 is connected to accumulator 518 via pressure switch/accumulator line 554. To provide additional safety mechanisms between power source 502 and bath 20 (not shown in FIG. 44), the hydraulic lines of the system can be constructed of a non-electrically conductive high pressure plastic and the hydraulic fluid can have non-electrically conductive properties. Preferably, the second high pressure pipe 510, high pressure pipe 388', are constructed of this non-electrically conductive high pressure plastic while the remainder of the hydraulic lines are constructed with stainless steel, brass, or the like. It is contemplated that the hydraulic fluid used in the self-pressurized system comprises a light oil. Further, it is contemplated that pump device 516 could be achieved through Fenner Fluid Power System, Model No. KP20, supplied by Fenner Fluid Power, which was acquired by SPX Corporation of Rockford, Ill. in 2000. Accumulator 518 could be achieved through Pulseguard Accumulator, Model No. B139x420, supplied by Pulseguard, Inc of Hampstead, N.C. Further, constant pressure switch 520 could be achieved by using a Hyvair Pressure Switch model no. HYV PS20-2K, supplied by Hyvair Corporation of Houston, Tex.

The fluid control system 94" comprises a remote control system 562, a solenoid valve 102" and needle valves 580 and 582. Remote control system 562 contains a remote control receiver 564 and a remote control transmitter 566. The remote control receiver 564 contains radio wave receiver 574, solenoid valve power switch 572 and solenoid valve power lines 576 and 578. Radio wave receiver 574 is connected to solenoid valve power switch 572. The solenoid valve power switch 572 is connected in series with solenoid valve power line 578. The remote control transmitter 566 contains a twelve volt remote battery 570 connected to a radio transmitter 568 with a user button 569. It is contemplated that the remote control transmitter 566 could be sealed within an air/water tight malleable container which would allow the activation of the user button 569 while preventing any fluids or other matter from penetrating the contents of the sealed container. It is also contemplated that such a container could include a sufficient buoyant material, i.e., sufficient air content, foam, etc., to give the remote control transmitter 566 buoyant properties. It is also contemplated that the remote battery 570 would have a working of life of years before needing replacement. Further, solenoid valve 102" contains a four-way valve 584 and a valve controller 586. The four-way valve 584 is connected to the valve controller 586. The valve controller 586 is connected to solenoid valve power lines 576 and 578 and is used to switch the valve between its first and second states. The four-way valve 584 has two states: the first state is where lifting device supply line 556 is in fluid communication with high pressure pipe 388' and lifting device return line 540 is in fluid communication with second high pressure pipe 510, and the second state is where lifting device supply line 556 is in fluid communication with second high pressure pipe 510 and lifting device return line 540 is in fluid communication with high pressure pipe 388'. Here, the first state corresponds to the raising of the seat and the second state corresponds to the lowering of the seat. In addition, needle valve 580 is located within lifting device supply line 556 and needle valve 582 is located within lifting device return line 540 for adjusting the rate of flow in the corresponding lifting device return lines. It is contemplated that the remote control receiver 564 and the remote control transmitter 566 work together at a distance as great as 100 feet. It is further contemplated that a hardwired or manual system could be used in place of the remote control system 562, however, the separation of the high voltage from near proximity to the water within the bath inherent in the remote system is generally believed to be a more desirable design. It is contemplated that control receiver 564 and a remote control transmitter 566 can be achieved by using Westek Model Nos. RFA 114 and RFA 110 respectively, supplied by AmerTac of Monsey, N.Y. Further, it is contemplated that solenoid valve 102" could be achieved through Bosch Valve with AC/DC Solenoid and Wiring Box, Model No. 9810231012, supplied by Bosch Rexroth Corporation of Bethlehem, Pa.

Lifting device 28"" contains many similar components of those of lifting device 28', as indicated in FIG. 36 of the preferred laterally offset retrofit embodiment. Some examples of similar components visible in FIG. 44 include: "T" connector 366', control pipe path 388A', control pipe path 388B', lifting actuator 28A', lifting actuator 28B', lifting piston rod 386A' and lifting piston rod 586B'. Other components relatively dissimilar to those of the components of the preferred laterally offset retrofit embodiment include: lifting device 28""'s additional components that allow the inflow and outflow of hydraulic fluid behind the piston heads 504A and 504B. As shown in FIG. 44, piston heads 504A and 504B have, respectively, piston head front surfaces 506A and 506B and piston head rear surfaces 508A and 508B. The piston head seals (not shown) used in this design may be similar to directional seals 124' and 372 described earlier. Other additional components include: a second high pressure pipe 510, a "T" connector 588, and two control pipe paths 512A and 512B. Each of the control pipe paths 512A and 512B communicate fluid to the rod side of the piston in the respective lifting actuators 28A' and 28B'.

Use and Operation of Self-Pressurized System

The operation of the self-pressurized system has many similarities to the operation of the preferred laterally offset retrofit embodiment as shown in FIGS. 36–43. While the self-pressurized system only aesthetically appears to differ from the preferred laterally offset retrofit embodiment in that it utilizes a remote control transmitter 566 in place of a mechanical knob or switch, the differences extend beyond that generally viewable by the naked eye. For example, both the power system 30'" and the lifting device 28"" contain components that are either not present or that are different from those found in the preferred laterally offset retrofit embodiment.

It is useful to first describe how the constant pressure generation mechanism 500 works to generate and continually maintain a relatively constant pressure. This constant pressure is ultimately used by fluid control system 94" and lifting device 28"" to extend and retract lifting actuators 28A' and 28B'. In the current embodiment the pressure maintained in the accumulator 518 is about 1500 psi and the accumulator 518 has a maximum capacity of 2800 psi. In operation, if pressure sensor 558 detects a pressure below a minimum psi level in pressure switch/accumulator line 554 it signals the motor power switch 560 to close resulting in the connection of power from the outside power source 502 to the pump motor 526. Being connected to power source 502, pump motor 526 then drives hydraulic pump 524 causing the pumping of hydraulic fluid from hydraulic fluid reservoir 528 through pump draw line 530, through hydraulic pump 524, through pump/accumulator line 532 and into accumulator 518 on the hydraulic fluid 550 side of bladder 548. In contrast, when pressure sensor 558 detects a pressure at or above its maximum normal psi level it signals motor power switch 560 to open, breaking the circuit, and thereby removing power to pump motor 526 and thus stopping the further pressurization within accumulator 518. If the hydraulic pressure from the pump/accumulator line 532 is above a maximum abnormal psi value, the hydraulic pump 524 allows the hydraulic fluid to drain from the pump/accumulator line 532 through the hydraulic pump 524, exiting through the pump return line 534, through the check valve 536, into the hydraulic fluid reservoir 528, until the pressure from the pump/accumulator line 532 falls below such maximum abnormal psi value. As a second safety mechanism, safety valve 522 and accumulator/reservoir line 538 are used to relieve pressure from accumulator 518 when the pressure therein reaches a maximum allowable accumulator psi. If this maximum allowable accumulator psi is reached, safety valve 522 opens and allows hydraulic fluid to drain directly from accumulator 518 through accumulator/reservoir line 538 and safety valve 522 into hydraulic fluid reservoir 528. In sum, constant pressure generation mechanism 500 works independently to maintain pressurized hydraulic fluid to be utilized by the rest of the system via lifting device supply line 556.

As an illustrative example for this embodiment, the pressure sensor 558 can be set at a pressure between 1400 to 1600 psi, the check valve 536 can be set at a pressure of 2000 psi, and the check safety valve 522 can be set at a pressure of 2600 psi. When the motor power switch 560 is closed, the pump motor 526 and hydraulic pump 524 are operating—thus pressurizing accumulator 518. When the accumulator 518 reaches the set pressure of the pressure sensor 558 (1400 to 1600 psi in this example), the pressure sensor 558 should send a signal to the motor power switch 560, effectively shutting down the pump motor 526 and hydraulic pump 524—thus stopping the accumulation of pressure in the accumulator 518. However, should the pressure sensor 558 fail to activate or should the motor power switch 560 fail to open the circuit, the pump motor 526 will continue to operate hydraulic pump 524, accumulating pressure in the accumulator 518 and associated pump/accumulator line 532. When the check valve 536 senses the pressure at the hydraulic pump 524 reaching a level of 2000 psi, the check valve 536 opens and drains the pump/accumulator line 532, protecting the hydraulic pump 526 from its own power and preventing the increase of pressure in accumulator 518. At this point, the hydraulic pump 524 will essentially circulate hydraulic fluid from the hydraulic fluid reservoir 528 up through the draw line 530 and back down through the return line 534 through the check valve 536. Such an operation will continue until the pressure drops below 2000 psi, causing the check valve 536 to close. If the accumulator 518 continues to pressurize despite the aforementioned features, the safety valve 522 will open when the accumulator 518 reaches a pressure of 2600 psi, allowing the pressure in the accumulator 518 to dissipate via accumulator reserve line 538 to the hydraulic fluid reservoir 528.

With the pressure provided by constant pressure generation mechanism 500, the bather and/or operator is able to control the transfer of hydraulic fluid from constant pressure generation mechanism 500 to lifting device 28"", and ultimately control the raising and lowering of seat 22, by using fluid control system 94". Specifically, using the fluid control system 94", the bather and/or operator transitions the seat 22 between a lowered and a raised position by the press of user button 569 on remote control transmitter 566. When user button 569 is depressed it generates a radio signal that is received by radio wave receiver 574. Once received, the radio wave receiver 574 signals solenoid valve power switch 572 to change its current state (i.e., open or closed). The solenoid valve power switch 572 then either closes or opens, i.e., connects or disconnects solenoid valve power line 578 to outside power source 502, depending on its last state. If the solenoid valve power switch 572 in its open state, i.e., the lowering state, then no power is supplied to valve controller 586, and as a result, the valve controller 586 maintains the four-way valve 584 with its corresponding connections where lifting device supply line 556 is in communication with second high pressure pipe 510 and lifting device return line 540 is in communication with high pressure pipe 388'. If, however, the solenoid valve power switch 572 is instead in its closed state, i.e., the raising state, then power is then supplied to valve controller 586, and as a result, the valve controller 586 maintains the four-way valve 584 with its corresponding connections where lifting device supply line 556 is in communication with high pressure pipe 388' and lifting device return line 540 is in communication with second high pressure pipe 510. In addition, needle valves 580 and 582 can be adjusted to reduce the flow rate within lifting device supply line 556 and lifting device return line 540, respectively, thus effecting the speed at which the seat raises and lowers. In sum, depending on the current state, i.e., a raising state or a lowering state, high pressure pipes 388' and 510, are either high and low, or low and high, respectively. Further, it is contemplated that a safety reversing mechanism, not too dissimilar to those used in conjunction with automatic garage doors, may be utilized with this embodiment for the purpose of halting downward movement of the mechanism when a solid foreign body is detected as being present below such mechanism.

Lifting device 28"", capable of providing a pull force (towards a piston head) or a push force (away from a piston head) to a connecting piston rod depending which of the two high pressure pipes 388' or 510 contains high pressure and which contains low pressure, as determined by fluid control system 94". A push force will raise the seat during a seat raising state and a pull force will lower the seat during a seat lowering state. In the seat raising state, i.e., where high pressure pipe 388' contains high pressure and second high pressure pipe 510 contains low pressure, the preferred self-pressurized embodiment operates similarly to that of the preferred laterally offset retrofit embodiment. Here, the high pressure hydraulic fluid from high pressure pipe 388' flows through "T" connector 366' into control pipe paths 388A' and 388B', and then into lifting actuators 28A' and 28B' causing a force to be applied to piston head front surfaces 506A and 506B and down (push force) the respective lifting piston rods 386A' and 386B', causing such piston rods to extend outwardly away from the respective lifting actuators. What is not similar about the seat raising state of operation of the operation of the self-pressurized system to that of the similar operation of the preferred laterally offset retrofit embodiment is the presence and displacement of the hydraulic fluid located on the rod side of piston heads 504A and 504B. As the piston rods 386A' and 386B' extend outwardly away from their respective lifting actuators, and the piston heads 504A and 504B down their respective lifting actuators, the fluid behind such piston heads, i.e., the hydraulic fluid in contact with the piston head rear surfaces 508A and 508B and in fluid communication with control pipe paths 512A and 512B, is forced out of the lifting actuators into control pipe paths 512A and 512B, through "T" connector 588, into second high pressure pipe 510, through four-way valve 584, through lifting device return line 540 and into hydraulic fluid reservoir 528.

When the self-pressurized system is in the seat lowering state, i.e., where second high pressure pipe 510 contains high pressure and high pressure pipe 388' contains low pressure, it operates significantly differently than the preferred laterally offset retrofit embodiment. Here, the high pressure hydraulic fluid from second high pressure pipe 510 flows through "T" connector 588 into control pipe paths 512A and 512B, and then into lifting actuators 28A' and 28B' where the high pressure hydraulic fluid pushes on piston head rear surfaces 508A and 508B causing a force to be applied up (pull force) the respective lifting piston rods 386A' and 386B', causing such piston rods to retract inwardly towards their respective lifting actuators. As the lifting piston rods 386A' and 386B' move up their respective lifting actuators, fluid in front of piston heads 504A and 504B, i.e., fluid in contact with respective piston head front surfaces 506A and 506B and in fluid communication with respective control pipe paths 388A' and 388B', is forced out of the respective lifting actuators 28A' and 28B' into control pipe paths 388A' and 388B', through "T" connector 366', into high pressure pipe 388', through four-way valve 584, through lifting device return line 540 and into hydraulic fluid reservoir 528. Although, only two states, raising and lowering, are discussed above, it is contemplated that a stop, or pause, state could also be deployed. In such a state the seat could be stopped or paused anywhere along its normal path. Such a stopping or pausing could be achieved in many ways including, but not limited to, utilizing a four-way valve 584 that allows the blocking of flow between the pipes on either side of such valve or utilizing an additional valve for blocking any one or more of the pipes transferring hydraulic fluid in and out of lifting device 28"".

It is to be expressly understood that the lifting power system 30'" described with reference to FIG. 44 can replace the power systems of all the other embodiments described herein. For example, power system 30'" can replace drive system 96 in the composite embodiment of FIG. 6.

The foregoing disclosure and description is intended only to be illustrative and explanatory thereof. To the extent foreseeable, various changes in the size, shape, and materials, as well as in the details of illustrative construction and assembly, may be made without departing from the spirit of the invention.

We claim:

1. A system for moving a seat in a bath, the bath having a side wall and a wall behind the seat, comprising:

a guiding assembly disposed within the bath and between the wall behind the seat and the seat;

a hydraulic fluid;

a pressure generation mechanism to control pressure of said hydraulic fluid; and a lifting device in association with said guiding assembly for moving the seat between a raised position and a lowered position, wherein said raised position is laterally offset from said lowered position, said guiding assembly guides the seat in a straight line between said lowered position and said raised laterally offset position from said lowered position towards the side wall of the bath, and said lifting device uses said hydraulic pressure to move the seat.

2. The system of claim 1, further comprising:

a frame disposed within the bath, wherein said frame is located between the wall behind the seat and the seat, and said guiding assembly is attached to said frame.

3. A system adapted for use with a bath having a side wall and a seat back, and for moving a seat, comprising:

a guiding assembly disposed within the bath while the seat moves between a lowered position and a raised position, wherein said guiding assembly is substantially covered by the seat back when the seat is in said lowered position, and said raised position is laterally offset from said lowered position, and said guiding assembly moves the seat in a straight line between said lowered position and said raised laterally offset position from said lowered position towards the side wall of the bath;

a hydraulic fluid;

a source for generating a constant pressure on said hydraulic fluid; and a lifting device in association with said guiding assembly, wherein said lifting device moves the seat between said lowered and said raised position, and said lifting device uses said hydraulic fluid to move the seat.

4. The system of claim 3, wherein:

said lifting device is substantially covered by the seat back when the seat is in said lowered position.

5. The system of claim 3, wherein the bath having a wall behind the seat, and said guiding assembly is pivotally attached between the wall behind the seat and the seat.

6. The system of claim 3, wherein said guiding assembly pivotally guides the seat between said lowered position and said raised laterally offset position from said lowered position towards the side wall of the bath.

7. The system of claim 3, wherein the bath having a wall behind the seat, further comprising:

a frame disposed within the bath, wherein said frame is disposed between the wall behind the seat and the seat, and said guiding assembly is attached to said frame.

8. The system of claim 7, further comprising the wall behind the seat having a top, wherein said frame is attached adjacent to the top of the wall behind the seat.

9. The system of claim 7, further comprising the bath having a bath bottom, wherein said frame is further disposed between the seat and the bath bottom.

10. The system of claim 7, wherein said guiding assembly comprises a first arm pivotally connected to said frame.

11. The system of claim 3, further comprising a closed hydraulic system for maintaining said hydraulic fluid.

12. The system of claim 3, wherein said source comprises an accumulator.

13. A system adapted for use with a bath having a side wall, comprising:

a seat having a seat back;

a guiding assembly for guiding movement of said seat in a straight line between a lowered position and a raised laterally offset position from said lowered position towards the side wall of the bath;

a lifting device in association with said guiding assembly for moving said guiding assembly;

a hydraulic fluid; and a pressure generation mechanism to control pressure of said hydraulic fluid, wherein said lifting device uses said hydraulic fluid for moving said seat, said seat back substantially covers said guiding assembly and said lifting device, and said seat back is movable between an operating position and an access position to allow access to said guiding assembly and said lifting device.

14. The system of claim 13, wherein:

said seat is pivoted from said guiding assembly.

15. The system of claim 13, further comprising:

a rotation assembly, wherein said rotation assembly is connected to said guiding assembly.

16. The system of claim 13, wherein said seat includes a telescopic arm rest.

17. A system adapted for use with a bath having a side wall, comprising:

a frame sized to be received in the bath;

a seat having a seat back;

a guiding assembly connected to said frame and for guiding movement of said seat in a straight line between a lowered position and a raised laterally offset position from said lowered position towards the side wall of the bath;

a lifting device in association with said guiding assembly for moving said guiding assembly;

a hydraulic fluid; and a source for generating a constant pressure on said hydraulic fluid, wherein said lifting device uses said hydraulic fluid for moving said guiding assembly.

18. The system of claim 17, wherein:

said lifting device is connected between said guiding assembly and said frame.

19. A system for a bath having a side wall, comprising:

a seat;

a hydraulic fluid;

a closed hydraulic system for maintaining said hydraulic fluid;

a pressure generation mechanism to control pressure of said hydraulic fluid;

a guiding assembly for guiding movement of said seat in a straight line between a lowered position and a raised laterally offset position from said lowered position towards the side wall of the bath; and a lifting device in association with said guiding assembly for moving said seat between said raised laterally offset position and said lowered position, wherein said lifting device uses said hydraulic fluid to move said seat.

20. The system of claim 19, wherein said seat includes a telescopic arm rest.

21. The system of claim 19, wherein said pressure generation mechanism comprises an accumulator for controlling said hydraulic fluid.

22. The system of claim 19, wherein said pressure generation mechanism further comprises:

a pump for pressurizing said hydraulic fluid; and a pressure switch for controlling operation of said pump.

23. The system of claim 19, wherein said pressure generation mechanism includes a hydraulic fluid reservoir.

24. The system of claim 19, further comprising:

a remote control system; and a control valve connected to said remote control system for controlling fluid flow between said pressure generation mechanism and said lifting device.

25. The system of claim 24, wherein said control valve is a four-way control valve.

26. The system of claim 19, wherein said lifting device further comprises a hydraulic lifting actuator having a piston rod and a piston head, and wherein said hydraulic lifting actuator provides a pull force along said piston rod towards said piston head to lower said seat.

27. The system of claim 26, wherein said piston head further comprises a piston head rear surface, and wherein high pressure hydraulic fluid communicates with said piston head rear surface.

28. A system for moving a seat in a bath, the bath having a side wall and a wall behind the seat, comprising:

a guiding assembly disposed within the bath and attached to the wall behind the seat, wherein said guiding assembly moves in a straight line between a lowered position and a raised laterally offset position from said lowered position towards the side wall of the bath a hydraulic fluid having a pressure;

a pressure generation mechanism to control said pressure of said hydraulic fluid; and a lifting device in association with said guiding assembly for moving the seat between said raised laterally offset position and said lowered position, wherein said lifting device uses said hydraulic fluid to move the seat.

29. The system of claim 28, wherein said pressure generation mechanism includes an accumulator for controlling said hydraulic pressure.

30. The system of claim 28, wherein said pressure generation mechanism further comprises:

a pump for pressurizing said hydraulic fluid; and a pressure switch for controlling the operation of said pump.

31. The system of claim 28, further comprising:

a remote control system; and a valve connected to said remote control system for controlling fluid flow between said pressure generation mechanism and said lifting device.

32. The system of claim 31, wherein said valve is a four-way control valve.

33. A system for moving a seat in a bath, the bath having a side wall and a wall behind the seat, comprising:

a guiding assembly, disposed within the bath and between the wall behind the seat and the seat, for guiding movement of the seat in a straight line between a lowered position and a raised laterally offset position from said lowered position towards the side wall of the bath a hydraulic fluid having a pressure;

a pressure generation mechanism to control said pressure of said hydraulic fluid; and a lifting device in association with said guiding assembly for moving the seat between said raised position and said lowered position, wherein said lifting device uses said hydraulic fluid to move the seat.

34. The system of claim 33, wherein said pressure generation mechanism comprises an accumulator.

35. The system of claim 33, wherein said pressure generation mechanism further comprises:

a pump for pressurizing said hydraulic fluid; and a pressure switch for controlling the operation of said pump.

36. The system of claim 33, further comprising:

a remote control system; and a valve connected to said remote control system for controlling fluid flow between said pressure generation mechanism and said lifting device.

37. A system for moving a seat in a bath, the bath having a side wall and a wall behind the seat, comprising:

a guiding assembly disposed within the bath and between the wall behind the seat and the seat;

a lifting device in association with said guiding assembly for moving the seat between a raised position and a lowered position, wherein said raised position is laterally offset from said lowered position, and said guiding assembly moves in a straight line between said lowered position and said raised laterally offset position from said lowered position towards the side wall of the bath; and a remote control system, wherein said remote control system electronically activates said lifting device.

38. The system of claim 37, wherein said remote control system includes a wireless transmitter and a wireless receiver.

39. The system of claim 38, wherein said wireless transmitter is sealed within a container.

40. The system of claim 37, further comprising:

a hydraulic fluid having a pressure; and a pressure generation mechanism to control said pressure of said hydraulic fluid, wherein said lifting device uses said hydraulic fluid to move the seat.

41. The system of claim 40, wherein said pressure generation mechanism comprises an accumulator.

42. The system of claim 40, wherein said pressure generation mechanism comprises:

a pump for pressurizing said hydraulic fluid; and a pressure switch for controlling the operation of said pump.

43. The system of claim 40, further comprising:

a valve connected to said remote control system for controlling fluid flow between said pressure generation mechanism and said lifting device.

44. A system for moving a seat in a bath, the bath having a side wall and a wall behind the seat, comprising:

a guiding assembly;

a hydraulic fluid;

a lifting device in association with said guiding assembly for moving the seat between a raised position and a lowered position, wherein said lifting device uses said hydraulic fluid to move the seat, said raised position is laterally offset from said lowered position, and said guiding assembly moves the seat in a straight line between said lowered position and said raised laterally offset position from said lowered position towards the side wall of the bath; and a pressure generation mechanism to control said hydraulic fluid, wherein said pressure generation mechanism comprises:

a pump for pressurizing said hydraulic fluid, and a pump check device.

45. A system adapted for use with a bath having a side wall and for moving a seat, comprising:

a guiding assembly for guiding movement of the seat in a straight line between a lowered position and a raised laterally offset position from said lowered position towards the side wall of the bath;

a lifting device in association with said guiding assembly for moving the seat;

a hydraulic fluid; and a source for generating a constant pressure on said hydraulic fluid, wherein said lifting device uses said hydraulic fluid for moving the seat, and said hydraulic fluid is water.

46. The system of claim 45, wherein said hydraulic fluid comprises standard tap water.

47. The system of claim 46, wherein said source is a pressure generation mechanism.

48. The system of claim 45, wherein said source comprises a hydraulic pressure multiplier system.

49. The system of claim 45, wherein said source is a pressure generation mechanism.

50. The system of claim 45, further comprising a piston head, wherein said hydraulic fluid moves said piston head, and said movement of said piston head moves the seat to said raised position.

51. The system of claim 50, wherein said movement of said piston head creates a pulling force.

52. The system of claim 50, further comprising a piston rod, coupled to said piston head, and a piston housing wherein said hydraulic fluid moving said piston head forces said piston rod into said piston housing.

53. The system of claim 50, further comprising an accumulator for controlling said hydraulic fluid.

54. The system of claim 50, wherein said movement of said piston head creates a pushing force.

* * * * *